US006928406B1

(12) United States Patent
Ehara et al.

(10) Patent No.: US 6,928,406 B1
(45) Date of Patent: Aug. 9, 2005

(54) EXCITATION VECTOR GENERATING APPARATUS AND SPEECH CODING/ DECODING APPARATUS

(75) Inventors: Hiroyuki Ehara, Yokohama (JP); Toshiyuki Morii, Kawasaki (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 0 days.

(21) Appl. No.: 09/674,442

(22) PCT Filed: Mar. 2, 2000

(86) PCT No.: PCT/JP00/01225

§ 371 (c)(1),
(2), (4) Date: Nov. 1, 2000

(87) PCT Pub. No.: WO00/54258

PCT Pub. Date: Sep. 14, 2000

(30) Foreign Application Priority Data

Mar. 5, 1999 (JP) ..... 11-059520
Nov. 4, 1999 (JP) ..... 11-314271

(51) Int. Cl.[7] ..... G10L 19/12
(52) U.S. Cl. ..... 704/223; 704/222; 704/200
(58) Field of Search ..... 704/230, 219, 704/207, 235, 243, 223, 220, 222; 381/54

(56) References Cited

U.S. PATENT DOCUMENTS 3,825,685 A * 7/1974 Roworth ..... 381/54
5,327,519 A * 7/1994 Haggvist et al. ..... 704/219
5,377,302 A * 12/1994 Tsiang ..... 704/235
5,444,816 A * 8/1995 Adoul et al. ..... 704/219
5,754,976 A * 5/1998 Adoul et al. ..... 704/223
5,970,444 A * 10/1999 Hayashi et al. ..... 704/223
6,094,630 A * 7/2000 Nomura ..... 704/230
6,415,254 B1 * 7/2002 Yasunaga et al. ..... 704/223

FOREIGN PATENT DOCUMENTS

| | | |
|---|---|---|
| JP | 02294700 | 12/1990 |
| JP | 06012098 | 1/1994 |
| JP | 07295596 | 11/1995 |
| JP | 8123493 | 5/1996 |
| JP | 96396 | 1/1997 |
| JP | 10513571 | 12/1998 |

OTHER PUBLICATIONS

English tanslation of "Improved Multi–Dispersed–Pulse Based CELP Coding In A Noisy Environment", Ehara et al.*
English translation of JP 2–294700.*
English translation of "Low–Bit–Rate Speech Coding With Multi–Dispersed–Pulse–Based Codebook", Yasunaga et al.*
Yasunaga et al., "A Low Bit Rate Speech Coding With Multi Dispersed Pulse Based Codebook" Proceedings of Research Presentation Autumn Meeting in 1998 of the Acoustical Society of Japan (ASJ), 3–2–17 (1998), pp. 281–282 with partial translation.
Yasunaga et al., "Improved Multi–Dispersed–Pulse Based CELP Coding in a Noisy Environment", Proceedings of Research Presentation Autumn Meeting in 1998 of The Acoustical Society of Japan (ASJ), 3–2–18 (1998), pp. 283–284 with partial translation.

* cited by examiner

*Primary Examiner*—David Ometz
*Assistant Examiner*—Jakieda R Jackson
(74) *Attorney, Agent, or Firm*—Stevens, Davis, Miller & Mosher, LLP

(57) ABSTRACT

The total number of entries of an algebraic codebook is decreased by liming a random code vector generated from the algebraic codebook, and entries of a random codebook with a large number of pulses are assigned to a decreased portion. Further, the number of entries of the decreased portion is adaptively switched according to a mode.

6 Claims, 39 Drawing Sheets

| PULSE NUMBER | PULSE POSITION |
|---|---|
| 1 | 0,2,4,6,8,10,12,14,16,18,20,22,24,26,28,30,32,34,36,38,40,42,44,46,48,50,52,54,56,58,60,62,64,66,68,70,72,74,76,78 |
| 2 | 1,3,5,7,9,11,13,15,17,19,21,23,25,27,29,31,33,35,37,39,41,43,45,47,49,51,53,55,57,59,61,63,65,67,69,71,73,75,77,79 |

40 × 40 = 1600

RELATED ART

FIG.2

| PULSE NUMBER | PULSE POSITION |
|---|---|
| 1 | 0,3,6,9,12,15,18,21,24,27,30,33,36,39,42,45,48,51,54,57,60,63,66,69,72,75,78 |
| 2 | 1,4,7,10,13,16,19,22,25,28,31,34,37,40,43,46,49,52,55,58,61,64,67,70,73,76,79 |
| 3 | 2,5,8,11,14,17,20,23,26,29,32,35,38,41,44,47,50,53,56,59,62,65,68,71,74,77 |

27 × 27 × 26 = 18954

RELATED ART

FIG.3

(a)

| PULSE NUMBER | PULSE POSITION |
|---|---|
| 1 | 0,2,4,6,8,10,12,14,16,18,20,22,24,26,28,30,32,34,36,38,40,42,44,46,48,50,52,54,56,58,60,62,64,66,68,70,72 |
| 2 | P1+1,P1+3,P1+5,P1+7 |

(b)

| PULSE NUMBER | PULSE POSITION |
|---|---|
| 1 | P2+1,P2+3,P2+5,P2+7, |
| 2 | 1,3,5,7,9,11,13,15,17,19,21,23,25,27,29,31,33,35,37,39,41,43,45,47,49,51,53,55,57,59,61,63,65,67,69,71 |

(c)

| PULSE NUMBER | PULSE POSITION |
|---|---|
| 1 | 74,76,78 |
| 2 | 73,75,77,79 |

$37 \times 4+36 \times 4+3 \times 4=304$

FIG.8

(a)

| PULSE NUMBER | PULSE POSITION (a) |
|---|---|
| 1 | 0,3,6,9,12,15,18,21,24,27,30,33,36,39,42,45,48,51,54,57,60,63,66,69,72 |
| 2 | P1+1,P1+4,P1+7 |
| 3 | 2,5,8,11,14,17,20,23,26,29,32,35,38,41,44,47,50,53,56,59,62,65,68,71,74,77 |

(b)

| PULSE NUMBER | PULSE POSITION (b) |
|---|---|
| 1 | P2+2,P2+5,P2+8 |
| 2 | 1,4,7,10,13,16,19,22,25,28,31,34,37,40,43,46,49,52,55,58,61,64,67,70 |
| 3 | 2,5,8,11,14,17,20,23,26,29,32,35,38,41,44,47,50,53,56,59,62,65,68,71,74,77 |

(c)

| PULSE NUMBER | PULSE POSITION (c) |
|---|---|
| 1 | 75,78 |
| 2 | 73,76,79 |
| 3 | 2,5,8,11,14,17,20,23,26,29,32,35,38,41,44,47,50,53,56,59,62,65,68,71,74,77 |

(d)

| PULSE NUMBER | PULSE POSITION (d) |
|---|---|
| 1 | 0,3,6,9,12,15,18,21,24,27,30,33,36,39,42,45,48,51,54,57,60,63,66,69 |
| 2 | 1,4,7,10,13,16,19,22,25,28,31,34,37,40,43,46,49,52,55,58,61,64,67,70,73,76,79 |
| 3 | P1+2,P1+5,P1+8 |

(e)

| PULSE NUMBER | PULSE POSITION (e) |
|---|---|
| 1 | P3+1,P3+4,P3+7 |
| 2 | 1,4,7,10,13,16,19,22,25,28,31,34,37,40,43,46,49,52,55,58,61,64,67,70,73,76,79 |
| 3 | 2,5,8,11,14,17,20,23,26,29,32,35,38,41,44,47,50,53,56,59,62,65,68,71 |

(f)

| PULSE NUMBER | PULSE POSITION (f) |
|---|---|
| 1 | 72,75,78 |
| 2 | 1,4,7,10,13,16,19,22,25,28,31,34,37,40,43,46,49,52,55,58,61,64,67,70,73,76,79 |
| 3 | 74,77 |

(g)

| PULSE NUMBER | PULSE POSITION (g) |
|---|---|
| 1 | 0,3,6,9,12,15,18,21,24,27,30,33,36,39,42,45,48,51,54,57,60,63,66,69,72,75,78 |
| 2 | 1,4,7,10,13,16,19,22,25,28,31,34,37,40,43,46,49,52,55,58,61,64,67,70 |
| 3 | P2+1,P2+4,P2+7 |

(h)

| PULSE NUMBER | PULSE POSITION (h) |
|---|---|
| 1 | 0,3,6,9,12,15,18,21,24,27,30,33,36,39,42,45,48,51,54,57,60,63,66,69,72,75,78 |
| 2 | P3+2,P3+5,P3+8 |
| 3 | 2,5,8,11,14,17,20,23,26,29,32,35,38,41,44,47,50,53,56,59,62,65,68,71 |

(i)

| PULSE NUMBER | PULSE POSITION (i) |
|---|---|
| 1 | 0,3,6,9,12,15,18,21,24,27,30,33,36,39,42,45,48,51,54,57,60,63,66,69,72,75,78 |
| 2 | 73,76,79 |
| 3 | 74,77 |

$(25 \times 3+3 \times 24+2 \times 3) \times 26+(24 \times 3+3 \times 24+3 \times 2) \times 27+(24 \times 3+3 \times 24+3 \times 2) \times 27=12078$

FIG.14

| pulse1(=P1)/CH1 | pulse2(=P2)/CH2 | INDEX |
|---|---|---|
| 0 | P1+1 | 0 |
| 0 | P1+3 | 1 |
| 2 | P1+1 | 2 |
| 2 | P1+3 | 3 |
| 4 | P1+1 | 4 |
| 4 | P1+3 | 5 |
| 6 | P1+1 | 6 |
| 6 | P1+3 | 7 |
| P2+1 | 1 | 8 |
| P2+3 | 1 | 9 |
| P2+1 | 3 | 10 |
| P2+3 | 3 | 11 |
| P2+1 | 5 | 12 |
| P2+3 | 5 | 13 |
| P2+1 | 7 | 14 |
| P2+3 | 7 | 15 |
| Ra0 | Rb0 | 16 |
| Ra0 | Rb1 | 17 |
| Ra0 | Rb2 | 18 |
| Ra0 | Rb3 | 19 |
| Ra1 | Rb0 | 20 |
| Ra1 | Rb1 | 21 |
| Ra1 | Rb2 | 22 |
| Ra1 | Rb3 | 23 |
| Ra2 | Rb0 | 24 |
| Ra2 | Rb1 | 25 |
| Ra2 | Rb2 | 26 |
| Ra2 | Rb3 | 27 |
| Ra3 | Rb0 | 28 |
| Ra3 | Rb1 | 29 |
| Ra3 | Rb2 | 30 |
| Ra3 | Rb3 | 31 |

PARTIAL ALGEBRAIC CODEBBOK SIZE=4×2+4×2=16
RANDOM CODEBOOK SIZE=4×4=16

FIG.25A

| pulse1(=P1)/CH1 | pulse2(=P2)/CH2 | INDEX |
|---|---|---|
| 0 | P1+1 | 0 |
| Ra4 | Rb0 | 1 |
| 2 | P1+1 | 2 |
| Ra4 | Rb1 | 3 |
| 4 | P1+1 | 4 |
| Ra4 | Rb2 | 5 |
| 6 | P1+1 | 6 |
| Ra4 | Rb3 | 7 |
| P2+1 | 1 | 8 |
| Ra5 | Rb0 | 9 |
| P2+1 | 3 | 10 |
| Ra5 | Rb1 | 11 |
| P2+1 | 5 | 12 |
| Ra5 | Rb2 | 13 |
| P2+1 | 7 | 14 |
| Ra5 | Rb3 | 15 |
| Ra0 | Rb0 | 16 |
| Ra0 | Rb1 | 17 |
| Ra0 | Rb2 | 18 |
| Ra0 | Rb3 | 19 |
| Ra1 | Rb0 | 20 |
| Ra1 | Rb1 | 21 |
| Ra1 | Rb2 | 22 |
| Ra1 | Rb3 | 23 |
| Ra2 | Rb0 | 24 |
| Ra2 | Rb1 | 25 |
| Ra2 | Rb2 | 26 |
| Ra2 | Rb3 | 27 |
| Ra3 | Rb0 | 28 |
| Ra3 | Rb1 | 29 |
| Ra3 | Rb2 | 30 |
| Ra3 | Rb3 | 31 |

PARTIAL ALGEBRAIC CODEBOOK SIZE=4×1+4×1=8
RANDOM CODEBOOK SIZE=6×4=24

FIG.25B

| pulse1(=P1)/CH1 | pulse2(=P2)/CH2 | INDEX |
|---|---|---|
| 0 | P1+1 | 0 |
| 0 | P1+3 | 1 |
| 2 | P1+1 | 2 |
| 2 | P1+3 | 3 |
| 4 | P1+1 | 4 |
| 4 | P1+3 | 5 |
| P2+1 | 1 | 6 |
| P2+3 | 1 | 7 |
| P2+1 | 3 | 8 |
| P2+3 | 3 | 9 |
| 6 | 5 | 10 |
| 6 | 7 | 11 |
| Ra0 | Rb0 | 12 |
| Ra0 | Rb1 | 13 |
| Ra1 | Rb0 | 14 |
| Ra1 | Rb1 | 15 |

PARTIAL ALGEBRAIC CODEBOOK SIZE=
$3 \times 2 + 2 \times 2 + 1 \times 2 = 12$
RANDOM CODEBBOK SIZE$= 2 \times 2 = 4$

FIG.26A

| pulse1(=P1)/CH1 | pulse2(=P2)/CH2 | INDEX |
|---|---|---|
| 0 | P1+1 | 0 |
| Ra2 | Rb0 | 1 |
| 2 | P1+1 | 2 |
| Ra2 | Rb1 | 3 |
| 4 | P1+1 | 4 |
| Ra2 | Rb2 | 5 |
| P2+1 | 1 | 6 |
| Ra0 | Rb2 | 7 |
| P2+1 | 3 | 8 |
| Ra1 | Rb2 | 9 |
| 6 | 5 | 10 |
| 6 | 7 | 11 |
| Ra0 | Rb0 | 12 |
| Ra0 | Rb1 | 13 |
| Ra1 | Rb0 | 14 |
| Ra1 | Rb1 | 15 |

PARTIAL ALGEBRAIC CODEBOOK SIZE=
$3 \times 1 + 2 \times 1 + 1 \times 2 = 7$
RANDOM CODEBOOK SIZE$= 6 \times 4 = 24$

FIG.26B

THE NUMBER OF PULSES 4

| PULSE NUMBER | ARRANGEMENT RANGE OF EACH PULSE | | STARTING POSITION OF EACH RANGE | |
|---|---|---|---|---|
| j | ch1 (N_Range [0][j]) | ch2 (N_Range [1][j]) | ch1 (S_Range [0][j]) | ch2 (S_Range [1][j]) |
| 0 | 10 | 10 | 0 | 10 |
| 1 | 10 | 10 | 20 | 30 |
| 2 | 10 | 10 | 40 | 50 |
| 3 | 10 | 10 | 60 | 70 |

FIG.35A

THE NUMBER OF PULSES 6

| PULSE NUMBER | ARRANGEMENT RANGE OF EACH PULSE | | STARTING POSITION OF EACH RANGE | |
|---|---|---|---|---|
| j | ch1 (N_Range [0][j]) | ch2 (N_Range [1][j]) | ch1 (S_Range [0][j]) | ch2 (S_Range [1][j]) |
| 0 | 7 | 6 | 0 | 7 |
| 1 | 7 | 6 | 13 | 20 |
| 2 | 7 | 6 | 26 | 33 |
| 3 | 7 | 6 | 39 | 46 |
| 4 | 7 | 6 | 52 | 59 |
| 5 | 8 | 7 | 65 | 73 |

FIG.35B

EXCITATION VECTOR GENERATING APPARATUS AND SPEECH CODING/DECODING APPARATUS

TECHNICAL FIELD

The present invention relates to a low-bit-rate speech coding apparatus which encodes a speech signal to transmit, for example, in a mobile communication system, and more particularly, to a CELP (Code Excited Linear Prediction) type speech coding apparatus which separates the speech signal to vocal tract information and excitation information to represent.

BACKGROUND ART

In the fields of digital mobile communications and speech storage, speech coding apparatuses are used which compress speech information to encode with high efficiency for utilization of radio signals and storage media. Among them, the system based on a CELP (Code Excited Linear Prediction) system is carried into practice widely for the apparatuses operating at medium to low bit rates. The technology of the CELP is described in "Code-excited Linear Prediction (CELP):High-quality Speech at Very Low Bit Rates", Proc. ICASSP-85, 25.1.1., pp.937–940, 1985 by M. R. Schroeder and B. S. Atal.

In the CELP type speech coding system, speech signals are divided into predetermined frame lengths (about 5 ms to 50 ms), linear prediction of the speech signals is performed for each frame, the prediction residual (excitation vector signal) obtained by the linear prediction for each frame is encoded using an adaptive code vector and random code vector comprised of known waveforms. The adaptive code vector is selected to be used from an adaptive codebook storing previously generated excitation vectors, and the random code vector is selected to be used from a random codebook storing the predetermined number of pre-prepared vectors with predetermined forms. Examples used as the random code vectors stored in the random codebook are random noise sequence vectors and vectors generated by arranging a few pulses at different positions.

An algebraic codebook is one of representative examples of a type of random codebook that arranges a few pulses at different positions. Specific contents regarding the algebraic codebook is described, for example, in ITU-T Recommendation G.729.

A conventional example of a random code vector generator using the algebraic codebook is explained specifically below with reference to FIG. 1.

FIG. 1 is a basic block diagram of the random code vector generator using the algebraic code book. In FIG. 1, adder 3 adds a pulse generated in first pulse generator 1 and another pulse generated in second pulse generator 2, two pulses are arranged at different positions, and thereby the random code vector is generated. FIGS. 2 and 3 illustrate specific examples of the algebraic codebook. FIG. 2 illustrates an example that two pulses are arranged in 80 samples, and FIG. 3 illustrates another example that three pulses are arranged in 80 samples. In addition, in FIGS. 2 and 3, the number described under each table is indicative of the number of combinations of pulse positions.

In the above-described conventional random code vector generator using the algebraic code book, however, a search position of each excitation pulse is independent, and a relative position relationship between an excitation pulse and another excitation pulse is not utilized. Therefore, it is possible to generate random code vectors with various forms, while a large number of bits are needed to sufficiently represent a pulse position, resulting in a problem that the codebook is not always efficient when forms of random code vectors to be generated have some tendency. Further, in order to decrease the number of bits required for the algebraic codebook, there is considered a method of decreasing the number of excitation pulses. This method, however, provides another problem that subjective qualities greatly deteriorate at an unvoiced segment and stationary noise segment due to a few numbers of excitation pulses. Furthermore, in order to improve subjective qualities at the unvoiced segment and stationary noise segment, there is considered a method of performing mode switching of excitation. This method, however, has a problem when a mode determination error occurs.

DISCLOSURE OF INVENTION

It is an object of the present invention to provide an excitation vector generating apparatus and speech coding/decoding apparatus capable of reducing a size of a random codebook, improving qualities with respect to an unvoiced segment and stationary noise segment, and further improving coding performance with respect to the unvoiced segment and a background noise while keeping robustness against a mode decision error.

It is a subject matter of the present invention to reduce a size of an algebraic codebook efficiently by generating random code vectors using a partial algebraic codebook, in other words, by using random code vectors that generate only combinations such that at least two pulses are adjacent among a plurality of excitation pulses generated from the algebraic codebook.

Further, it is another subject matter of the present invention to improve subjective qualities with respect to the unvoiced segment and stationary noise segment by using a random codebook corresponding to the unvoiced segment and stationary noise segment along with the partial algebraic codebook, in other words, by storing excitation vectors effective on the unvoiced segment and stationery noise segment.

Furthermore, it is the other subject matter of the present invention to improve coding performance with respect to an unvoiced speech and background noise and thereby improve the subjective qualities, while keeping robustness against a mode decision error, by switching a ratio of a size of the partial algebraic codebook to that of the random codebook used together corresponding to a mode determination result.

A distance between adjacent pulses herein is considered to be not more than 1.25 ms, i.e., not more than about 10 samples in a digital signal of 8 kHz sampling.

BRIEF DESCRIPTION OF DRAWINGS

FIG. 2 is a diagram illustrating an example of a conventional 2-channel algebraic codebook;

FIG. 3 is a diagram illustrating an example of a conventional 3-channel algebraic codebook;

FIG. 8 is a diagram illustrating an example of a partial algebraic codebook according to the first embodiment of the present invention;

FIG. 14 is a diagram illustrating another example of the partial algebraic codebook according to the first embodiment of the present invention;

FIG. 25A is a diagram illustrating an example of a correspondence table of random code vectors with indexes according to the third embodiment of the present invention;

FIG. 25B is another diagram illustrating an example of the correspondence table of random code vectors with indexes according to the third embodiment of the present invention;

FIG. 26A is a diagram illustrating another example of the correspondence table of random code vectors with. indexes according to the third embodiment of the present invention;

FIG. 26B is another diagram illustrating another example of the correspondence table of random code vectors with indexes according to the third embodiment of the present invention;

FIG. 35A is a diagram illustrating sample intervals and pulse positions in the random codebook;

FIG. 35B is another diagram illustrating sample intervals and pulse positions in the random codebook;

BEST MODE FOR CARRYING OUT THE INVENTION

Figure 1:
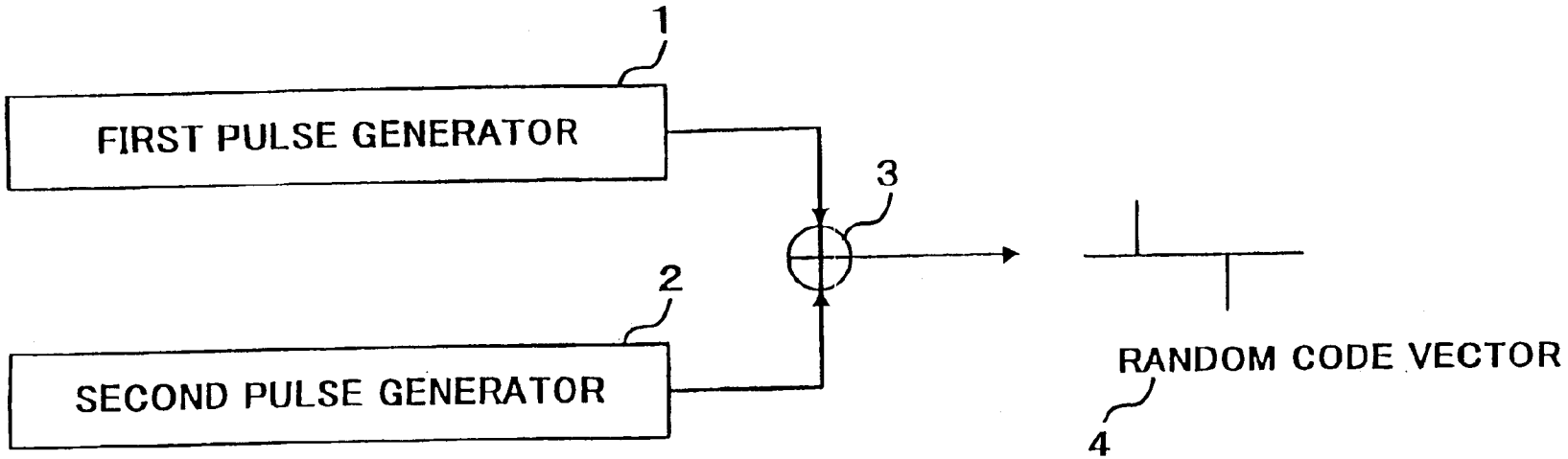
RELATED ART FIG.1
FIG. 1 is a block diagram illustrating a configuration of a conventional speech coding apparatus.

An excitation vector generating apparatus of the present invention adopts a configuration having a controller that controls a pulse position determiner so that a pulse position determined by the pulse position determiner is not arranged out of a transmission frame.

According to this configuration, it is possible to perform a search in a pulse position range such that pulse positions determined by the pulse position determiner are not out of the transmission frame, and to generate a random code vector.

The excitation vector generating apparatus of the present invention adopts a configuration having a random codebook storing second random code vectors each including a plurality of pulses being not adjacent to each other, where the random code vector generator generates a random code vector from a first and second random code vectors.

According to this configuration, it is possible to improve subjective qualities with respect to an unvoiced segment and stationary noise segment by using a random codebook corresponding to an unvoiced speech and stationary noise signal along with a partial algebraic codebook.

The excitation vector generating apparatus of the present invention adopts a configuration having a mode determiner that determines a speech mode, and a pulse position candidate number controller that increases or decreases the number of predetermined pulse position candidates corresponding to the determined speech mode.

According to this configuration, a usage ratio of the algebraic codebook to the random codebook is changed according to the mode determination, whereby it is possible to improve coding performance with respect to the unvoiced speech and background noise while keeping robustness against a mode decision error.

The excitation vector generating apparatus of the present invention adopts a configuration having a power calculator that calculates power of an excitation signal and an average power calculator that calculates average power of the excitation signal when the determined speech mode is a noise mode, where the pulse position candidate number controller increases or decreases the number of predetermined pulse position candidates based on the average power.

According to this configuration, it is possible to improve coding performance with respect to the unvoiced speech and background noise while keeping robustness against a mode decision error.

A speech coding apparatus of the present invention adopts a configuration having an excitation vector generator that generates a new excitation vector from an adaptive code vector output from an adaptive codebook storing excitation vectors and a random code vector output from a partial algebraic codebook storing random code vectors obtained in the above-mentioned excitation vector generating apparatus, an excitation vector updator that updates an excitation vector stored in the adaptive codebook to the new excitation vector, and a speech synthesis signal generator that generates a speech synthesis signal using the new excitation vector and a linear predictive analysis result that an input signal is quantized.

According to this configuration, a random code vector is generated that has at least two pulses adjacent to each other, whereby it is possible to efficiently reduce a size of the partial algebraic codebook, and consequently to achieve a speech coding apparatus with a low bit rate and a small computation amount.

A speech decoding apparatus of the present invention adopts a configuration having an excitation parameter decoder that decodes excitation parameters including position information on an adaptive code vector and index information to designate a random code vector, an excitation vector generator that generates an excitation vector using the adaptive code vector obtained from the position information on the adaptive code vector and the random code vector having at least two pulses adjacent to each other obtained from the index information, an excitation vector updator that updates an excitation vector stored in the adaptive codebook to the generated excitation vector, and a speech synthesis signal generator that generates a speech synthesis signal using the generated excitation vector and a decoded result of quantized linear predictive analysis result transmitted from a coding side.

According to the configuration, since the random code vector is used that has at least two pulses adjacent to each other, it is possible to efficiently reduce a size of the partial algebraic codebook, and consequently to achieve a speech decoding apparatus with a low bit rate.

A speech coding/decoding apparatus of the present invention adopts a configuration having a partial algebraic codebook that generates excitation vectors each comprised of three excitation pulses to store, a limiter that performs a limitation to generate an excitation vector in which an interval between at least a pair of the excitation pulses is relatively short among the excitation vectors, and a random codebook used adaptively corresponding to a size of the partial algebraic codebook.

According to this configuration, the partial algebraic codebook is composed with three pulses set as the excitation pulses, whereby it is possible to achieve a speech coding/decoding apparatus with high basic performance.

The speech coding/decoding apparatus of the present invention adopts a constitution where the limiter classifies a speech into a voiced speech and non-voiced speech corresponding to a position (index) of the excitation pulse.

According to this constitution, it is possible to perform an orderly search of excitation pulse position, whereby a computation amount required for the search can be kept to a required minimum level.

The speech coding/decoding apparatus of the present invention adopts a constitution to increase a rate of the random codebook by a portion corresponding to a decreased size of the partial algebraic codebook.

According to this constitution, indexes of common portions can be shared even when the size of random codebook is changed corresponding to the mode information, and therefore it is possible to avoid adverse effects due to, for example, mode information error.

The speech coding/decoding apparatus of the present invention adopts a constitution where the random codebook is comprised of a plurality of channels, and positions of the excitation pulses are limited so as to prevent the excitation pulses from overlapping between the channels.

According to this constitution, since it is possible to reserve orthogonality between vectors generated from respective channels in an excitation region, it is possible to compose a random codebook with high efficiency.

The speech coding/decoding apparatus of the present invention adopts a configuration having an algebraic. codebook storing excitation vectors, a dispersion pattern generator that generates a dispersion pattern corresponding to power of a noise interval in speech data, and a pattern disperser that disperses a pattern of the excitation vector output from the algebraic codebook according to the dispersion pattern.

According to this configuration, it is possible to limit the noise characteristic of the dispersion pattern corresponding noise power, and thereby possible to achieve a speech coding/decoding apparatus that is robust with respect to noise levels.

The speech coding/decoding apparatus of the present invention adopts a constitution where the dispersion pattern generator generates a dispersion pattern with strong noise characteristic when average noise power is high, while generating a dispersion pattern with weak noise characteristic when the average noise power is low.

According to this constitution, it is possible to generate a signal representative of a noisier speech when a noise level is high, while generating another signal representative of a cleaner speech when the noise level is low.

The speech coding/decoding apparatus of the present invention of the present invention adopts a constitution where the dispersion pattern generator generates the dispersion pattern corresponding to a mode of the speech data.

According to this constitution, it is possible to set the noise characteristic to be not more than a middle level in a speech interval (voiced interval), and thereby possible to improve a speech quality in the noise.

Embodiments of the present invention will be explained below with reference to accompanying drawings.

(First Embodiment)

Figure 4:
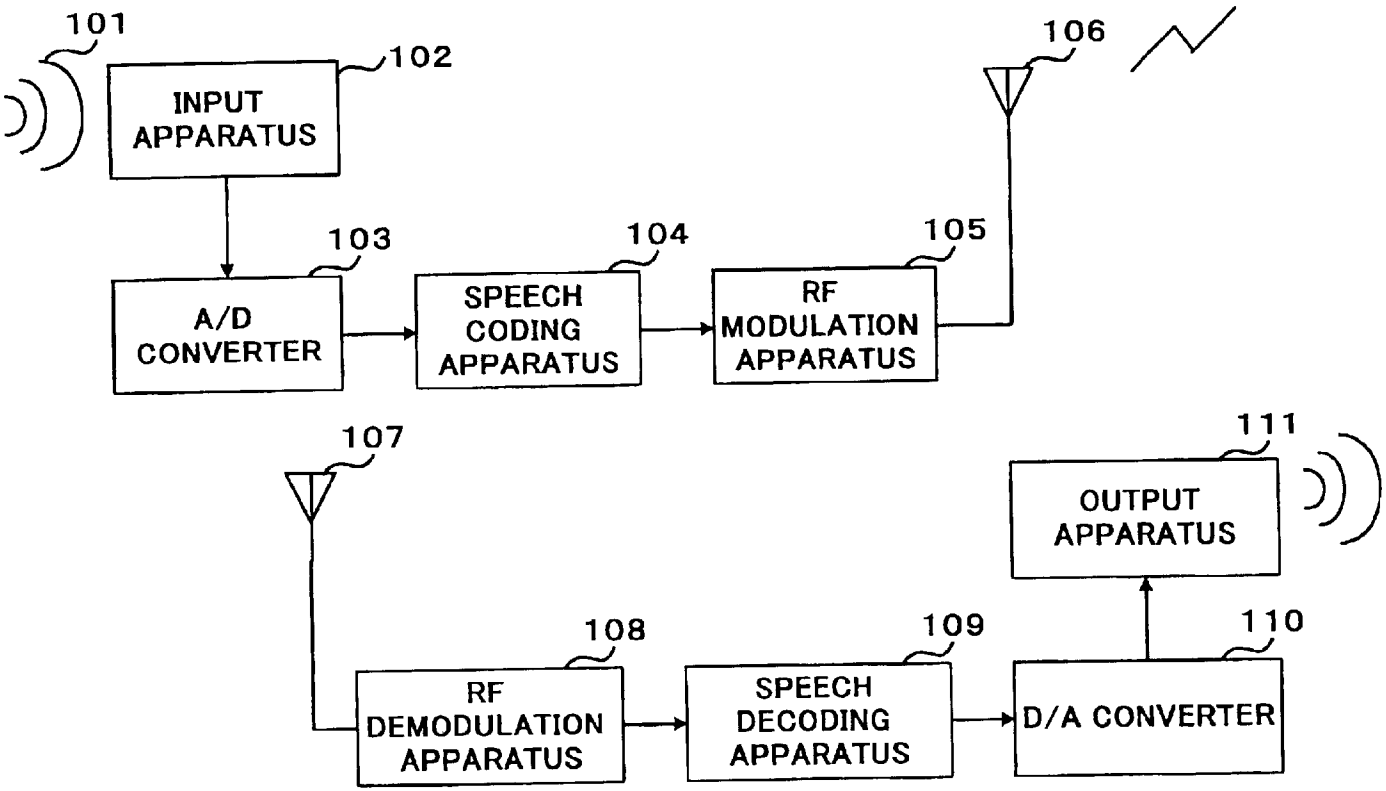
FIG. 4 is a block diagram illustrating configurations of a speech signal transmission apparatus and speech signal reception apparatus according to embodiments of the present invention.

FIG. 4 is a block diagram illustrating a speech signal transmitter and/or receiver provided with a speech coding and/or decoding apparatus according to the present invention.

In the speech signal transmitter illustrated in FIG. 4, speech signal 101 is converted into an electric analog signal in speech input apparatus 102, and output to A/D converter 103. The analog speech signal is converted into a digital speech signal in A/D converter 103, and output to speech coding apparatus 104. Speech coding apparatus 104 performs speech coding processing on the input signal, and outputs coded information to RF modulation apparatus 105. RF modulation apparatus 105 subjects the coded speech signal to processing to transmit a radio signal such as modulation, amplification and code spreading, and outputs the coded speech signal to transmission antenna 106. Finally a radio signal (RF signal) is transmitted from transmission antenna 106.

Meanwhile in the receiver, a radio signal (RF signal) is received at reception antenna 107. The received signal is output to RF demodulation apparatus 108. RF demodulation apparatus 108 performs processing to convert the radio signal into coded information such as code despreading and demodulation, and outputs coded information to speech decoding apparatus 109. Speech decoding apparatus 109 performs decoding processing on the coded information, and outputs a digital decoded speech signal to D/A converter 110. D/A converter 110 converts the digital decoded speech signal output from speech decoding apparatus 109 into an analog decoded speech signal to output to speech output apparatus 111. Finally, speech output apparatus 111 converts the electric analog decoded speech signal into a decoded speech to output.

Figure 5:
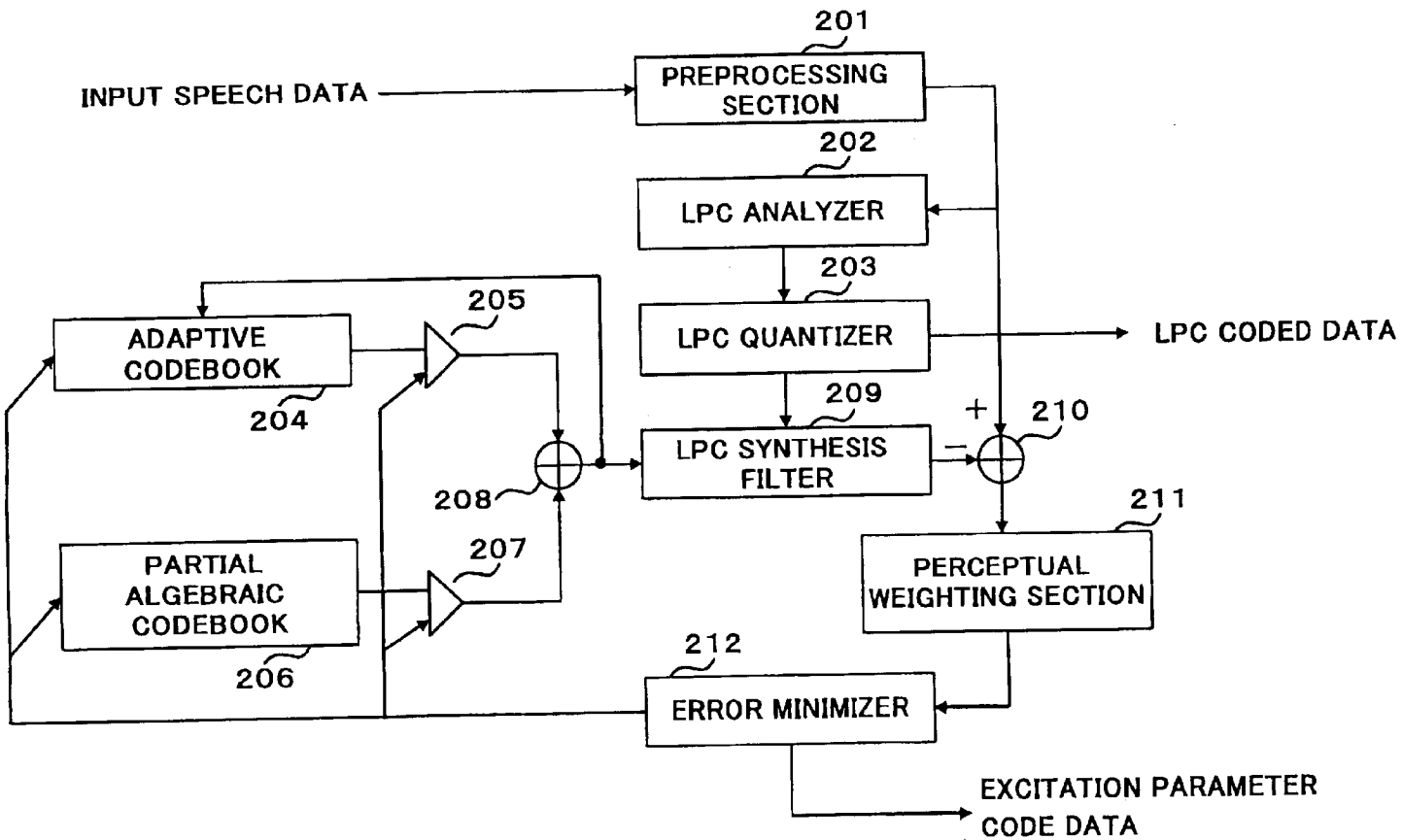
FIG. 5 is a block diagram illustrating a configuration of a speech coding apparatus according to a first embodiment of the present invention.

The explanation is next given of a random code vector generator in the speech signal transmitter and/or receiver with the above-mentioned configuration. FIG. 5 is a block diagram illustrating a speech coding apparatus provided with the random code vector generator according to the first embodiment. The speech coding apparatus illustrated in FIG. 5 is provided with preprocessing section 201, LPC analyzer 202, LPC quantizer 203, adaptive codebook 204, multiplier 205, partial algebraic codebook 206, multiplier 207, adder 208, LPC synthesis filter 209, adder 210, perceptual weighting section 211, and error minimizer 212.

In the random code vector generator, input speech data is a digital signal obtained by performing A/D conversion on a speech signal, and is input to preprocessing section 201 for each unit processing time (frame). Preprocessing section 201 is to perform processing to improve a subjective quality of the input speech data and convert the input speech data into a signal with a state suitable to coding, and for example, performs high-pass filter processing to cut a direct current component and pre-emphasis processing to enhance characteristics of the speech signal.

A preprocessed signal is output to LPC analyzer 202 and adder 210. LPC analyzer 202 performs LPC analysis (Linear Predictive analysis) using a signal input from preprocessing section 201, and outputs obtained LPC (Linear Predictive Coefficients) to LPC quantizer 203. LPC quantizer 203 performs quantization of the LPC input from LPC analyzer 202, outputs quantized LPC to LPC synthesis filter 209, and further outputs coded data of the quantized LPC to a decoder side via a transmission path.

Adaptive codebook 204 is a buffer for previously generated excitation vectors (vectors output from adder 208), and retrieves an adaptive code vector from a position designated from error minimizer 212 to output to multiplier 205. Multiplier 205 multiplies the adaptive code vector output from adaptive codebook 204 by an adaptive code vector gain to output to adder 208. The adaptive code vector gain is designated by the error minimizer. Partial algebraic codebook 206 is a codebook with a configuration in FIG. 7 or FIG. 13 described later or with similar one to such a configuration, and outputs a random code vector comprised of a few pulses such that positions of at least two pulses are adjacent to multiplier 207.

Multiplier 207 multiplies the random code vector output from partial algebraic codebook 206 by a random code vector gain to output to adder 208. Adder 208 performs vector addition of the adaptive code vector, multiplied by the adaptive code vector gain, output from multiplier 205 and the random code vector, multiplied by the random code vector gain, output from multiplier 207 to generate an excitation vector, and outputs the excitation vector to adaptive codebook 204 and LPC synthesis filter 209.

The excitation vector output to adaptive codebook 204 is used when adaptive codebook 204 is updated, and the excitation vector output to LPC synthesis filter 209 is used to generate a synthesis speech. LPC synthesis filter 209 is a linear predictive filter composed of the quantized LPC output from LPC quantizer 203, and drives itself using the excitation vector output from adder 208 to output a synthesis signal to adder 210.

Adder 210 calculates a difference (error) signal between the preprocessed input speech signal output from preprocessing section 201 and the synthesis signal output from LPC synthesis filter 209 to output to perceptual weighting section 211. Perceptual weighting section 211 receives as its input the difference signal output from adder 210, and performs perceptual weighting on the input to output to error minimizer 212. Error minimizer 212 receives as its input a perceptual weighted difference signal output from perceptual weighting section 211, adjusts, for example, in such a manner as to minimize a square sum of the input, values of a position at which the adaptive code vector is retrieved from adaptive codebook 204, the random code vector to be generated from partial algebraic codebook 206, the adaptive code vector gain to be multiplied in multiplier 205, and the random code vector-gain to be multiplied. in multiplier 207, and encodes each value to transmit to a decoder side as excitation parameter coded data via a transmission path.

Figure 6:
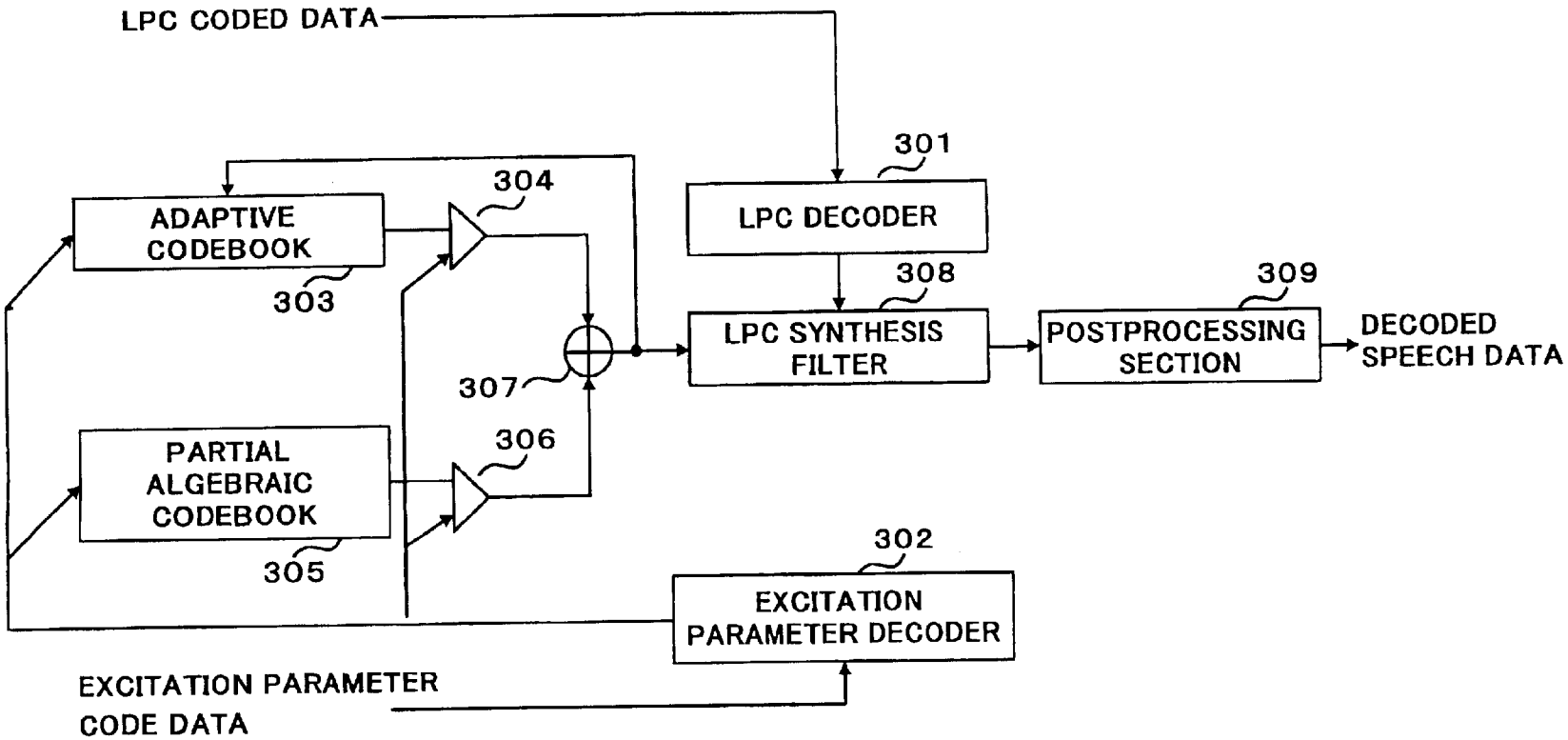
FIG. 6 is a block diagram illustrating a configuration of a speech decoding apparatus according to the first embodiment of the present invention.

FIG. 6 is a block diagram illustrating a speech decoding apparatus provided with the random code vector generator according to the first embodiment. The speech decoding apparatus illustrated in FIG. 6 is provided with LPC decoder 301, excitation parameter decoder 302, adaptive codebook 303, multiplier 304, partial algebraic codebook 305, multiplier 306, adder 307, LPC synthesis filter 308, and postprocessing section 309.

LPC coded data and excitation parameter coded data is respectively input to LPC decoder 301 and excitation parameter decoder 302 on a frame-by-frame basis via a transmission path. LPC decoder 301 decodes quantized LPC to output to LPC synthesis filter 308. The quantized LPC are concurrently output to postprocessing section 309 when postprocessing section 309 uses them. Excitation parameter decoder 302 outputs information indicative of a position to retrieve an adaptive code vector, an adaptive code vector gain, index information to designate a random code vector, and a random code vector gain respectively to adaptive codebook 303, multiplier 304, partial algebraic codebook 305 and multiplier 306.

Adaptive codebook 303 is a buffer for previously generated excitation vectors (vectors output from adder 307), and retrieves an adaptive code vector from a retrieval position input from. excitation parameter decoder 302 to output to multiplier 304. Multiplier 304 multiplies the adaptive code vector output from adaptive. codebook 303 by the adaptive code vector gain input from excitation parameter decoder 303 to output to adder 307.

Figure 7:
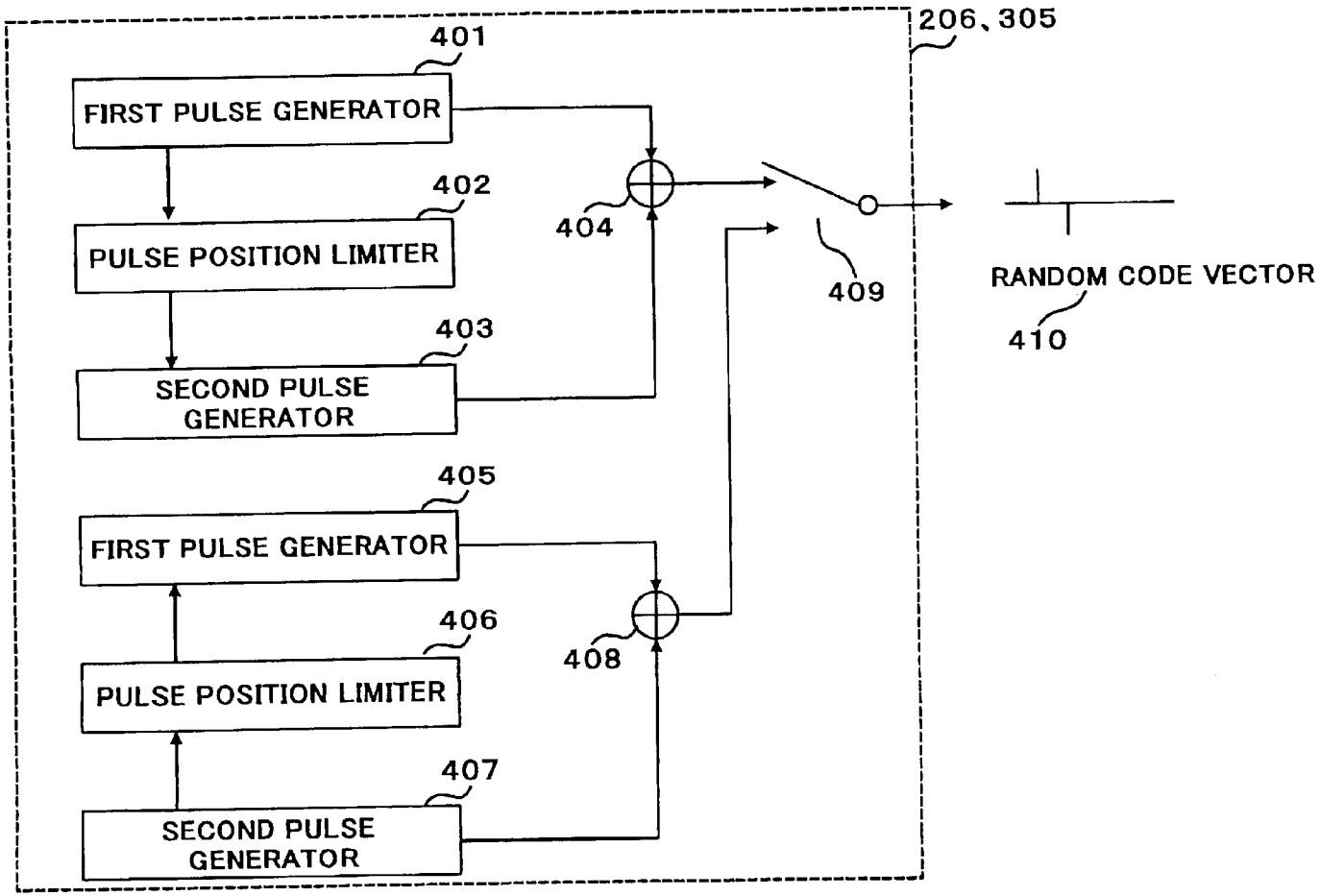
FIG. 7 is a block diagram illustrating a configuration of a random code vector generating apparatus according to the first embodiment of the present invention.

Partial algebraic codebook 305 is the same partial algebraic codebook as that denoted by "206" in FIG. 5 with a configuration in FIG. 7 or FIG. 13 described later or with similar one to such a configuration, and outputs a random code vector comprised of a few pulses such that positions of at least two pulses designated by an index input from excitation parameter decoder 304 are adjacent to multiplier 306.

Multiplier 306 multiplies the random code vector output from the partial algebraic codebook by the random code vector gain input from excitation parameter decoder 302 to output to adder 307. Adder 307 performs vector addition of the adaptive code vector, multiplied by the adaptive code vector gain, output from multiplier 306 and the random code vector, multiplied by the random code vector gain, output from multiplier 306 to generate an excitation vector, and outputs the excitation vector to adaptive codebook 303 and LPC synthesis filter 308.

The excitation vector output to adaptive codebook 303 is used when adaptive codebook 303 is updated, and the excitation vector output to LPC synthesis filter 308 is used to generate a synthesis speech. LPC synthesis filter 308 is a linear predictive filter composed of the quantized LPC (decoded result of quantized LPC transmitted from a coding side) output from LPC decoder 301, and drives itself using the excitation vector output from adder 307 to output the synthesis signal to postprocessing section 309.

Postprocessing section 309 subjects the synthesis speech output from LPC synthesis filter 308 to processing for improving subjective qualities such as postfilter processing comprised of, for example, formant emphasis processing, pitch emphasis processing and spectra inclination correction processing and processing enabling a stationary background noise to be listened comfortably, and outputs the resultant as decode speech data.

The random code vector generator according to the present invention is next explained in detail. FIG. 7 is a block diagram illustrating a configuration of a random code vector generating apparatus according to the first embodiment of the present invention.

First pulse generator 401 arranges a first pulse at one of predetermined position candidates, for example, as shown in a column of pulse number 1 in a pattern (a) in FIG. 8 to output to adder 404. First pulse generator 401 concurrently outputs information indicative of a position at which the first pulse is arranged (selected pulse position) to pulse position limiter 402. Pulse position limiter 402 receives the first pulse position input from first pulse generator 401, and using the position as a reference, determines second pulse position candidates (selects second pulse positions).

Each of the second pulse position candidates is represented with a relative representation from the first pulse position (=P1), for example, as shown in a column of pulse number 2 in the pattern 8(a) in FIG. 8. Pulse position limiter 402 outputs the second pulse position candidates to second pulse generator 403. Second pulse generator 403 arranges a second pulse at one of the second pulse position candidates input from pulse position limiter 402 to output to adder 404.

Adder 404 receives as its inputs the first pulse output from first pulse generator 401 and the second pulse output from second pulse generator 403, and outputs a first random code vector comprised of second pulses to selecting switch 409.

Meanwhile, second pulse generator 407 arranges a second pulse at one of predetermined position candidates, for example, as shown in a column of pulse number 2 in a pattern (b) in FIG. 8 to output to adder 408. Second pulse generator 407 concurrently outputs information indicative of a position at which the second pulse is arranged to pulse position limiter 406. Pulse position limiter 406 receives the second pulse position input from second pulse generator 407, and using the position as a reference, determines first pulse position candidates.

Each of the first pulse position candidates is represented with a relative representation from the second pulse position (=P2), for example, as shown in a column of pulse number 2 in the pattern 8(*b*) in FIG. 8. Pulse position limiter 406 outputs the first pulse position candidates to first pulse generator 405. First pulse generator 405 arranges a first pulse at one of the first pulse position candidates input from pulse position limiter 406 to output to adder 408.

Adder 408 receives as its inputs the first pulse output from first pulse generator 405 and the second pulse output from second pulse generator 407, and outputs a second random code vector comprised of second pulses to selecting switch 409.

Selecting switch 409 selects either of the first random code vector output from adder 404 and the second random code vector output from adder 408 to output as a final random code vector 410. This selection is designated by an external control.

In addition, as described above, when one of two pulses is represented with an absolute position and the other one is represented with a relative position, the other pulse represented with the relative position may exist out of a frame due to the fact that the pulse represented with the absolute position exists around an end of the frame. Therefore, in an actual search algorithm, it is considered to use a different pattern only for a portion causing a combination of a pulse and an out-of-pulse, and perform search while separating to three types (a to c) of search position patterns as shown in FIG. 8. FIG. 8 illustrates an example of arranging two pulses in a frame comprised of 80 samples (0 to 79). The codebook shown in FIG. 8 is capable of generating part of the total entry of random code vectors generated from the conventional algebraic codebook shown in FIG. 1. In this meaning, the algebraic codebook of the present invention shown in FIG. 8 is referred to as partial algebraic codebook.

Figure 9:
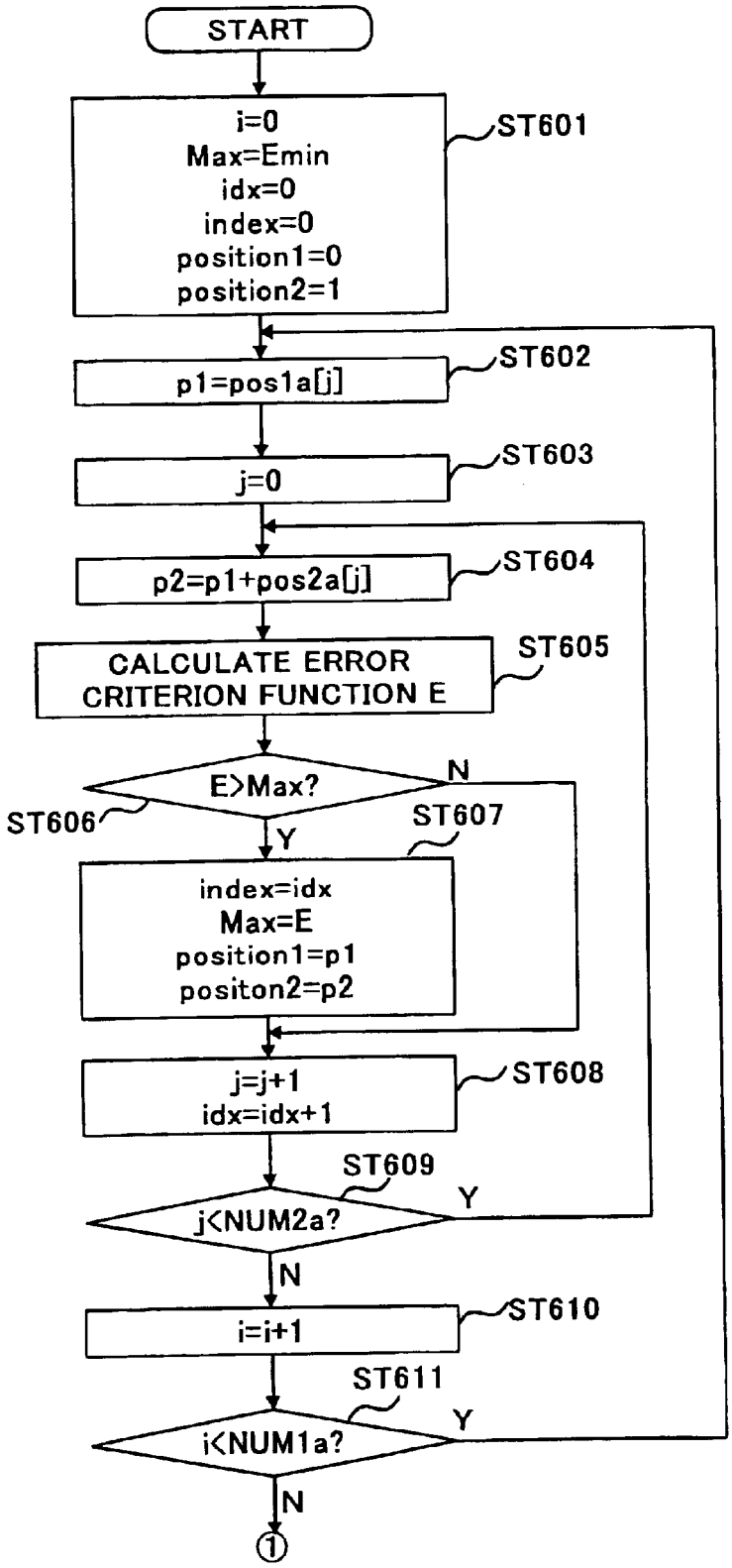
FIG. 9 is a flowchart showing a first part of a processing flow of random code vector coding according to the first embodiment of the present invention.
Figure 10:
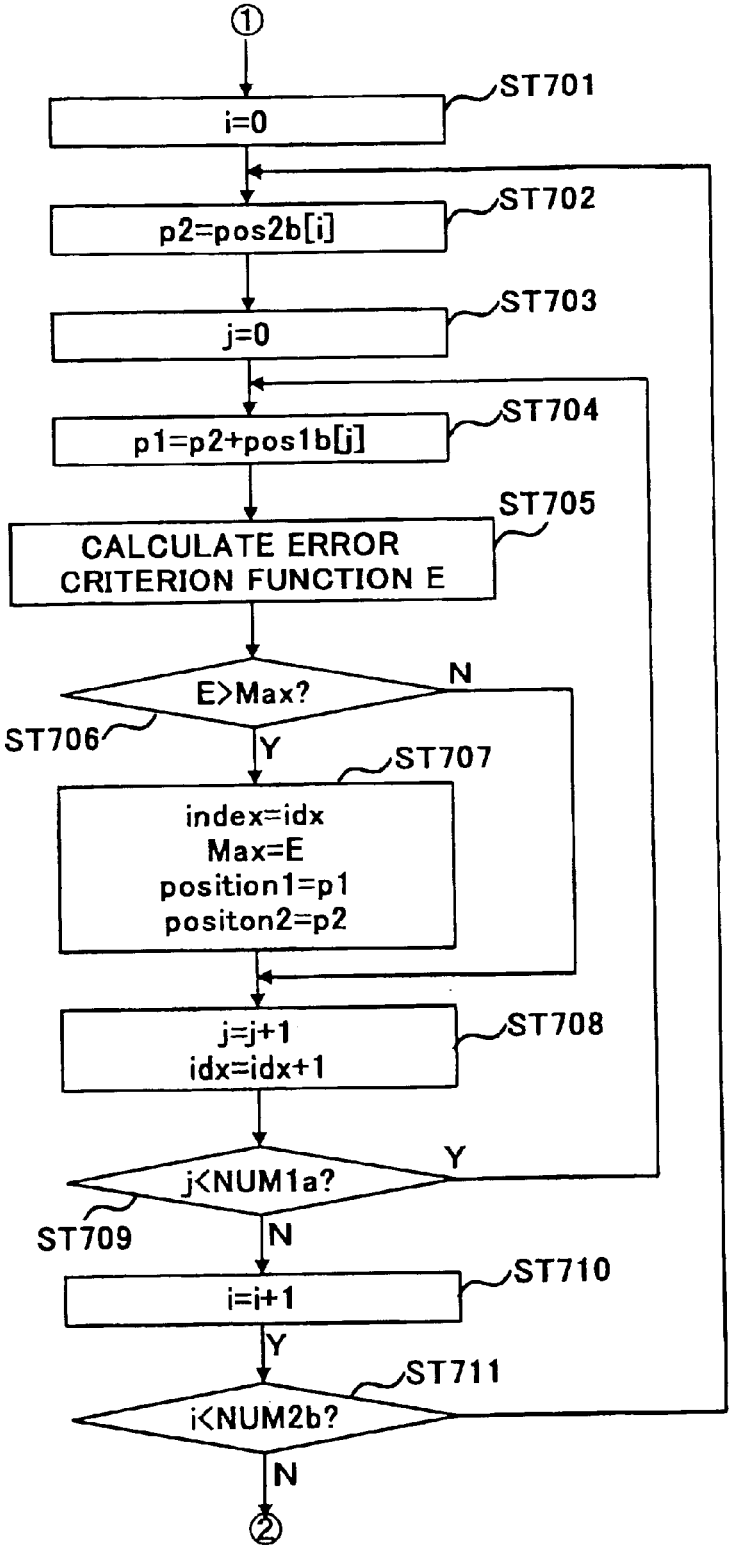
FIG. 10 is a flowchart showing an intermediate part of the processing flow of random code vector coding according to the first embodiment of the present invention.
Figure 11:
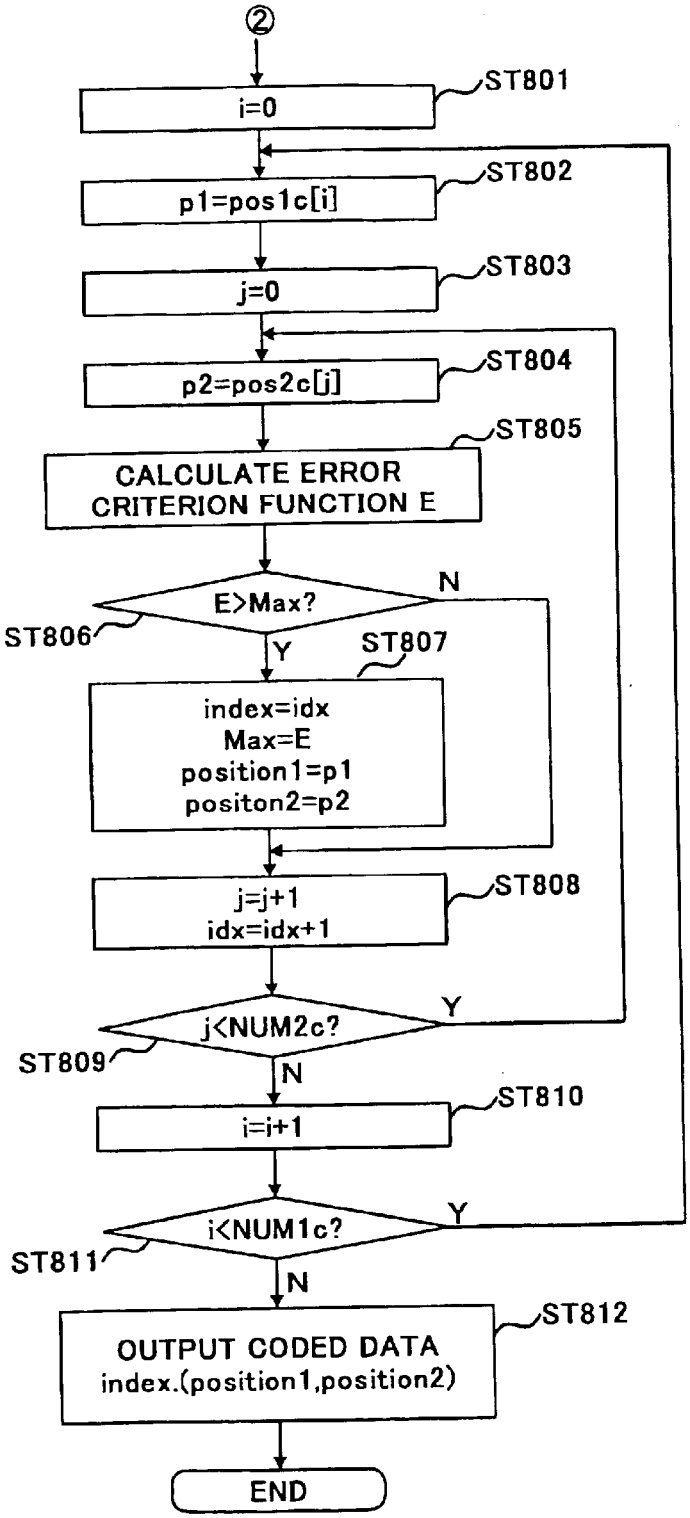
FIG. 11 is a flowchart showing a final part of the processing flow of random code vector coding according to the first embodiment of the present invention.

The following explanation is given of a processing flow of a random code book generating method (coding method and random codebook search method) in the above embodiment using the codebook in FIG. 8 with reference to FIGS. 9 to 11. FIG. 9 shows a specific processing flow of coding only a position of a pulse on the assumption that a polarity (+ or −) of the pulse is coded separately.

First, at step (hereinafter abbreviated as ST) 601, initialization is performed of loop variable "i", an error function maximum "Max", index "idx", output index "index", first pulse position "position1" and second pulse position "position2".

Herein, the loop variable "i" is used as a loop variable of a pulse represented with an absolute position, and has an initial value of 0. The error function maximum "Max" is initialized to a minimum value (for example, [−10^32]) enabling the representation, and is for use in maximizing an error criterion function calculated in a search loop. The index "idx" is an index assigned to each of code vectors generated in the random code vector generating method, has an initial value of 0, and is incremented whenever a pulse position is changed. The "index" is an index of a random code vector finally output, the position1 is a first pulse position finally determined, and position2 is a second pulse position finally determined.

Next at ST602, the first pulse position "p1" is set at pos1*a*[j]. pos1*a*[ ] is a position (0, 2, . . . ,72) shown in the column of pulse number 1 in the pattern (a) in FIG. 8. Herein, the first pulse is a pulse represented with an absolute position.

Next at ST603, the loop variable "j" is initialized. The loop variable "j" is a loop variable of a pulse represented with a relative position, and has an initial value of 0. Herein, the second pulse is represented with the relative position.

Next at ST604, the second pulse position (p2) is set at p1+pos2*a*[j]. The p1 is the first pulse position already set at ST602, and pos2*a*[4] is {1,3,5,7} (pos2*a*[4]={1,3,5,7}). Decreasing the number of elements of pos2*a*[ ] enables a size of the partial algebraic codebook (the total entry number of random code vectors) to be decreased. In this case, it is necessary to change the contents of a pattern (c) in FIG. 8 corresponding to the number of decreased elements. In addition, similar processing is performed in the case of increasing the number of elements.

Next at ST605; the error criterion function E is calculated when a pulse is arranged at each of set two pulse positions. The error criterion function is to evaluate an error between a target vector and a vector synthesized from a random code vector, and for example, employs the following equation (1). In addition, when a random code vector is made orthogonalized to an adaptive code vector, an equation modified from the equation (1) is used as generally used in a CELP coder. When a value of the equation (1) is indicative of maximum, the error is minimized between the target vector and a synthesis vector obtained by driving the synthesis filter with the random code vector.

$$\frac{(X'Hci)^2}{ci'H'Hci} \qquad \text{eq. (1)}$$

$X$ : target vector $H$ : impulse convolution matrix of a synthesis filter $C$ : random code vector $i$ ($i$ is an index number)

x: target vector

H: impulse convolution matrix of a synthesis filter

C: random code vector i (i is an index number)

eq.(1)

Next at ST606, it is determined whether the value of the error criterion function E exceeds the error criterion function maximum Max. The processing flow proceeds to ST607 when the E value exceeds the maximum value Max, while proceeding to ST608 with ST607 skipped when the E value does not exceed the maximum value Max.

At ST607, the index, Max, position1 and position2 are updated. That is, the error criterion function maximum Max is updated to the error criterion function E calculated at ST605, the index is updated to idx, position1 is updated to the first pulse position p1, and position2 is updated to the second pulse position p2.

Next at ST608, the loop variable j and the index number idx are each incremented. Incrementing the loop variable j moves the second pulse position, and results in evaluating a random code vector with a next index number.

Next at ST609, it is checked whether the loop variable j is less than the total number NUM2*a* of second pulse position candidates. In the partial algebraic codebook shown in FIG. 8, NUM2*a* equals 4 (NUM2*a*=4). When the loop variable j is less than NUM2*a*, the processing flow returns to ST604 to repeat the loop of "j". When the loop variable j reaches NUM2*a*, the loop of "j" is finished, and the processing flow proceeds to ST610.

At ST610, the loop variable i is incremented. Incrementing the loop variable i moves the first pulse position, and results in evaluating a random code vector with a next index number.

Next at ST611, it is checked whether the loop variable i is less than the total number NUM1*a* of first pulse position candidates. In the partial algebraic codebook shown in FIG. 8, NUM1*a* equals 37 (NUM1*a*=37). When the loop variable i is less than NUM1*a*, the processing flow returns to ST602 to repeat the loop of "i". When the loop variable i reaches NUM1*a*, the loop of "i" is finished, and the processing flow proceeds to ST701 in FIG. 10. At the time the processing flow proceeds to ST612, the search in the pattern (a) in FIG. 8 is finished, and a loop of the search in the pattern (b) is started.

Next at ST701, the loop variable i is cleared to be 0. At ST702, the second pulse position (p2) is set at pos2*b*[i]. pos2*b*[ ] is a position (1, 3, . . . ,61) shown in the column of pulse number 2 in the pattern (b). Herein, the second pulse is a pulse represented with an absolute position.

Next at ST703, the loop variable j is initialized. The loop variable j is a loop variable of a pulse represented with a relative position, and has an initial value of 0. Herein, the first pulse is represented with the relative position.

Next at ST704, the first pulse position (p1) is set at p2+pos1*b*[j]. The p2 is the second pulse position already set at ST702, and pos1*b*[4] is {1,3,5,7} (pos1*b*[4] ={1,3,5,7}). Decreasing the number of elements of pos1*b*[ ] enables a size of the partial algebraic codebook (the total entry number of random code vectors) to be decreased. In this case, it is necessary to change the contents of the pattern (c) in FIG. 8 corresponding to the number of decreased elements. In addition, similar processing is performed in the case of increasing the number of elements of the pos1*b*[ ].

Next at ST705, the error criterion function E is calculated when a pulse is arranged at each of set two pulse positions. The error criterion function is to evaluate an error between a target vector and a vector synthesized from a random code vector, and employs an equation, for example, as shown in the equation (1). In addition, when a random code vector is made orthogonalized to an adaptive code vector, an equation modified from the equation (1) is used as generally used in a CELP coder. When a value of the equation (1) is indicative of maximum, the error is minimized between the target vector and a synthesis vector obtained by driving the synthesis filter with the random code vector.

Next at ST706, it is determined whether the value of the error criterion function E exceeds the error criterion function maximum Max. The processing flow proceeds to ST707 when the E value exceeds the maximum value Max, while proceeding to ST708 with ST707 skipped when the E value does not exceed the maximum value Max.

At ST707, the index, Max, position1 and position2 are updated. That is, the error criterion function maximum Max is updated to the error criterion function E calculated at ST705, the index is updated to idx, position1 is updated to the first pulse position p1, and position2 is updated to the second pulse position p2.

Next at ST708, the loop variable j and the index number idx are each incremented. Incrementing the loop variable j moves the first pulse position, and results in evaluating a random code vector with a next index number.

Next at ST709, it is checked whether the loop variable j is less than the total number NUM1*b* of first pulse position candidates. In the partial algebraic codebook shown in FIG. 8, NUM1*b* equals 4 (NUM1*b*=4). When the loop variable j is less than NUM1*b*, the processing flow returns to ST704 to repeat the loop of "j". When the loop variable j reaches NUM1*b*, the loop of "j" is finished, and the processing flow proceeds to ST710.

At ST710, the loop variable i. is incremented. Incrementing the loop variable i moves the second pulse position, and results in evaluating a random code vector with a next index number.

Next at ST711, it is checked whether the loop variable i is less than the total number NUM2*b* of second pulse position candidates. In the partial algebraic codebook shown in FIG. 8, NUM2*b* equals 36 (NUM2*b*=36). When the loop variable i is less than NUM2*b*, the processing flow returns to ST702 to repeat the loop of "i". When the loop variable i reaches NUM2*b*, the loop of "i" is finished, and the processing flow proceeds to ST801 in FIG. 11. At the time the processing flow proceeds to ST801, the search in the pattern (b) is finished, and a loop of the search in the pattern (c) is started.

At ST801, the loop variable i is cleared to be 0. Next at ST802, the first pulse position (p1) is set at pos1*c*[i]. pos1*c*[ ] is a position (74, 76, 78) shown in a column of pulse number 1 in the pattern (c). Herein, both the first and second pulses are represented with absolute positions.

Next at ST803, the loop variable j is initialized. The loop variable j is a loop variable of the second pulse, and has an initial value of 0.

Next at ST804, the second pulse position (p2) is set at pos2*c*[j]. The pos2*c*[ ] is a position (73, 75, 77, 79) shown in a column of pulse number 2 in FIG. 5 (c).

Next at ST805, the error criterion function E is calculated when a pulse is arranged at each of set two pulse positions. The error criterion function is to evaluate an error between a target vector and a vector synthesized from a random code vector, and employs an equation, for example, as shown in the equation (1). In addition, when a random code vector is made orthogonalized to an adaptive code vector, an equation modified from the equation (1) is used as generally used in a CELP coder. When a value of the equation (1) is indicative of maximum, the error is minimized between the target vector and a synthesis vector obtained by driving the synthesis filter with the random code vector.

Next at ST806, it is determined whether the value of the error criterion function E exceeds the error criterion function maximum Max. The processing flow proceeds to ST807 when the E value exceeds the maximum value Max, while proceeding to ST808 with ST807 skipped when the E value does not exceed the maximum value Max. At ST807, the index, Max, position1 and position2 are updated. That is, the error criterion function maximum Max is updated to the error criterion function E calculated at ST805, the index is updated to idx, position1 is updated to the first pulse position p1, and position2 is updated to the second pulse position p2.

Next at ST808, the loop variable j and the index number idx are each incremented. Incrementing the loop variable j moves the second pulse position, and results in evaluating a random code vector with a next index number.

Next at ST809, it is checked whether the loop variable j is less than the total number NUM2*c* of second pulse position candidates. In the partial algebraic codebook shown in FIG. 8, NUM2*c* equals 4 (NUM2*c*=4). When the loop variable j is less than NUM2*c*, the processing flow returns to ST804 to repeat the loop of "j". When the loop variable j reaches NUM2*c*, the loop of "j" is finished, and the processing flow proceeds to ST810.

At ST810, the loop variable i is incremented. Incrementing the loop variable i moves the first pulse position, and results in evaluating a random code vector with a next index number.

Next at ST811, it is checked whether the loop variable i is less than the total number NUM1*c* of first pulse position candidates. In the partial algebraic codebook shown in FIG. 8, NUM1*c* equals 3 (NUM1*c*=3). When the loop variable i is less than NUM1*c*, the processing flow returns to ST802 to repeat the loop of "i". When the loop variable i reaches NUM1*c*, the loop of "i" is finished, and the processing flow proceeds to ST812. At the time the processing flow proceeds to ST812, the search in the pattern (c) is finished, and thereby all the searches are finished.

Finally at ST812, the index that is a search result is output. It is not necessary to output two pulse positions of position1 and position2 corresponding to the index, which can be used for partial decoding. In addition, it is possible to determine in advance a polarity (+ or −) of each pulse by adapting to the vector xH in the equation (1) (by only considering positive correlation of xH and c in the equation (1)). Therefore the explanation is omitted in the above embodiment.

Figure 12:
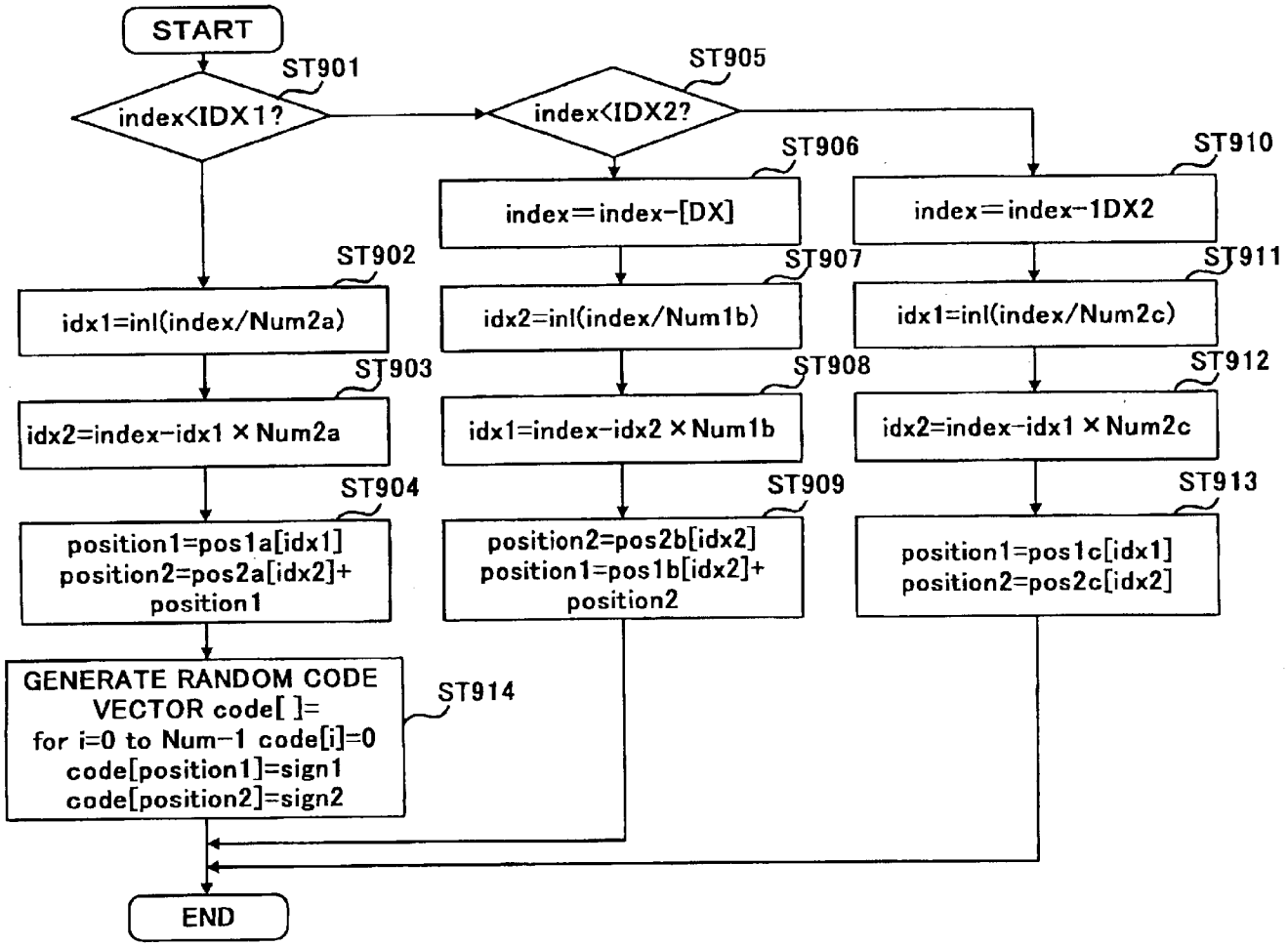
FIG. 12 is a flowchart showing a processing flow of random code vector decoding according to the first embodiment of the present invention.

The following explanation is given of a processing flow of a random code vector generating method (decoding method) in the above embodiment using the codebook in FIG. 8 with reference to FIG. 12.

FIG. 12 shows a specific processing flow of decoding only a position of a pulse on the assumption that a polarity (+ or −) of the pulse is decoded separately.

First at ST901, it is checked whether the index "index" of a random code vector received from a coder is less than IDX1. IDX1 is a codebook size of a portion of the pattern (a) of the codebook in FIG. 8, and is indicative of a value of "idx" at the time of ST601 in FIG. 9. Specifically, IDX1=32×4=128. When the index is less than IDX1, two pulse positions are in a portion represented by the pattern (a), and the processing flow proceeds to ST902. When the index is not less than IDX1, the positions are in a portion represented by the pattern (b) or pattern (c), and the processing flow proceeds to ST905 to further performs a check.

At ST902, a quotient idx1 is obtained by dividing the index by Num2*a*. This idx1 becomes a first pulse index number. At ST902, int( ) is a function to obtain an integer part in the bracket.

Next at ST903, a remainder idx2 is obtained by dividing the index by Num2*a*. This idx2 becomes a second pulse index number.

Next at ST904, a first pulse position "position1" using the idx1 obtained at ST902 and a second pulse position "position2" using the idx2 obtained at ST903 are each determined using the codebook of the pattern (a). The determined positio1 and position2 are used at ST914.

When the index is not less than IDX1 at ST901, the processing flow proceeds to ST905. At ST905, it is checked whether the index is less than IDX2. IDX2 is a codebook size of a combined portion of the portion of the pattern (a) and another portion of the pattern (b) in the codebook in FIG. 8, and is indicative of a value of "idx" at the time of ST801 in FIG. 9. Specifically, IDX2=32×4+31×4=252. When the index is less than IDX2, two pulse positions are in a portion represented by the pattern (b), and the processing flow proceeds to ST906. When the index is not less than IDX2, the positions are in a portion represented by the pattern (c), and the processing flow proceeds to ST910.

At ST906, IDX1 is subtracted from the index, and the processing flow proceeds to ST907. At ST907, a quotient idx2 is obtained by dividing the difference the index minus IDX1 by Num1*b*. This idx2 becomes a second pulse index number. At ST907, int( ) is a function to obtain an integer part in the bracket.

Next at ST908, a remainder idx1 is obtained by dividing the difference the index minus IDX1 by Num1*b*. This idx1 becomes a first pulse index number.

Next at ST909, a second pulse position "position2" using the idx2 obtained at ST907 and a first pulse position "position1" using the idx1 obtained at ST908 are each determined using the codebook of the pattern (b). The determined positio1 and position2 are used at ST914.

When the index is not less than IDX2 at ST905, the processing flow proceeds to ST910. At ST910, IDX2 is subtracted from the index, and the processing flow proceeds to ST911. At ST911, a quotient idx1 is obtained by dividing the difference the index minus IDX2 by Num2*c*. This idx1 becomes a first pulse index number. At ST911, int( ) is a function to obtain an integer part in the bracket.

Next at ST912, a remainder idx2 is obtained by dividing the difference the index minus IDX2 by Num2*c*. This idx2 becomes a second pulse index number.

Next at ST913, a first pulse position "position1" using the idx1 obtained at ST911 and a second pulse position "position2" using the idx2 obtained at ST912 are each determined using the codebook of the pattern (c). The determined positio1 and position2 are used at ST914.

At ST914, a random code vector "code[ ]" is generated using the first pulse position "position1" and second pulse position "position2". That is, a vector is generated such that elements are 0 except code[position1] and code[position2]. Each of code[position1] and code[position2] is +1 or −1 respectively according to a polarity of sign1 or sing2 each separately decoded (each of sign1 and sign2 adopts a value of +1 or 1). "code[ ]" is a random code vector to be decoded.

Figure 13:
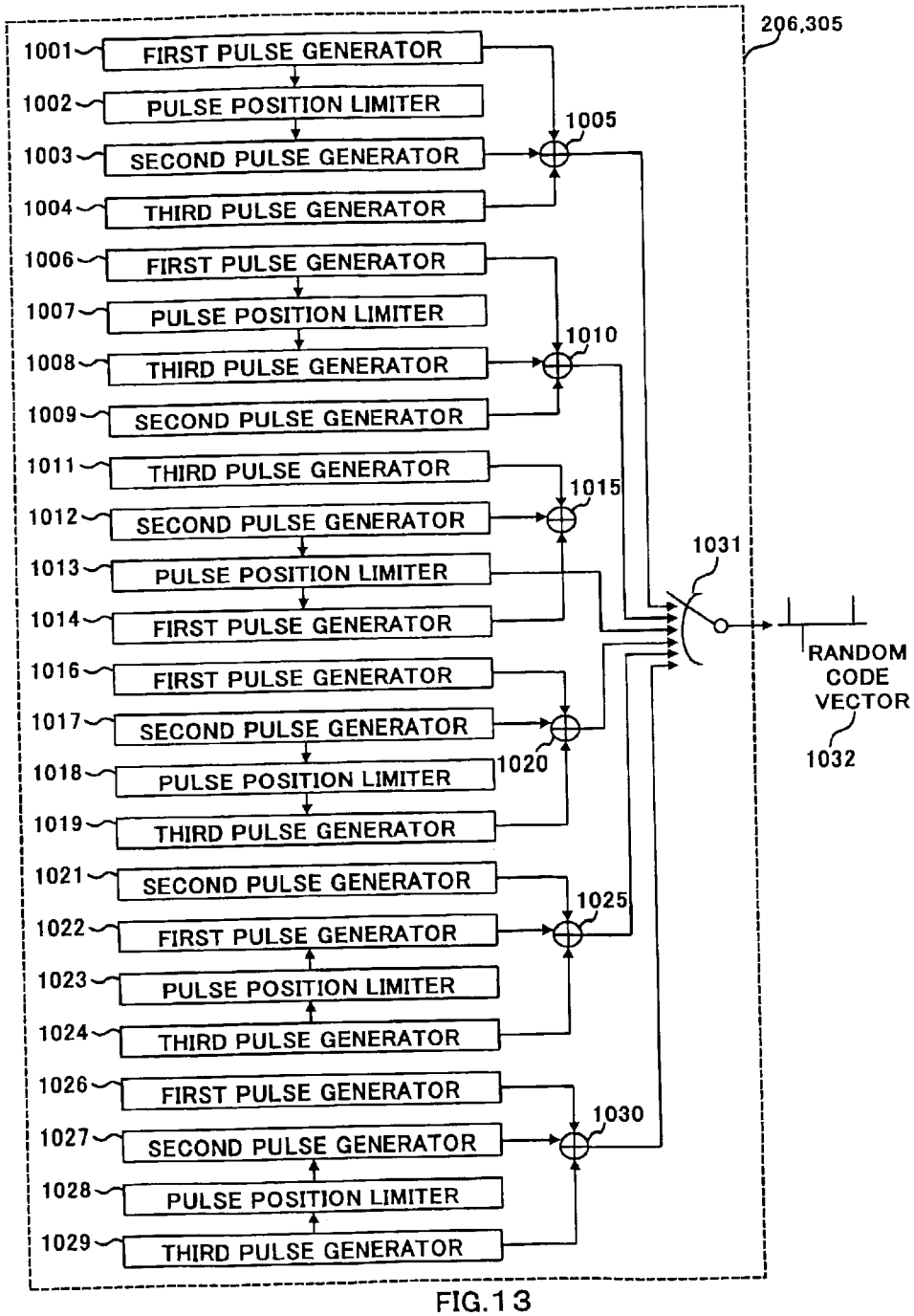
FIG. 13 is a block diagram illustrating another configuration of the random code vector generating apparatus according to the first embodiment of the present invention.

Next, FIG. 13 illustrates a configuration example of a partial algebraic codebook in which the number of pulses is 3.

The configuration example in FIG. 13 adopts a constitution that limits pulse search positions so that at least two of three pulses are arranged at positions adjacent to each other. FIG. 14 illustrates a codebook corresponding to this constitution.

The further explanation is given below using FIG. 13. First pulse generator 1001 arranges a first pulse at one of predetermined position candidates, for example, as shown in a column of pulse number 1 in a pattern (a) in FIG. 14 to output to adder 1005. First pulse generator 1001 concurrently outputs information indicative of a position at which the first pulse is arranged to pulse position limiter 1002. Pulse position limiter 1002 receives first pulse position information input from first pulse generator 1001, and using the position as a reference, determines second pulse position candidates. Each of the second pulse position candidates is represented with a relative representation from the first pulse position (=P1), for example, as shown in a column of pulse number 2 in the pattern (a).

Pulse position limiter 1002 outputs the second pulse position candidates to second pulse generator 1003. Second pulse generator 1003 arranges a second pulse at one of the second pulse position candidates input from pulse position limiter 1002 to output to adder 1005. Third pulse generator 1004 arranges a third pulse at one of predetermined position candidates, for example, as shown in a column of pulse number 3 in the pattern (a) to output to adder 1005. Adder 1005 performs vector addition of total three impulse vectors respectively output from pulse generators 1001, 1003 and 1.004, and outputs a random code vector comprised of three pulses to selecting switch 1031.

First pulse generator 1006 arranges a first pulse atone of predetermined position candidates, for example, as shown in a column of pulse number 1 in a pattern (d) to output to adder 1010. First pulse generator 1006 concurrently outputs information indicative of a position at which the first pulse is arranged to pulse position limiter 1007. Pulse position limiter 1007 receives first pulse position information input from first pulse generator 1006, and using the position as a reference, determines third pulse position candidates. Each of the third pulse position candidates is represented with a relative representation from the first pulse position (=P1), for example, as shown in a column of pulse number 3 in the pattern (d).

Pulse position limiter 1007 outputs the third pulse position candidates to third pulse generator 1008. Third pulse generator 1008 arranges a third pulse at one of the third pulse position candidates input from pulse position limiter 1007 to output to adder 1010. Second pulse generator 1009 arranges a second pulse at one of predetermined position candidates, for example, as shown in a column of pulse number 2 in the pattern (d) to output to adder 1010. Adder 1010 performs vector addition of total three impulse vectors respectively output from pulse generators 1006, 1008 and 1009, and outputs a random code vector comprised of three pulses to selecting switch 1031.

Third pulse generator 1011 arranges a third pulse at one of predetermined position candidates, for example, as shown in a column of pulse number 3 in a pattern (b) to output to adder 1015. Second pulse generator 1012 arranges a second pulse at one of predetermined position candidates, for example, as shown in a column of pulse number 2 in the pattern (b) to output to adder 1015. Second pulse generator 1012 concurrently outputs information indicative of a position at which the second pulse is arranged to pulse position limiter 1013. Pulse position limiter 1013 receives second pulse position information input from second pulse generator 1012, and using the position as a reference, determines first pulse position candidates. Each of the first pulse position candidates is represented with a relative representation from the second pulse position (=P2), for example, as shown in a column of pulse number 1 in the pattern (b).

Pulse position limiter 1013 outputs the first pulse position candidates to first pulse generator 1014. First pulse generator 1014 arranges a first pulse at one of the first pulse position candidates input from pulse position limiter 1013 to output to adder 1015. Adder 1015 performs vector addition of total three impulse vectors respectively output from pulse generators 1011, 1012 and 1014, and outputs a random code vector comprised of three pulses to selecting switch 1031.

First pulse generator 1016 arranges a first pulse at one of predetermined position candidates, for example, as shown in a column of pulse number 1 in a pattern (g) to output to adder 1020. Second pulse generator 1017 arranges a second pulse at one of predetermined position candidates, for example, as shown in a column of pulse number 2 in the pattern (g) to output to adder 1020. Second pulse generator 1017 concurrently outputs a position at which the second pulse is arranged to pulse position limiter 1018. Pulse position limiter 1018 receives the second pulse position input from second pulse generator 1017, and using the position as a reference, determines third pulse position candidates. Each of the third pulse position candidates is represented with a relative representation from the second pulse position (=P2), for example, as shown in a column of pulse number 3 in the pattern (g).

Pulse position limiter 1018 outputs the third pulse position candidates to third pulse generator 1019. Third pulse generator 1019 arranges a third pulse at one of the third pulse position candidates input from pulse position limiter 1018 to output to adder 1020. Adder 1020 performs vector addition of total three impulse vectors respectively output from pulse generators 1016, 1017 and 1019, and outputs a random code vector comprised of three pulses to selecting switch 1031.

Second pulse generator 1021 arranges a second pulse at one of predetermined position candidates, for example, as shown in a column of pulse number 2 in a pattern (e) to output to adder 1025. Third pulse generator 1024 arranges a third pulse at one of predetermined position candidates, for example, as shown in a column of pulse number 3 in the pattern (e) to output to adder 1025. Third pulse generator 1024 concurrently outputs a position at which the third pulse is arranged to pulse position limiter 1023. Pulse position limiter 1023 receives the third pulse position input from third pulse generator 1024, and using the position as a reference, determines first pulse position candidates. Each of the first pulse position candidates is represented with a relative representation from the third pulse position (=P3), for example, as shown in a column of pulse number 1 in the pattern (e).

Pulse position limiter 1023 outputs the first pulse position candidates to first pulse generator 1022. First pulse generator 1022 arranges a first pulse at one of the first pulse position candidates input from pulse position limiter 1023 to output to adder 1025. Adder 1025 performs vector addition of total three impulse vectors respectively output from pulse generators 1021, 1022 and 1024, and outputs a random code vector comprised of three pulses to selecting switch 1031.

First pulse generator 1026 arranges a first pulse at one of predetermined position candidates, for example, as shown in a column of pulse number 1 in a pattern (h) to output to adder 1030. Third pulse generator 1029 arranges a third pulse at one of predetermined position candidates, for example, as shown in a column of pulse number 3 in the pattern (h) to output to adder 1030. Third pulse generator 1029 concurrently outputs a position at which the third pulse is arranged to pulse position limiter 1028. Pulse position limiter 1028 receives the third pulse position input from third pulse generator 1019, and using the position as a reference, determines second pulse position candidates. Each of the second pulse position candidates is represented with a relative representation from the third pulse position (=P3), for example, as shown in a column of pulse number 1 in the pattern (h).

Pulse position limiter 1028 outputs the second pulse position candidates to second pulse generator 1027. Second pulse generator 1027 arranges a second pulse at one of the second pulse position candidates input from pulse position limiter 1028 to output to adder 1030. Adder 1030 performs vector addition of total three impulse vectors respectively output from pulse generators 1026, 1027 and 1029, and outputs a random code vector comprised of three pulses to selecting switch 1031.

Selecting switch 1031 selects one from among total six kinds of random code vectors respectively input from adders 1005, 1010, 1015, 1020, 1025 and 1030, and outputs a random code vector 1032. This selection is designated by an external control.

In addition, in FIGS. 8 and 14, a pattern (c) in FIG. 8 and patterns (c), (f) and (i) in FIG. 14 are provided for an expected case that a pulse represented with a relative position is out of a frame. However, in the case where pulses represented with relative positions are never out of a frame because a range of pulse position candidates represented with absolute positions lies forwardly in the frame, these portions (the pattern (c) in FIG. 8, etc.) can be omitted.

(Second Embodiment)

Figure 15:
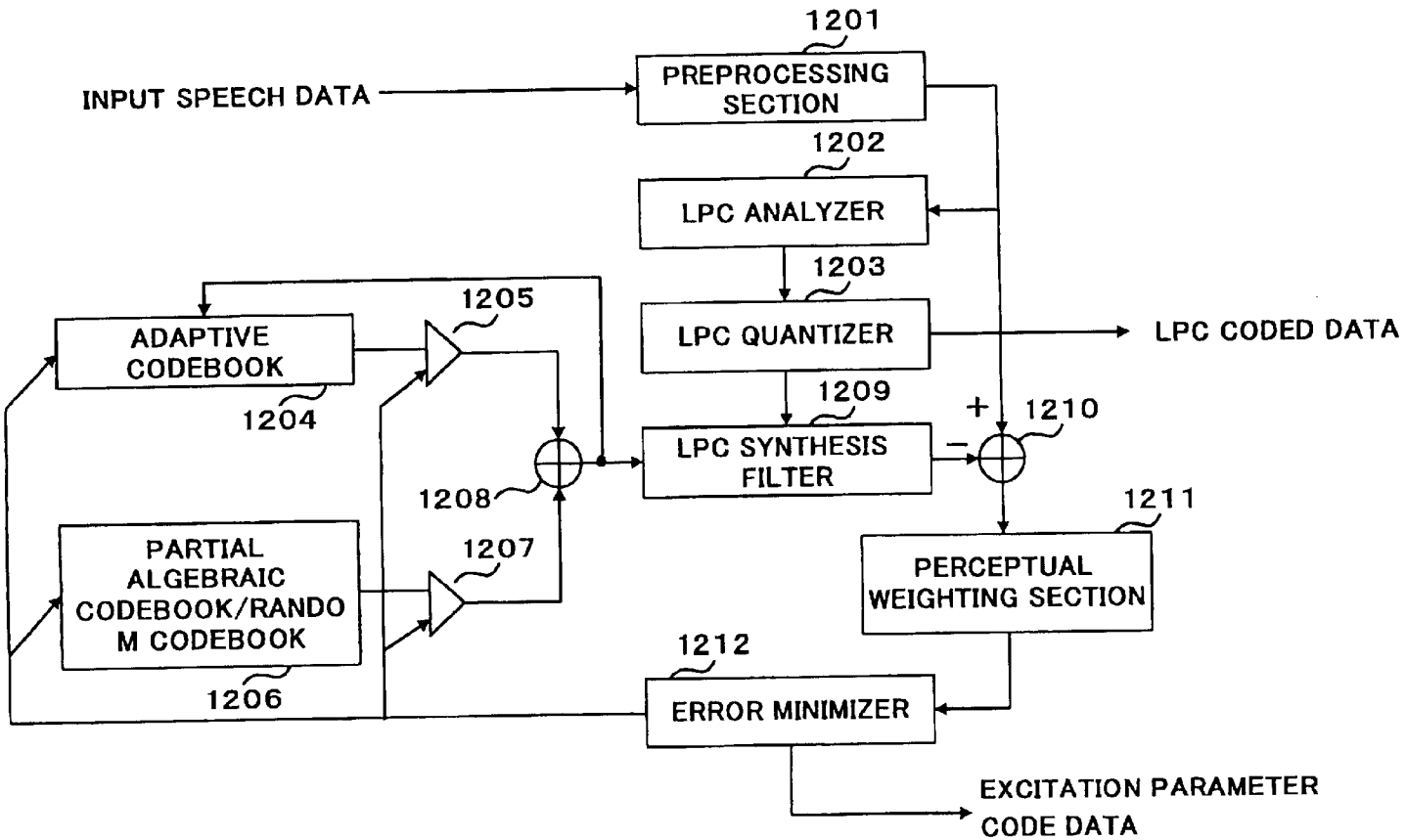
FIG. 15 is a block diagram illustrating a configuration of a speech coding apparatus according to a second embodiment of the present invention.

FIG. 15 is a block diagram illustrating a speech coding apparatus provided with a random code vector generator according to the second embodiment. The speech coding apparatus illustrated in FIG. 15 is provided with preprocessing section 1201, LPC analyzer 1202, LPC quantizer 1203, adaptive codebook 1204, multiplier 1205, random codebook 1206 comprised of a partial algebraic codebook and a random codebook, multiplier 1207, adder 1208, LPC synthesis filter 1209, adder 1210, perceptual weighting section 1211, and error minimizer 1212.

In the speech coding apparatus, input speech data is a digital signal obtained by performing A/D conversion on a speech signal, and is input to preprocessing section 1201 for each unit processing time (frame). Preprocessing section 1201 is to perform processing to improve a subjective quality of the input speech data and convert the input speech data into a signal with a state suitable to coding, and for example, performs high-pass filter processing to cut a direct current component and pre-emphasis processing to enhance characteristics of the speech signal.

A preprocessed signal is output to LPC analyzer 1202 and adder 1210. LPC analyzer 1202 performs LPC analysis (Linear Predictive analysis) using a signal input from preprocessing section 1201, and outputs obtained LPC (Linear Predictive Coefficients) to LPC quantizer 1203. LPC quantizer 1203 performs quantization of the LPC input from LPC analyzer 1202, outputs quantized LPC to LPC synthesis filter 1209, and further outputs coded data of the quantized LPC to a decoder side via a transmission path.

Adaptive codebook 1204 is a buffer for previously generated excitation vectors (vectors output from adder 1208), and retrieves an adaptive code vector from a position designated from error minimizer 1212 to output to multiplier 1205. Multiplier 1205 multiplies the adaptive code vector output from adaptive codebook 1204 by an adaptive code vector gain to output to adder 1208. The adaptive code vector gain is designated by the error minimizer.

Random codebook 1206 comprised of a partial algebraic codebook and a random codebook is a codebook with a configuration illustrated in FIG. 17 described later, and outputs either of a random code vector comprised of a few pulses such that positions of at least two pulse are adjacent and another random code vector with a sparse rate (ratio of the number of samples each with amplitude of 0 to the number of samples of an entire frame) of about 90% or less to multiplier 1207.

Multiplier 1207 multiplies the random code vector output from random codebook 1206 comprised of the partial algebraic codebook and random codebook by a random code vector gain to output to adder 1208. Adder 1208 performs vector addition of the adaptive code vector, multiplied by the adaptive code vector gain, output from multiplier 1205 and the random code vector, multiplied by the random code vector gain, output from multiplier 1207 to generate an excitation vector, and outputs the excitation vector to adaptive codebook 1204 and LPC synthesis filter 1209.

The excitation vector output to adaptive codebook 1204 is for use in updating adaptive codebook 1204, and the excitation vector output to LPC synthesis filter 1209 is used to generate a synthesis speech. LPC synthesis filter 1209 is a linear predictive filter composed of the quantized LPC output from LPC quantizer 1203, drives itself using the excitation vector output from adder 1208, and outputs a synthesis signal to adder 1210. Adder 1210 calculates a difference (error) signal between the preprocessed input speech signal output from preprocessing section 1201 and the synthesis signal output from LPC synthesis filter 1209 to output to perceptual weighting section 1211.

Perceptual weighting section 1211 receives as its input the difference signal output from adder 1210, and performs perceptual weighting on the input to output to error minimizer 1212. Error minimizer 1212 receives as its input a perceptual weighted difference signal output from perceptual weighting section 1211, adjusts, for example, in such a manner as to minimize a square sum of the input, values of a position at which the adaptive code vector is retrieved from adaptive codebook 1204, the random code vector to be generated from random codebook 1206 comprised of the partial algebraic codebook and random codebook, the adaptive code vector gain to be multiplied in multiplier 1205, and the random code vector gain to be multiplied in multiplier 1207, and encodes each value to transmit to a decoder side as excitation parameter coded data 1214 via a transmission path.

Figure 16:
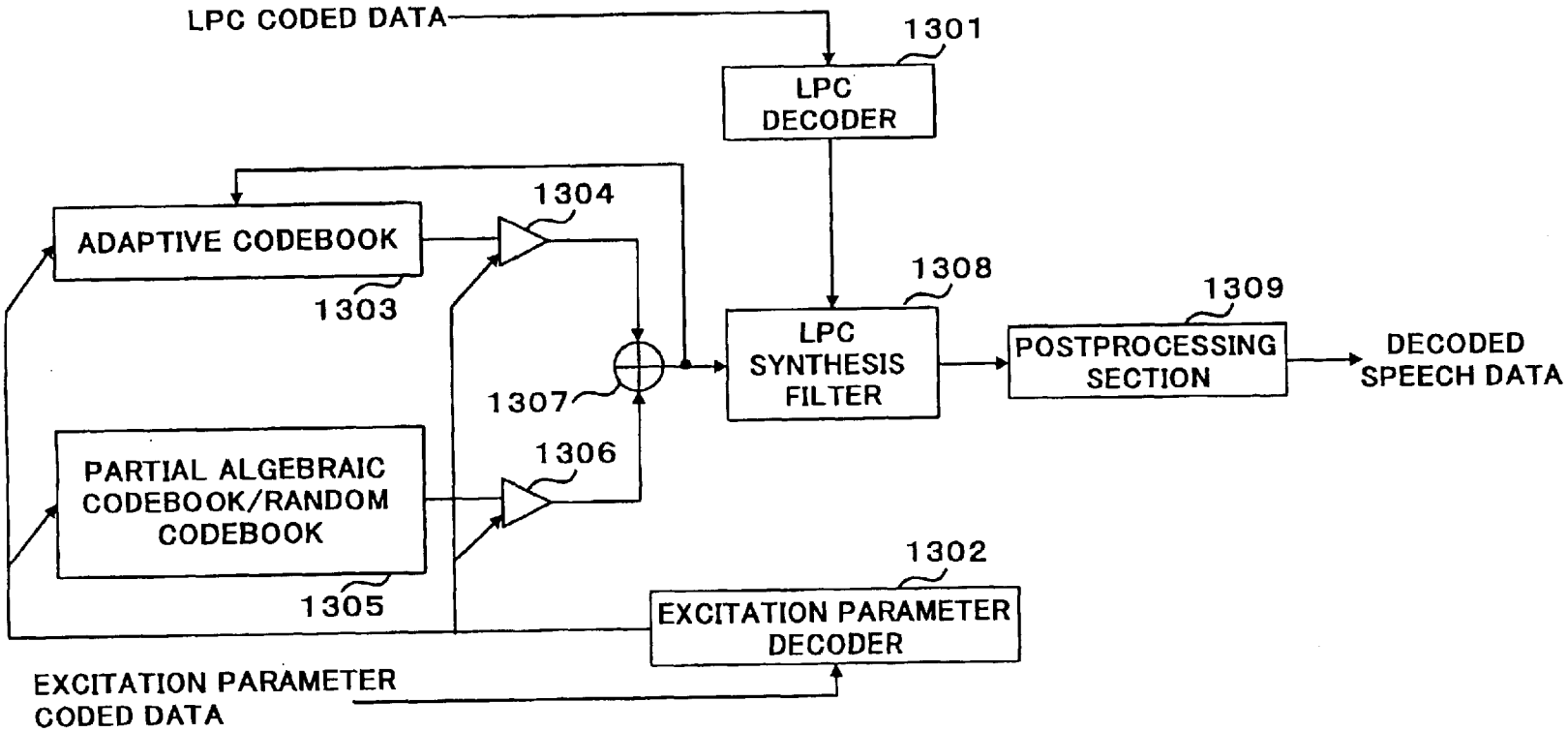
FIG. 16 is a block diagram illustrating a configuration of a speech decoding apparatus according to the second embodiment of the present invention.

FIG. 16 is a block diagram illustrating a speech decoding apparatus provided with the random code vector generator according to the second embodiment. The speech decoding apparatus illustrated in FIG. 16 is provided with LPC decoder 1301, excitation parameter decoder 1302, adaptive codebook 1303, multiplier 1304, random codebook 1305 comprised of a partial algebraic codebook and a random codebook, multiplier 1306, adder 1307, LPC synthesis filter 1308, and postprocessing section 1309.

In the speech decoding apparatus, LPC coded data and excitation parameter coded data is respectively input to LPC decoder 1301 and excitation parameter decoder 1302 on a frame-by-frame bas is via a transmission path. LPC decoder 1301 decodes quantized LPC to output to LPC synthesis filter 1308. The quantized LPC are concurrently output to postprocessing section 1309 from LPC decoder 1301 when postprocessing section 1309 uses the quantized LPC. Excitation parameter decoder 1302 outputs information indicative of a position to retrieve an adaptive code vector, an adaptive code vector gain, index information to designate a random code vector, and a random code vector gain respectively to adaptive codebook 1303, multiplier 1304, random codebook 1305 comprised of the partial algebraic codebook and random codebook, and multiplier 1306.

Adaptive codebook 1303 is a buffer for previously generated excitation vectors (vectors output from adder 1307), and retrieves an adaptive code vector from a retrieval position input from excitation parameter decoder 1302 to output to multiplier 1304. Multiplier 1304 multiplies the adaptive code vector output from adaptive codebook 1303 by the adaptive code vector gain input from excitation parameter decoder 1302 to output to adder 1307.

Figure 17:
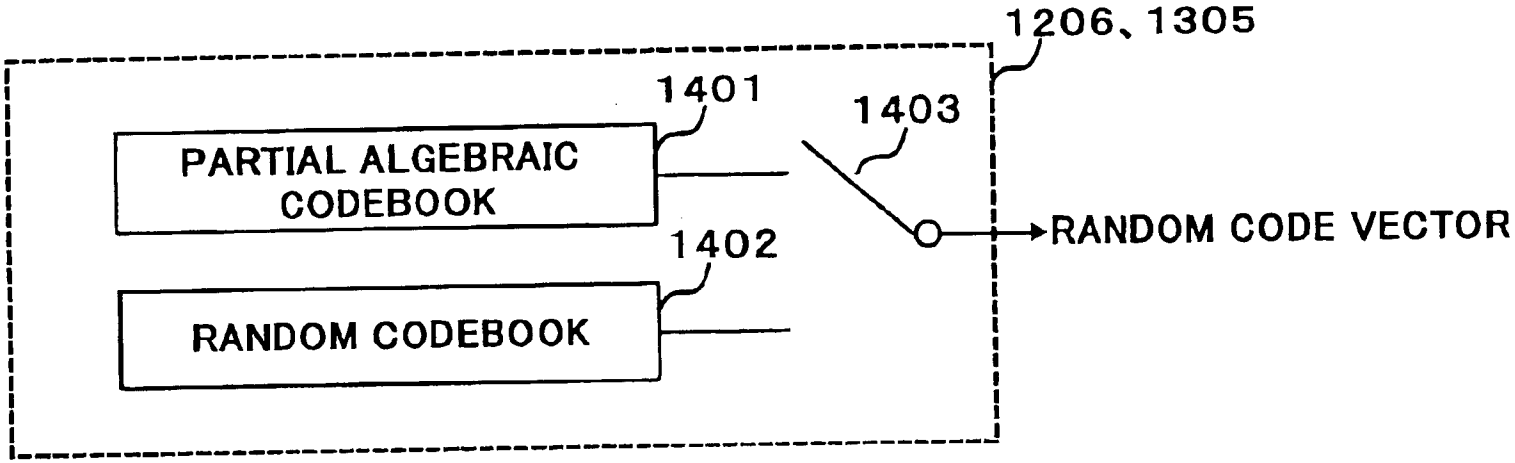
FIG. 17 is a block diagram illustrating a configuration of a random code vector generating apparatus according to the second embodiment of the present invention.

Random codebook 1305 comprised of the partial algebraic codebook and random codebook is a random codebook with the configuration illustrated in FIG. 17, is the same random codebook as that denoted by "1206" in FIG. 15, and outputs either of a random code vector comprised of a few pulses such that positions of at least two pulses designated by an index input from excitation parameter decoder 1302 are adjacent and another random code vector with a sparse rate of about 90% or less to multiplier 1306.

Multiplier 1306 multiplies the random code vector output from the partial algebraic codebook by a random code vector gain input from excitation parameter decoder 1302 to output to adder 1307. Adder 1307 performs vector addition of the adaptive code vector, multiplied by the adaptive code vector gain, output from multiplier 1304 and the random code vector, multiplied by the random code vector gain, output from multiplier 1306 to generate an excitation vector, and outputs the excitation vector to adaptive codebook 1303 and LPC synthesis filter 1308.

The excitation vector output to adaptive codebook 1303 is used when adaptive codebook 1303 is updated, and the excitation vector output to LPC synthesis filter 1308 is used to generate a synthesis speech. LPC synthesis filter 1308 is a linear predictive filter composed of the quantized LPC output from LPC decoder 1301, drives itself using the excitation vector output from adder 1307, and outputs the synthesis signal to postprocessing section 1309.

Postprocessing section 1309 subjects the synthesis speech output from LPC synthesis filter 1308 to processing for improving subjective qualities such as postfilter processing comprised of, for example, formant emphasis processing, pitch emphasis processing and spectra inclination correction processing and processing enabling a stationary background noise to be listened comfortably, and outputs the resultant as decode speech data.

FIG. 17 illustrates a configuration of a random code vector generating apparatus according to the second embodiment of the present invention. The random code vector generating apparatus illustrated in FIG. 17 is provided with partial algebraic codebook 1401 and random codebook 1402 each illustrated in the first. embodiment.

Partial algebraic codebook 1401 generates a random code vector comprised of two or more unit pulses such that at least two pulses are adjacent to output to selecting switch 1403. A method of generating the random code vector in partial algebraic codebook 1401 is described specifically in the first embodiment.

Random codebook 1402 stores random code vectors each with pulses of which the number is larger than that of the random code vector generated from partial algebraic codebook 1401, and selects one from among the stored random code vectors to output to selecting switch 1403.

Random codebook 1402 is more advantageously in computation amount and memory amount comprised of a plurality of channels than comprised of a single channel. Further, since partial algebraic codebook 1401 is capable of generating the random code vector such that two pulses are adjacent, the performance with respect to silent consonant and stationary noises can be improved by storing random code vectors such that all pulses are arranged evenly over the entire frame not to be adjacent to each other in random codebook 1402.

Further, it is preferable to set the number of pulses of the random code vector stored in random codebook 1401 at about 8 to 16 to reduce the computation amount when a frame length is 80 samples. In this case, random codebook 1401 with a 2-channel structure may store vectors each comprised of 4 to 8 pulses for each channel. Moreover, making amplitude of each pulse +1 or −1 in such a sparse vector enables further reductions of the computation amount and memory amount.

Selecting switch 1403 selects either of the random code vector output from partial algebraic codebook 1401 and the other random code vector output from random codebook 1402 under externally performed control (for example, the control is performed by a block that minimizes an error between the vector and target vector when the random code vector is used in a coder, while being performed by an index of a decoded random code vector when the generator is used in a decoder), and outputs the selected vector as random code vector 1404 of the random code vector generator.

It is herein preferable that the ratio of random code vectors output from random codebook 1402 to those output from partial algebraic codebook 1401 (random to algebraic) is 1:1 to 2:1, in other words, and that 50 to 66% are output from the random codebook and 34 to 50% are output from the algebraic codebook.

Figure 18:
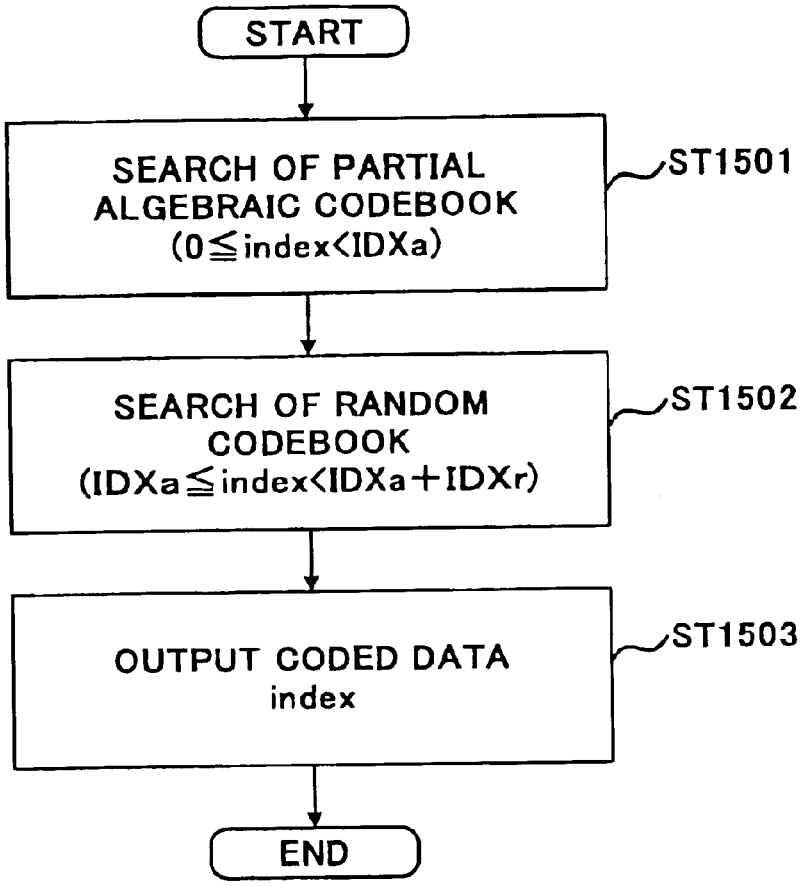
FIG. 18 is a flowchart showing a processing flow of random code vector coding according to the second embodiment of the present invention.

The following explanation is given of a processing flow of a random code vector generating method (coding method and random codebook search method) in the above embodiment with reference to FIG. 18. First at ST1501, a partial algebraic codebook search is performed. The details of the specific search method are achieved by maximizing the equation (1) as described in the first embodiment. The size of the partial algebraic codebook is IDXa, and at the step, an index "index" ($0 \leqq \text{index} < \text{IDXa}$) of an optimal candidate is determined from the partial algebraic codebook.

Next at ST1502, a random codebook search is performed. The random codebook search is performed using a method generally used in the CELP coder. Specifically, the criterion equation shown in the equation (1) is calculated with respect to all the random code vectors stored in the random codebook to determine the index "index" with respect to a vector with a maximum evaluated value. In addition, since the maximization of the equation (1) is already performed at ST1501, the "index" determined at ST1501 is updated to a new index "index" ($\text{IDXa} \leqq \text{index} < (\text{IDXa}+\text{IDXr})$) only when a random code vector exists of which the evaluated value is larger than the maximum value of the equation (1) determined at ST1501. When the random codebook does not store any random code vector of which the evaluated value is larger than the maximum value of the equation (1) determined at ST1501, the coded data ("index") determined at ST1501 is output as coded information of the random code vector.

Figure 19:
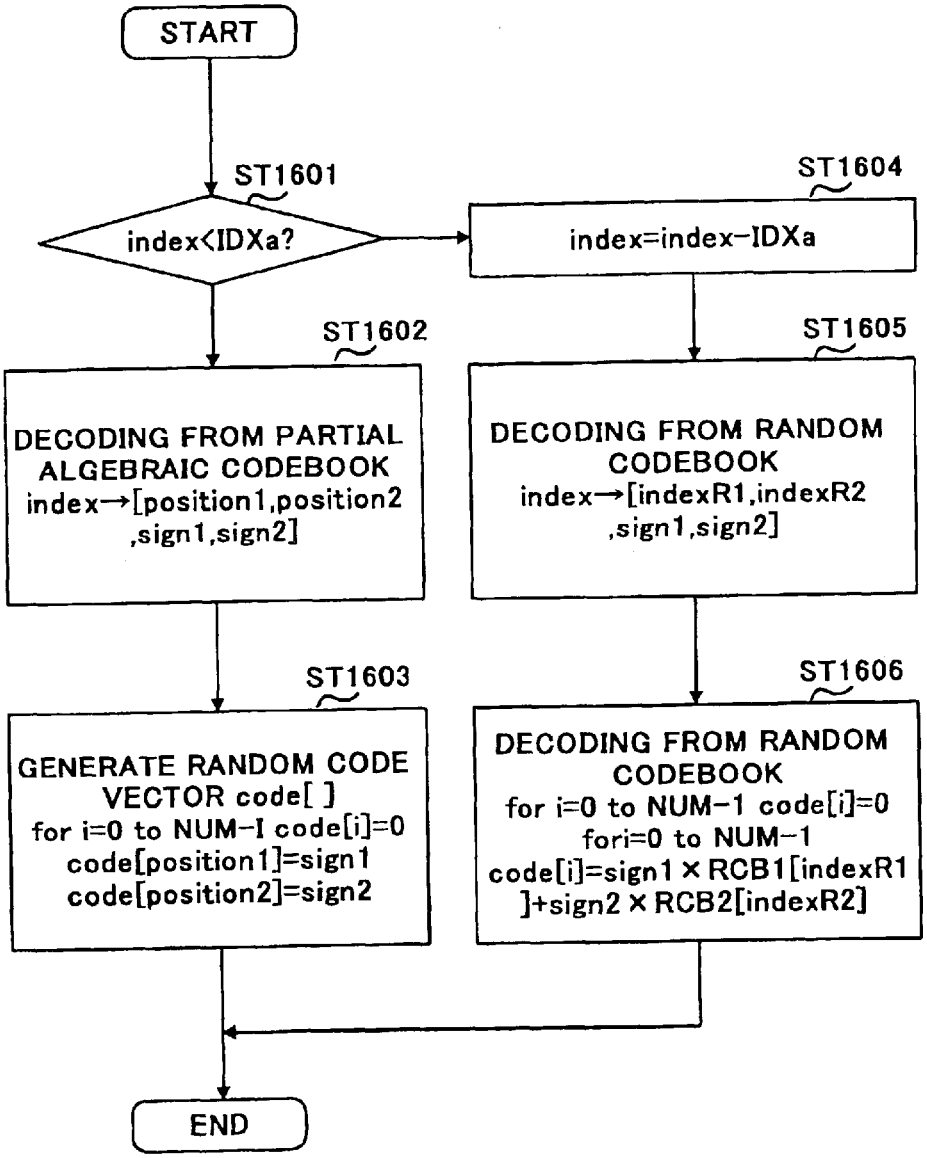
FIG. 19 is a flowchart showing a processing flow of random code vector decoding according to the second embodiment of the present invention.

The following explains about a processing flow of a random code vector generating method (decoding method) in the above embodiment with reference to FIG. 19.

First at ST1601, it is determined whether the coded information "index" of a random code vector that is transmitted from a coder and then decoded is less than IDXa. IDXa is a size of the partial algebraic code book. The random code vector generator generates random code vectors from the random codebook comprised of the partial algebraic codebook with the size of IDXa and the random codebook with the size of IDXr, and provides the partial algebraic codebook with indexes of 0 to (IDXa−1), and the random codebook with indexes of IDXa to (IDXa+IDXr−1) Accordingly, a random code vector is generated from the partial algebraic codebook when a received index is less than IDXa, while being generated from the random codebook when the received index is not less than IDXa (less than (IDXa+IDXr)). The processing flow proceeds to ST1602 when the index is less than IDXa, while proceeding to ST1604 when the index is not less than IDXa.

At ST1602, partial algebraic codebook parameters are decoded. The specific decoding method is described in the first embodiment. For example, when the number of pulses is two, the first pulse position "position1", and second pulse position "position2" are decoded from the "index". Further, when the "index" includes pulse polarity information, the first pulse polarity (sign1) and second pulse polarity (sign2) are also decoded. Herein, the sign1 and sign2 are +1 or −1.

At ST1603, the random code vector is generated from the decoded partial algebraic codebook parameters. Specifically, when the number of pulses is two, as the random code vector, a vector code[0 to Num−1] is output such that a pulse with a polarity of sign1 and with amplitude of 1 is arranged at a position of position1, and another pulse with a polarity of sign2 and with amplitude of 1 is arranged at a position of position2 with all 0 in positions except those two positions. Herein, the NUM is a frame length or random code vector length (the number of samples).

Meanwhile, when the "index" is more than or equal to IDXa at ST1601, the processing flow proceeds to ST1604. At ST1604, IDXa is subtracted from the "index". It is because of simply converting the "index" into figures in a range of 0 to IDXr−1. Herein the IDXr is the size of the random codebook.

Next at ST1605, random codebook parameters are decoded. Specifically, in the case of the random codebook with the 2-channel structure, "indexR1" of a first-channel random codebook index and "indexR2" of a second-channel random codebook index are decoded from the "index". Further, when the "index" includes pulse polarity information, the first pulse polarity (sign1) and second pulse polarity (sign2) are also decoded. Herein, the sign1 and sign2 are +1 or −1.

Next at ST1606, the random code vector is generated from the decoded random codebook parameters. specifically, in the case of the random codebook with the 2-channel structure, RCB1[indexR1][0 to Num−1] is retrieved from a first-channel RCB1, RCB2[indexR2] [0 to Num−1] is retrieved from a second-channel RCB2, and the retrieved vectors are added to be output as a random code vector "code[0 to Num−1]". Herein, the NUM is a frame length or random code vector length (the number of samples).

(Third Embodiment)

Figure 20:
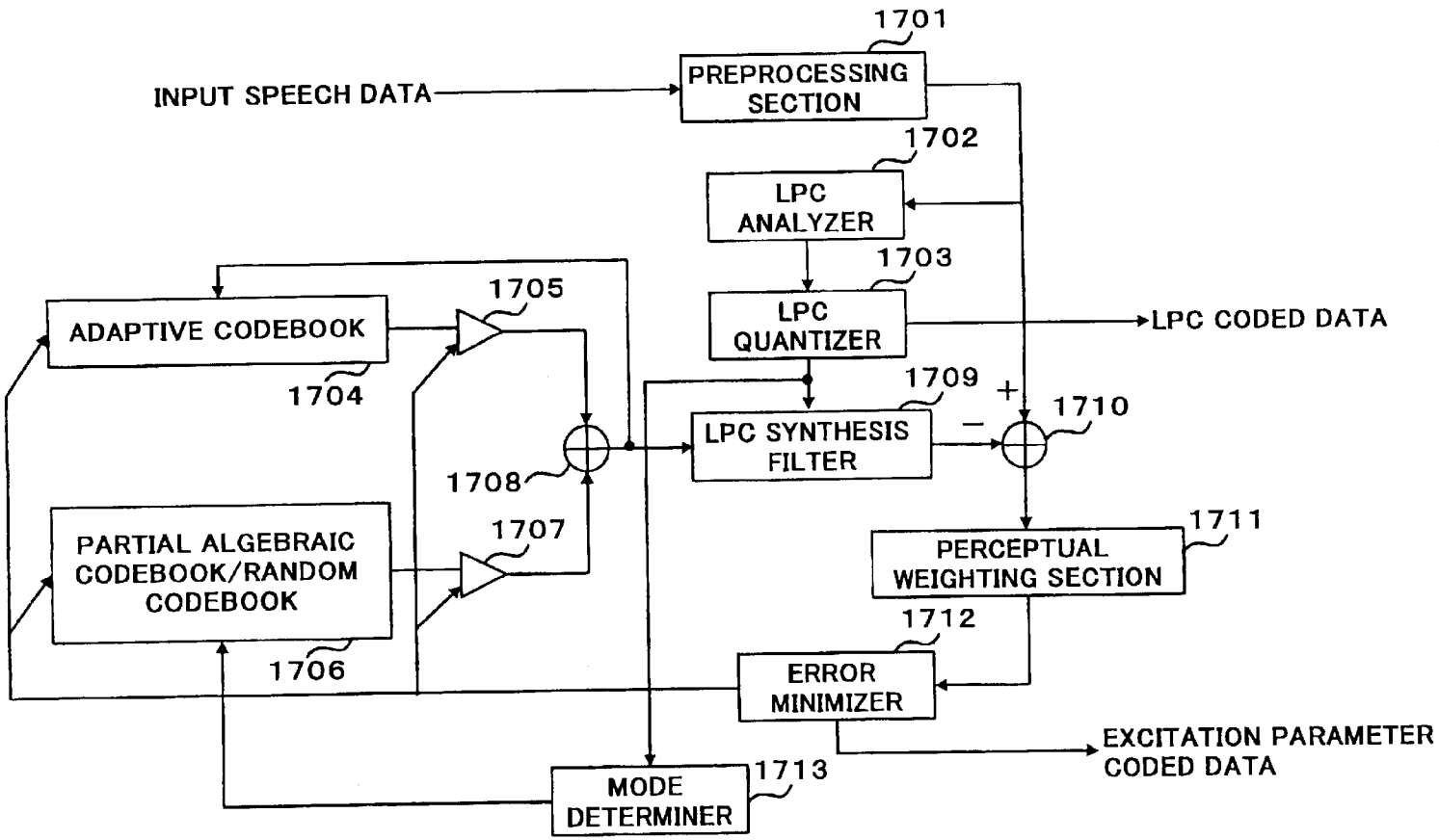
FIG. 20 is a block diagram illustrating a configuration of a speech coding apparatus according to a third embodiment of the present invention.

FIG. 20 is a block diagram illustrating a speech coding apparatus provided with a random code vector generator according to the third embodiment. The speech coding apparatus illustrated in FIG. 20 is provided with preprocessing section 1701, LPC analyzer 1702, LPC quantizer 1703, adaptive codebook 1704, multiplier 1705, random codebook 1706 comprised of a partial algebraic codebook and random codebook, multiplier 1707, adder 1708, LPC synthesis filter 1709, adder 1710, perceptual weighting section 1711, error minimizer 1712, and mode determiner 1713.

In the speech coding apparatus, input speech data is a digital signal obtained by performing A/D conversion on a speech signal, and is input to preprocessing section 1701 for each unit processing time (frame). Preprocessing section 1701 is to perform processing to improve a subjective quality of the input speech data and convert the input speech data into a signal with a state suitable to coding, and for example, performs high-pass filter processing to cut a direct current component and pre-emphasis processing to enhance characteristics of the speech signal.

A preprocessed signal is output to LPC analyzer 1702 and adder 1710. LPC analyzer 1702 performs LPC analysis (Linear Predictive analysis) using a signal input from preprocessing section 1701, and outputs obtained LPC (Linear Predictive Coefficients) to LPC quantizer 1703 . LPC quantizer 1703 performs quantization of the LPC input from LPC analyzer 1702, outputs quantized LPC to LPC synthesis filter 1709 and mode determiner 1713, and further outputs coded data of the quantized LPC to a decoder side via a transmission path.

Mode determiner 1713 performs classification (mode determination) into a speech interval and non-speech interval or into a voiced internal and unvoiced interval employing, for example, a dynamic characteristic and static characteristic of the input quantized LPC, and outputs a determination result to random codebook 1716 comprised of the partial algebraic codebook and random codebook. Specifically, the classification into the speech interval and non-speech interval is performed using the dynamic characteristic of the quantized LPC, and the classification into the voiced interval and unvoiced interval is performed using the static characteristic of the quantized LPC. Examples used as the dynamic characteristic of the quantized LPC are a variation amount between frames and a distance (difference) between average quantized LPC in an interval previously determined to be a non-speech interval and the quantized LPC in a current frame. Further, examples used as the static characteristic of the quantized LPC are first-order refection coefficients.

In addition, the quantized LPC are converted into parameters in other fields such as LSP, refection coefficients and LPC predictive residual power in order to enable themselves to be further effectively used. Moreover, when mode information can be transmitted, it is possible to perform more accurate and finer mode determination by employing various parameters obtained by analyzing the input speech data than by employing only the quantized LPC. In this case, the mode information is coded, and output to a decoder side along with coded data 1714 and excitation parameter coded data 1715.

Adaptive codebook 1704 is a buffer for previously generated excitation vectors (vectors output from adder 1708), and retrieves an adaptive code vector from a position designated from error minimizer 1712 to output to multiplier 1705. Multiplier 1705 multiplies the adaptive code vector output from adaptive codebook 1704 by an adaptive code vector gain to output to adder 1708.

The adaptive code vector gain is designated by the error minimizer. Random codebook 1706 comprised of the partial algebraic codebook and random codebook is a codebook such that a ratio of the partial random codebook to the random codebook is switched according to mode information input from mode determiner 1713, and has a configuration, as illustrated in FIG. 12, in which the number of entries of the partial algebraic codebook and that of entries of the random codebook are adaptively controlled (switched). Random codebook 1706 outputs either of a random code vector comprised of a few pulses such that positions of at least two pulse are adjacent and another random code vector with a sparse rate (ratio of the number of samples each with amplitude of 0 to the number of samples of an entire frame) of about 90% or less to multiplier 1707.

Multiplier 1707 multiplies the random code vector output from random codebook 1706 comprised of the partial algebraic codebook and random codebook by a random code vector gain to output to adder 1708. Adder 1708 performs vector addition of the adaptive code vector, multiplied by the adaptive code vector gain, output from multiplier 1705 and the random code vector, multiplied by the random code vector gain, output from multiplier 1707 to generate an excitation vector, and outputs the excitation vector to adaptive codebook 1704 and LPC synthesis filter 1709.

The excitation vector output to adaptive codebook 1704 is for use in updating adaptive codebook 1704, and the excitation vector output to LPC synthesis filter 1709 is used to generated a synthesis speech. LPC synthesis filter 1709 is a linear predictive filter composed of the quantized LPC output from LPC quantizer 1703, drives itself using the excitation vector output from adder 1708, and outputs a synthesis signal to adder 1710.

Adder 1710 calculates a difference (error) signal between the preprocessed input speech signal output from preprocessing section 1701 and the synthesis signal output from LPC synthesis filter 1709 to output to perceptual weighting section 1711. Perceptual weighting section 1711 receives as its input the difference signal output from adder 1710, and performs perceptual weighting on the input to output to error minimizer 1712.

Error minimizer 1712 receives as its input a perceptual weighted difference signal output from perceptual weighting section 1711, adjusts, for example, in such a manner as to minimize a square sum of the input, values of a position at which the adaptive code vector is retrieved from adaptive codebook 1704, the random code vector to be generated from random codebook 1706 comprised of the partial algebraic codebook and random codebook, the adaptive code vector gain to be multiplied in multiplier 1705, and the random code vector gain to be multiplied in multiplier 1707, and encodes each value to transmit to a decoder side as excitation parameter coded data via a transmission path.

Figure 21:
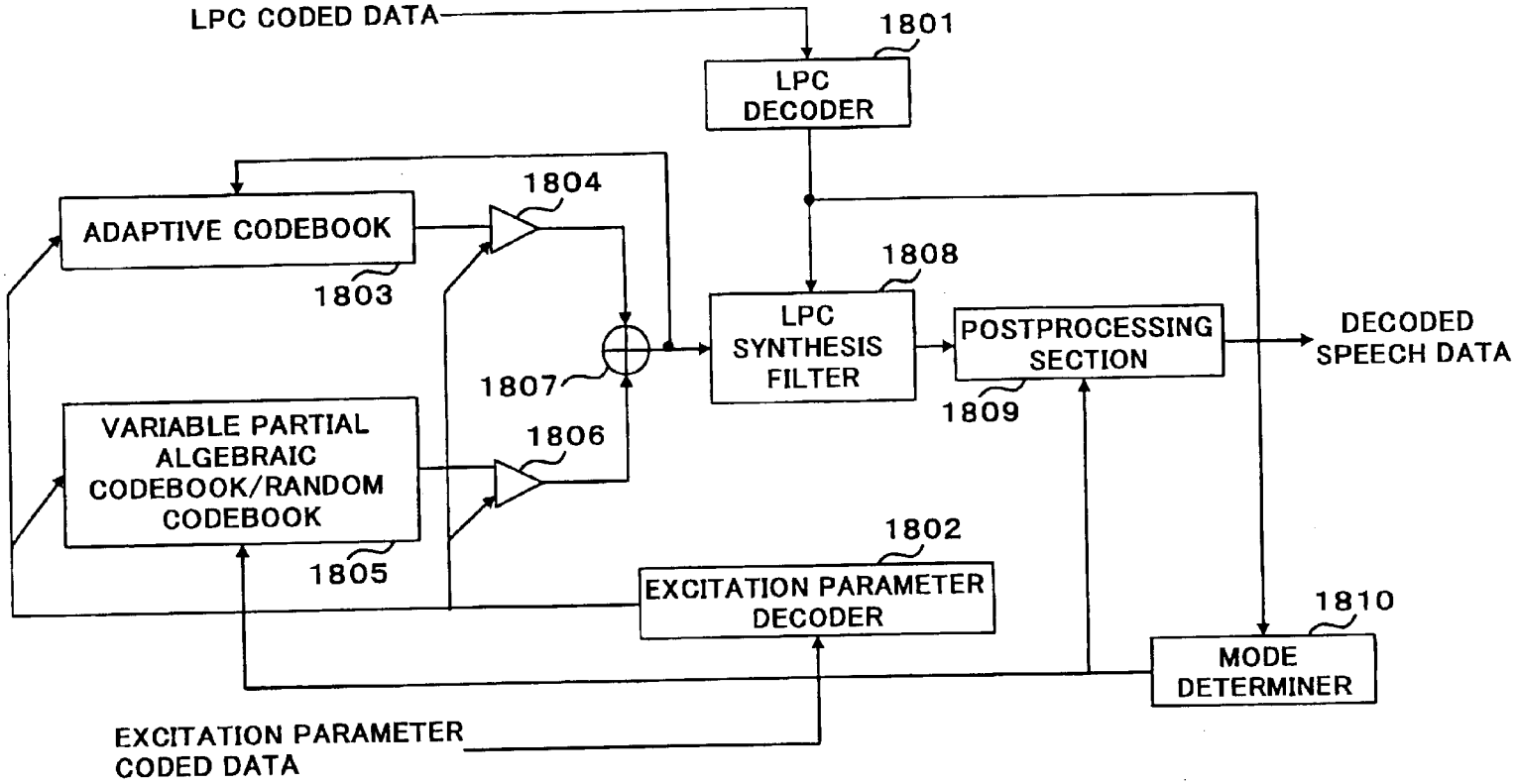
FIG. 21 is a block diagram illustrating a configuration of a speech decoding apparatus according to the third embodiment of the present invention.

FIG. 21 is a block diagram illustrating a speech decoding apparatus provided with the random code vector generator according to the third embodiment. The speech decoding apparatus illustrated in FIG. 21 is provided with LPC decoder 1801, excitation parameter decoder 1802, adaptive codebook 1803, multiplier 1804, random codebook 1805 comprised of a partial algebraic codebook and a random codebook, multiplier 1806, adder 1807, LPC synthesis filter 1808, postprocessing section 1809, and mode determiner 1810.

In the speech decoding apparatus, LPC coded data and excitation parameter coded data is respectively input to LPC decoder 1801 and excitation parameter decoder 1802 on a frame-by-frame basis via a transmission path. LPC decoder 1801 decodes quantized LPC to output to LPC synthesis filter 1808 and mode determiner 1810. The quantized LPC are concurrently output to postprocessing section 1809 from LPC decoder 1801 when postprocessing section 1809 uses the quantized LPC. Mode determiner 1810 is the same configuration as mode determiner 1713 in FIG. 20, performs classification (mode determination) into a speech interval and non-speech interval or into a voiced internal and non-voiced interval employing, for example, a dynamic characteristic and static characteristic of the input quantized LPC, and outputs a determination result to random codebook 1805 comprised of the partial algebraic codebook and random codebook and postprocessing section 1809.

Specifically, the classification into the speech interval and non-speech interval is performed using the dynamic characteristic of the quantized LPC, and the classification into the voiced interval and unvoiced interval is performed using the static characteristic of the quantized LPC. Examples used as the dynamic characteristic of the quantized LPC are a variation amount between frames and a distance (difference) between average quantized LPC in an interval previously determined to be a non-speech interval and the quantized LPC in a current frame. Further, examples used as the static characteristic of the quantized LPC are first-order refection coefficients.

In addition, the quantized LPC are converted into parameters in other fields such as LSP, refection coefficients and LPC predictive residual power in order to enable themselves to be further effectively used. Moreover, when mode information can be transmitted as another information, separately transmitted mode information is decoded, and the decoded mode information is output to random codebook 1805 and postprocessing section 1809.

Excitation parameter decoder 1802 outputs information indicative of a position to retrieve an adaptive code vector, an adaptive code vector gain, index information to designate a random code vector, and a random code vector gain respectively to adaptive codebook 1803, multiplier 1804, random codebook 1805 comprised of the partial algebraic codebook and random codebook, and multiplier 1806.

Adaptive codebook 1803 is a buffer for previously generated excitation vectors (vectors output from adder 1807), and retrieves an adaptive code vector from a retrieval position input from excitation parameter decoder 1802 to output to multiplier 1804. Multiplier 1804 multiplies the adaptive code vector output from adaptive codebook 1803 by the adaptive code vector gain input from excitation parameter decoder 1802 to output to adder 1807.

Random codebook 1805 comprised of the partial algebraic codebook and random codebook is a random codebook with the configuration in FIG. 12, is the same random codebook as that denoted by "1706" in FIG. 20, and outputs either of a random code vector comprised of a few pulses such that positions of at least two pulses designated by the index input from excitation parameter decoder 1802 are adjacent and another random code vector with a sparse rate of about 90% or less to multiplier 1806.

Multiplier 1806 multiplies the random code vector output from the partial algebraic codebook by a random code vector gain input from excitation parameter decoder 1802 to output to adder 1807. Adder 1807 performs vector addition of the adaptive code vector, multiplied by the adaptive code vector gain, output from multiplier 1804 and the random code vector, multiplied by the random code vector gain, output from multiplier 1806 to generate an excitation vector, and outputs the excitation vector to adaptive codebook 1803 and LPC synthesis filter 1808.

The excitation vector output to adaptive codebook 1803 is for use in adapting adaptive codebook 1803, and the excitation vector output to LPC synthesis filter 1808 is used to generate a synthesis speech. LPC synthesis filter 1808 is a linear predictive filter composed of the quantized LPC output from LPC decoder 1801, drives itself using the excitation vector output from adder 1807, and outputs the synthesis signal to postprocessing section 1809.

Postprocessing section 1809 subjects the synthesis speech output from LPC synthesis filter 1808 to processing for improving subjective qualities such as postfilter processing comprised of, for example, formant emphasis processing, pitch emphasis processing and spectra inclination correction processing and processing enabling a stationary background noise to be listened comfortably, and outputs the resultant as decode speech data 1810. Such postprocessing is performed adaptively using the mode information input from mode determiner 1808. In other words, the postprocessing is switched to appropriate one for each mode to be adapted, and strength and weakness of the postprocessing is adaptively changed.

Figure 22:
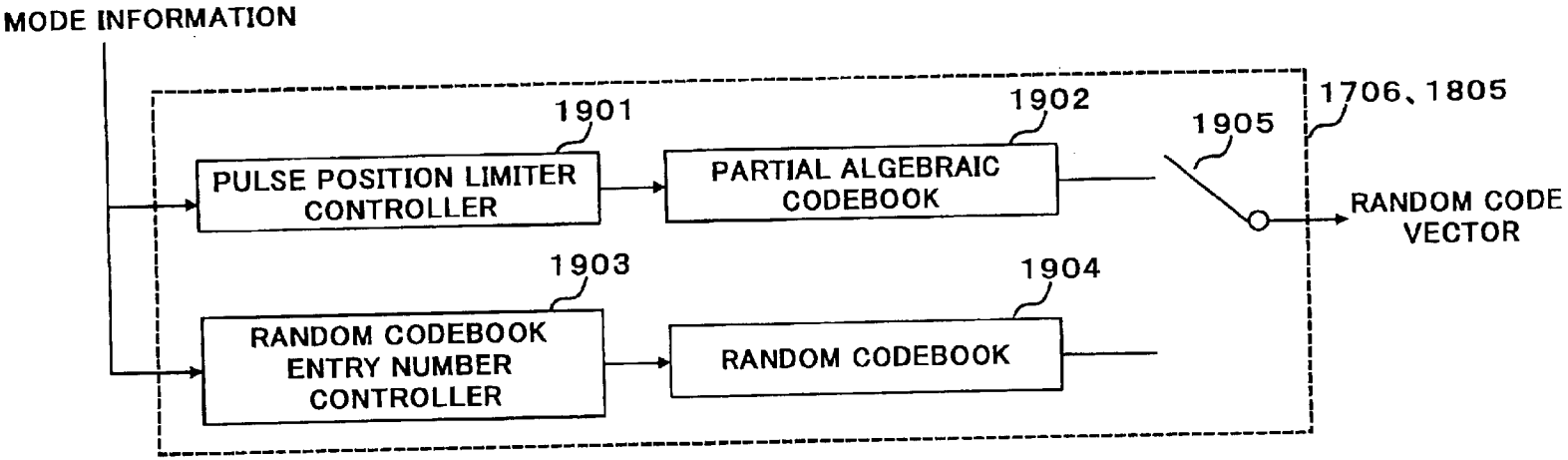
FIG. 22 is a block diagram illustrating a configuration of a random code vector generating apparatus according to the third embodiment of the present invention.

FIG. 22 is a block diagram illustrating a configuration of the random code vector generating apparatus according to the third embodiment of the present invention. The random code vector generator illustrated in FIG. 22 is provided with pulse position limiter controller 1901, partial algebraic codebook 1902, random codebook entry number controller 1903, and random codebook 1904.

Pulse position limiter controller 1901 outputs a control signal of a pulse position limiter to partial algebraic codebook 1902 corresponding to mode information input from an external. The control is performed to increase or decrease a size of the partial algebraic codebook (corresponding to a mode), and for example, when the mode is an unvoiced/stationery noise mode, the size of the partial algebraic codebook is decreased by performing a strong limitation (decreasing the number of pulse position candidates) (while random codebook entry number controller 1903 performs control so as to increase a size of random codebook 1904).

Performing such a control enables improved performance with respect to a signal such that the subjective performance deteriorates by using a random code vector comprised of a few pulses, such as an unvoiced segment and stationary noise segment. The pulse position limiter is incorporated into partial algebraic codebook 1902, and the specific operation of the limiter is described in the first embodiment.

Partial algebraic codebook 1902 is such a partial algebraic codebook that the operation of the pulse position limiter incorporated therein is controlled by the control signal input from pulse position limiter controller 1901, and increases or decreases the codebook size thereof corresponding to a limitation degree of pulse position candidates by the pulse position limiter. The specific operation of the partial algebraic codebook is described in the first embodiment. A random code vector generated from the codebook is output to selecting switch 1905.

Random codebook entry number controller 1903 performs the control for decreasing or increasing the size of random codebook 1904 corresponding to the mode information externally input. The control is performed in connection with the control by pulse position limiter controller 1901. In other words, random codebook entry number controller 1903 decreases the size of random codebook 1904 when pulse position limiter controller 1901 increases the size of partial algebraic codebook 1902, while increasing the size of random codebook 1904 when pulse position limiter controller 1901 decreases the size of partial algebraic codebook 1902. Then, the total number of entries of both partial algebraic codebook 1902 and random codebook 1904 (the size of all the codebooks in the random code vector generator) is always held at a constant value.

Random codebook 1904 generates a random code vector using the random codebook with the size designated with the control signal input from random codebook entry number controller 1903, and outputs the generated vector to selecting switch 1905. At this point, random codebook 1904 may be comprised of a plurality of random codebooks with different sizes, however, it is effective in memory amount to configure random codebook 1904 with only one kind of a random codebook to be shared with a predetermined size, and use the random codebook partially to thereby use as the random codebooks with the plurality of sizes.

Further, random codebook 1904 may be a random codebook with only one channel, however, using a random codebook comprised of a plurality of channels more than two channels is advantageous in computation amount and memory amount.

Selecting switch 1905 selects either random code output from partial algebraic codebook 1902 or random codebook 1904 under externally performed control (for example, the control signal from a block that minimizes an error between the vector and target vector when the random code vector generator is used in a coder, and decoded parameter information of the random codebook when the generator is used in a decoder), and outputs the selected vector as random code vector 1906 of the random code vector generator.

It is herein preferable that the ratio of random code vectors output from random codebook 1902 to those output from partial algebraic codebook 1902 (random to algebraic) in a voiced mode is 0.1:1 to 1:2, in other words, and that 0 to 34% are output from the random codebook and 66 to 100% are output from the algebraic codebook. Further, it is preferable that the above ratio (random:algebraic) in a non-voiced mode is 2:1 to 4:1, in other words, and that 66 to 80% are output from the random codebook and 20 to 34% are output from the algebraic codebook.

Figure 23:
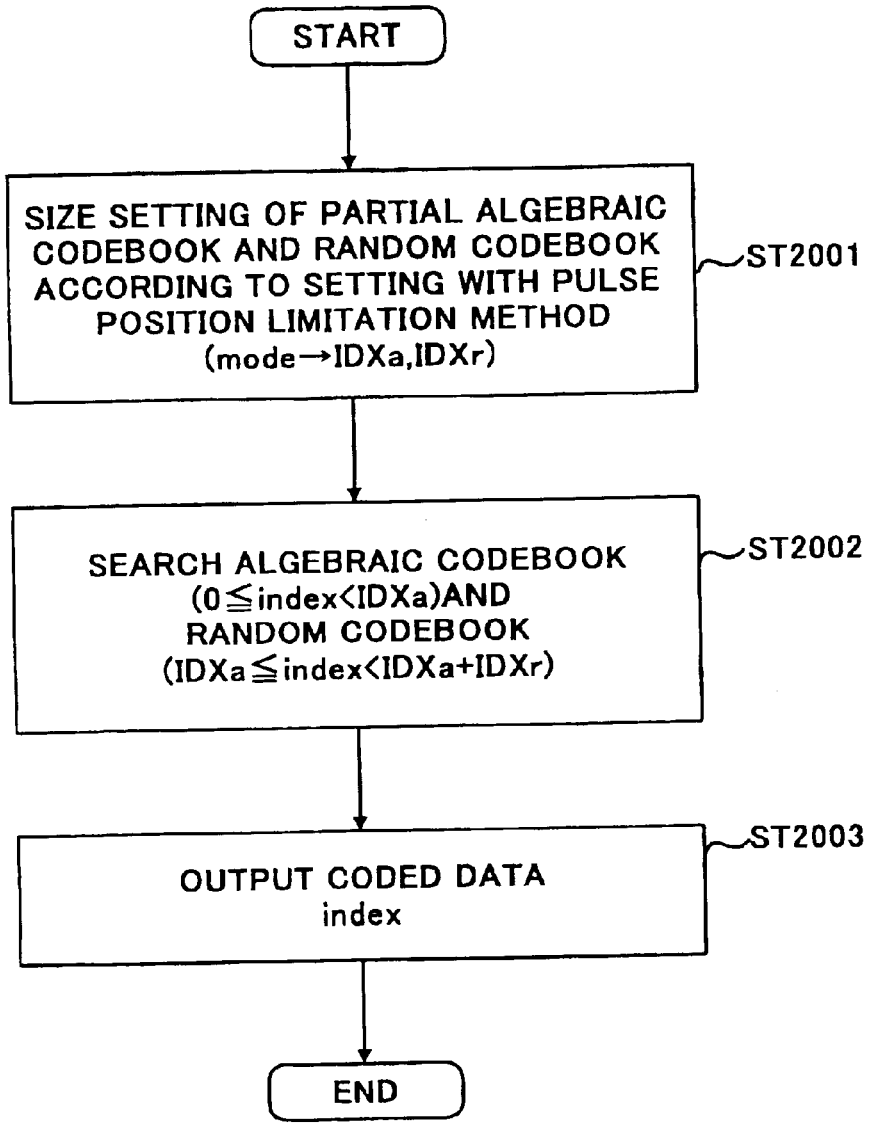
FIG. 23 is a flowchart showing a processing flow of random code vector coding according to the third embodiment of the present invention.

The following explanation is given of a processing flow of a random code vector generating method (coding method) in the above embodiment with reference to FIG. 23.

First at ST2001, sizes are set of the partial algebraic codebook and random codebook based on separately input mode information. At this point, the setting of the size of the partial algebraic codebook is performed by increasing or decreasing the number of pulse position candidates represented with relative positions as described in the first embodiment.

The increase and decrease of such pulses represented with relative positions can be performed mechanically, and the number of candidates is decreased by reducing it starting from a portion with an away relative position. Specifically, when relative positions are {1, 3, 5, 7}, the number of position candidates is decreased from {1, 3, 5}, {1, 3} to {1}. At the time of increasing, the number of candidates is increased from {1}, {1, 3} to {1, 3, 5}.

Further, the setting of the sizes of the partial algebraic codebook and random codebook is performed so that the total sum of the sizes of the partial algebraic codebook and random codebook is held at a constant value. Specifically, the sizes of both codebooks are set so as to increase the size (rate) of the partial algebraic codebook in a mode corresponding to a voiced (stationery) segment, while increasing the size (rate) of the random codebook in another mode corresponding to an unvoiced segment and noise segment.

In the block, "mode" is input mode information, IDXa is the size of the partial algebraic codebook (the entry number of random code vectors), IDXr is the size of the random codebook (the entry number of random code vectors), and IDXa plus IDXr is a constant (IDXa+IDXr=constant value). Further, the setting of the number of entries of the random codebook is, for example, achieved by setting a range of a random codebook to be referred. For instance, under the control such that the size of a 2-channel random codebook is switched between 128×128=16384 and 64×64=4096, such a setting is easily achieved by providing the random codebook with two channels each for storing 128 kinds of vectors (indexes 0 to 127), and switching a range of the index to be searched between two kinds of 0 to 127 and 0 to 63.

In addition, it is preferable in this case that a vector space in which vectors with the indexes of 0 to 127 exist matches with the other vector space in which vectors with the indexes 0 to 63 exist as much as possible. When the vectors with the indexes 0 to 63 cannot represent vectors with the indexes 64 to 127 at all, in other words, a vector space of the indexes 0 to 63 is completely different from the other vector space of the indexes 64 to 127, the change of random codebook size as described above sometimes causes the coding performance of the random codebook to deteriorate greatly, and therefore it is necessary to form the random codebook taking the foregoing into account.

Moreover, the ways of size setting (combinations) of both codebooks are necessarily limited to a few kinds when the total sum of entry numbers of the partial algebraic codebook and random codebook is kept constant, whereby the control of the size setting is equal to switching of the setting between these few kinds. At this step, the partial algebraic codebook size IDXa and random codebook size IDXr are set from the input mode information "mode".

Next at ST2002, a random code vector is selected that minimizes an error between the vector and a target vector from the partial algebraic codebook (with the size of IDXa) and the random codebook (with the size of IDXr), and an index thereof is obtained. The index "index" is determined, for example, so that it ranges from 0 to (IDXa−1) when a random code vector is selected from the partial algebraic codebook, while ranging from (IDXa−1) to (IDXa+IDXr−1) when the vector is selected from the random codebook.

Next at ST2003, the obtained "index" is output as coded data. The "index" is further coded in the form adapted to be output to a transmission path when necessary.

Figure 24:
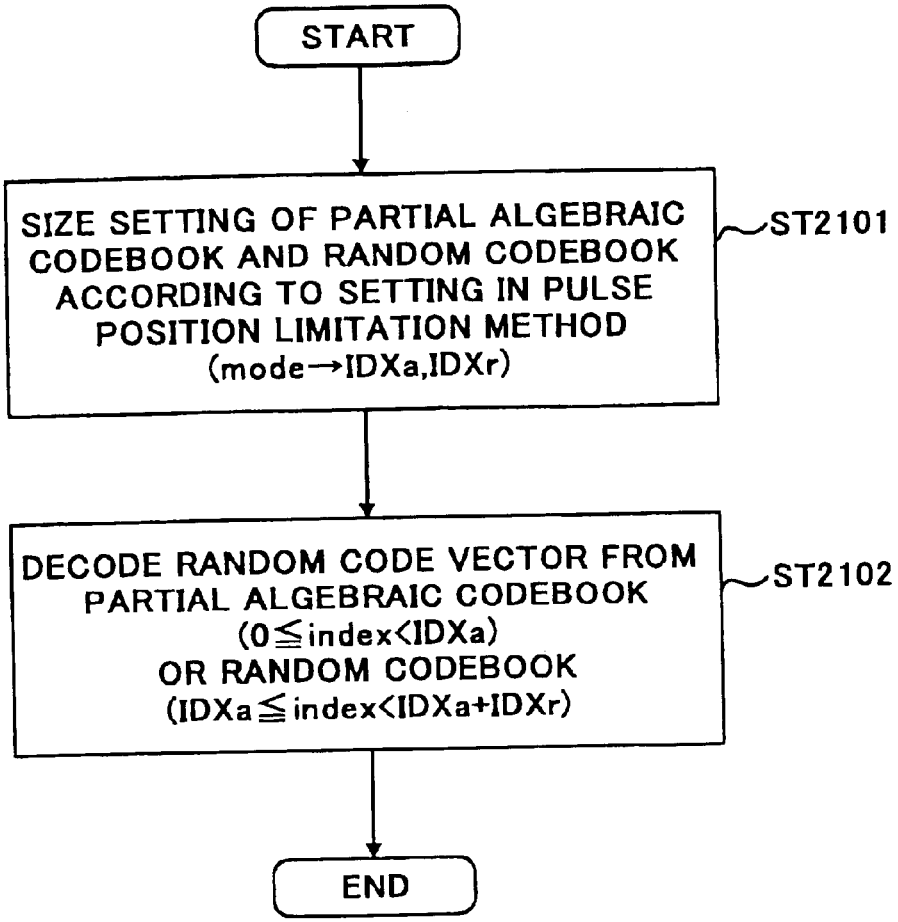
FIG. 24 is a flowchart showing a processing flow of random code vector decoding according to the third embodiment of the present invention.

The following explanation is given of a processing flow of a random code vector generating method (decoding method) in the above embodiment with reference to FIG. 24.

First at ST2101, size settings of the partial algebraic codebook and random codebook are performed based on the mode information "mode" separately decoded. The specific setting method is as described previously referring to FIG. 24. The partial algebraic codebook size IDXa and random codebook size IDXr are set from the mode information "mode".

Next at ST2102, a random code vector is decoded using either partial algebraic codebook or random codebook. Which codebook is used to decode is determined by a value of a separately decoded "index" of the random code vector. The decoding is performed from the partial algebraic codebook when the "index" ranges from 0 to IDXa ($0 \leqq \text{index} < \text{IDXa}$), while being performed from the random codebook when the "index" ranges from IDXa to IDXa+IDXr ($\text{IDXa} \leqq \text{index} < (\text{IDXa}+\text{IDXr})$). Specifically, the random code vector is decoded, for example, as explained in the third embodiment with reference to FIG. 19.

In addition, assigning the index as described above results in that different indexes are assigned to an entry of a random code vector shared among different modes (in other words, the random code vectors with the same forms have different indexes in different modes), and therefore the adverse effect due to a transmission error occurring is easily provided. In order to prevent such an effect, the same index is assigned to the entry of the random code vector shared among different modes, whereby it is possible to achieve a random code vector generating apparatus that has an error resistance. FIGS. 25 and 26 illustrate examples.

FIG. 25 illustrates an example that the size of the random codebook is 32, a (sub)frame length is 11 samples or more, a partial algebraic codebook with two pulses and a 2-channel random codebook are combined, and that vectors with pulses adjacent at an end of the (sub)frame are not considered.

Meanwhile, FIG. 26 illustrates another example that the size of the random codebook is 16, a (sub)frame length is 8 samples, a partial algebraic codebook with two pulses and a 2-channel random codebook are combined, and that vectors with pulses adjacent at an end of the (sub) frame are also considered.

In each row of FIGS. 25 and 26, a first column denotes a first pulse or a first channel of the random codebook, a second column denotes a second pulse or a second channel of the random codebook, and a third column denotes a random codebook index with respect to each combination.

Further, FIGS. 25A and 26A each illustrates a case that a rate of the random codebook is low (a small number of entries), and that a rate of the partial algebraic codebook is high (a large number of entries). FIGS. 25B and 26B each illustrates a case that a rate of the random codebook is high (a large number of entries), and that a rate of the partial algebraic codebook is low (a small number of entries). Random code vectors corresponding to indexes shown on half-tone screens with oblique lines are only different between FIG. 25A and FIG. 26A or between FIG. 25B and FIG. 26B.

In FIGS. 25 and 25, a number (except index) denotes a pulse position in the partial algebraic codebook, P1 and P2 respectively denote first and second pulse positions, Ra and Rb respectively denote first and second channels of the random codebook, a number assigned to Ra or Rb denotes a number of a random code vector stored in a respective channel. In correspondence to the algebraic codebook in FIG. 8, indexes of 0 to 5 in FIG. 26 and indexes 0 to 7 in FIG. 25 correspond to the pattern (a) in FIG. 8, indexes 6 to 9 in FIG. 26 and indexes 8 to 15 in FIG. 26 correspond to the pattern (b) in FIG, 8, and indexes 10 to 11 in FIG. 26 correspond the pattern (c) in FIG. 8 (no portion in FIG. 25 corresponds to the pattern (C) in FIG. 8).

In both FIGS. 25 and 26, since indexes shown on half-tone screens with oblique lines are orderly arranged in a limited range, it is possible to perform as follows, for example, when the decoding is performed: With respect to indexes less than or equal to 11 in FIG. 26A, the decoding is performed as explained using FIG. 12 (ID1X=6, IDX2=10). In FIG. 26B, when indexes are less than or equal to 11 and even numbers, the same decoding as the case of FIG. 26A is performed, while when the indexes are odd numbers, a vector number of each channel of the random codebook is decoded with the quotient the index divided by 2 considered as an index corresponding to the random codebook.

The foregoing is the same as in FIG. 25, and it is possible to orderly correspond the index to the vector number of the random codebook in a predetermined index range. Further with the same consideration as in coding, it is possible to perform coding while treating separately only an index portion where the random codebook and algebraic codebook are switched due to a mode change.

Performing thus enables only random code vectors corresponding to part of indexes to be affected by mode switching, and therefore also enables effects due to a wrong mode caused by transmission error to be suppressed to minimum. In such a case, while how to assign the index "index" is different from the case explained with reference to the previously described flowcharts (FIGS. 9, 12, 18, 19, 23 and 24), the basic codebook search method is the same as in the aforementioned case.

The usage ratio of the partial algebraic codebook to the random codebook is thus changed corresponding to the mode determination, whereby it is possible to improve coding performance with respect to unvoiced speeches and background noises while keeping robustness against a mode decision error.

(Fourth Embodiment)

This embodiment explains about a case that power of an excitation signal is calculated, average power is calculated from the power of excitation signals when a speech mode is a noise mode, and based on the average power, the number of predetermined pulse position candidates is increased or decreased.

Figure 27:
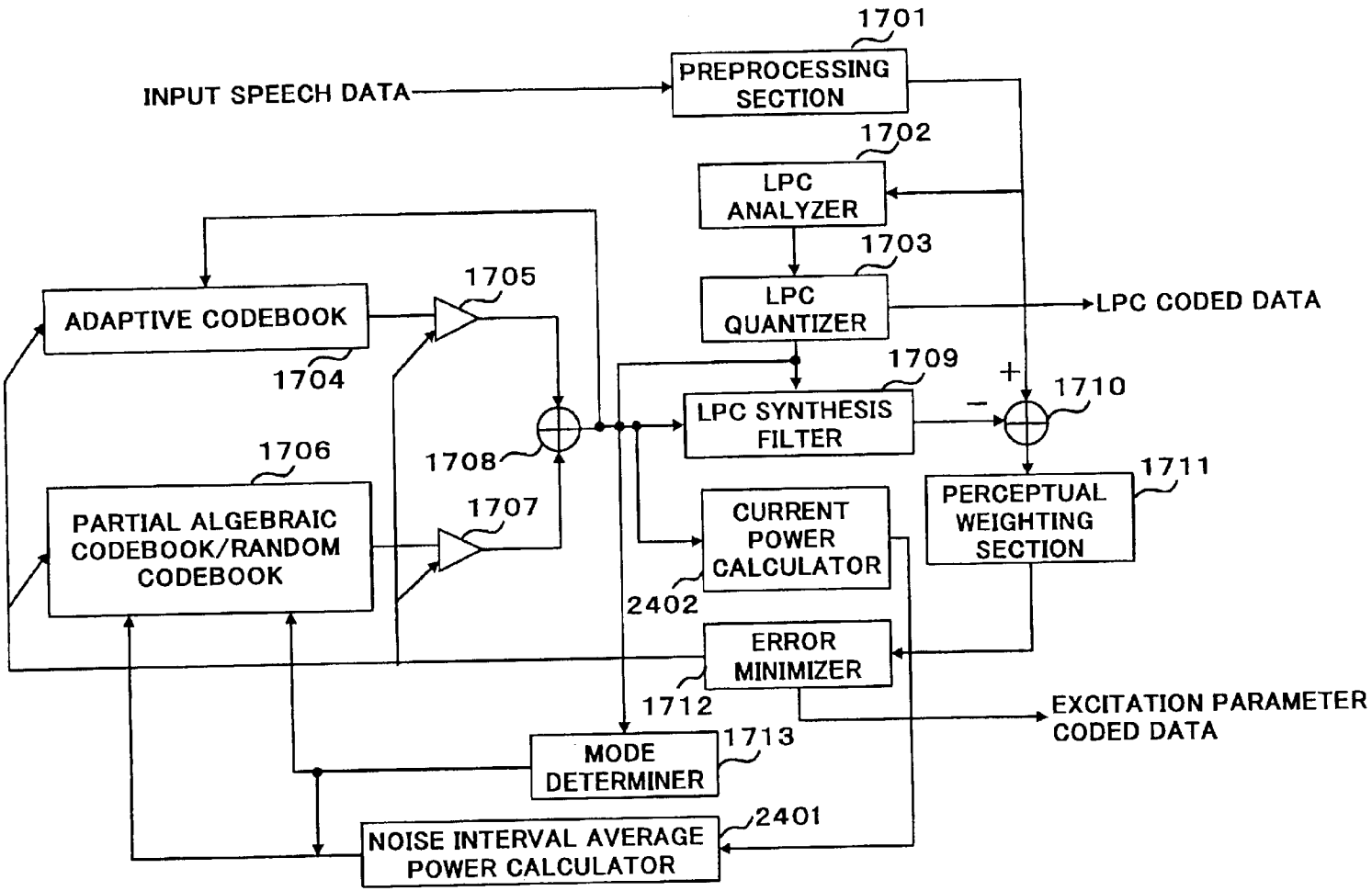
FIG. 27 is a block diagram illustrating a configuration of a speech coding apparatus according to a fourth embodiment of the present invention.

FIG. 27 is a block diagram illustrating a configuration of a speech coding apparatus according to the fourth embodiment of the present invention. The speech coding apparatus illustrated in FIG. 27 has a similar configuration to that of the speech coding apparatus illustrated in FIG. 20. The configuration illustrated in FIG. 27 is provided with current power calculator 2402 that calculates a current power level of an excitation signal, and noise interval average power calculator 2401 that calculates an average power level from power levels of excitation signals when a speech mode is a noise mode, based on mode determination information from mode determiner 1713 and the current power level from current power calculator 2402.

As explained in the third embodiment, mode determiner 1713 performs classification (mode determination) into a speech interval and non-speech interval or into a voiced internal and unvoiced interval employing, for example, a dynamic characteristic and static characteristic of the input quantized LPC, and outputs a determination result to random codebook 1716 comprised of the partial algebraic codebook and random codebook. The mode information from mode determiner 1713 is output to noise interval average power calculator 2401.

Meanwhile, current power calculator 2402 calculates a power level of an excitation signal. The excitation signal power level is thus observed. The current power calculation result is output to noise interval average power calculator 2401.

Noise interval average power calculator 2401 calculates the average power level of a noise interval based on the calculation result from current power calculator 2402 and the mode determination result. The current power calculation result is sequentially input to noise interval average power calculator 2401 from current power calculator 2402. Then, when noise interval average power calculator 2401 receives information indicative of the noise interval from mode determiner 1713, the calculator 2401 calculates the average power level of the noise interval using input current power calculation result.

The average power calculation result is output to variable partial algebraic codebook/random codebook 1706. Based on the average power calculation result, variable partial algebraic codebook/random codebook 1706 controls the usage ratio of the algebraic codebook to the random code. The control method is the same as in the third embodiment.

In addition, noise interval average power calculator 2401 compares the calculated noise interval average power with the current power sequentially input. Then, when the average power level of the noise interval is greater than the current power level, the calculator 2401 updates the average power level of the noise interval to the current power level because the average power level is considered to be improper. It is thereby possible to control the usage ratio of the algebraic codebook to the random codebook with more accuracy.

Figure 28:
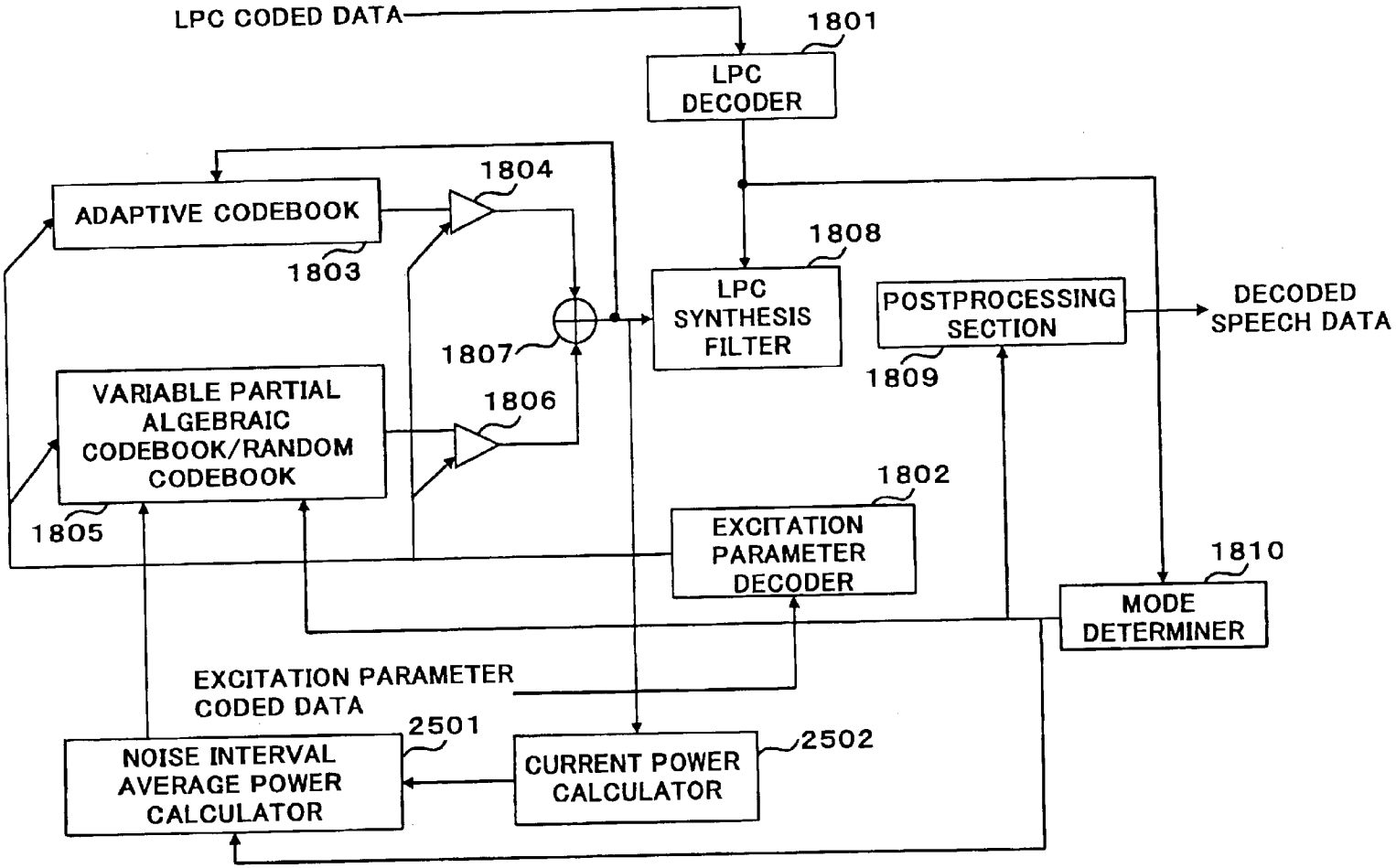
FIG. 28 is a block diagram illustrating a configuration of a speech decoding apparatus according to the fourth embodiment of the present invention.

Further, FIG. 28 is a block diagram illustrating a configuration of a speech decoding apparatus according to the fourth embodiment of the present invention. The speech decoding apparatus illustrated in FIG. 28 has a similar configuration to that of the speech decoding apparatus illustrated in FIG. 21. The configuration illustrated in FIG. 28 is provided with current power calculator 2502 that calculates a current power level of an excitation signal, and noise interval average power calculator 2501 that calculates an average power level from power levels of excitation signals when a speech mode is a noise mode, based on mode determination information from mode determiner 1810 and the current power level from current power calculator 2502.

As explained in the third embodiment, mode determiner 1810 performs classification (mode determination) into a speech interval and non-speech interval or into a voiced internal and unvoiced interval employing, for example, a dynamic characteristic and static characteristic of the input quantized LPC, and outputs a determination result to random codebook 1805 comprised of the partial algebraic codebook and random codebook and postprocessing section 1809. The mode information from mode determiner 1810 is output to noise interval average power calculator 2501.

Meanwhile, current power calculator 2502 calculates the power level of an excitation signal. The excitation signal power level is thus observed. The current power calculation result is output to noise interval average power calculator 2501.

Noise interval average power calculator 2501 calculates the average power level of a noise interval based on the calculation result from current power calculator 2502 and the mode determination result. The current power calculation result is sequentially input to noise interval average power calculator 2501 from current power calculator 2502. Then, when noise interval average power calculator 2501 receives information indicative of the noise interval from mode determiner 1810, the calculator 2401 calculates the average power level of the noise interval using input current power calculation result.

The average power calculation result is output to variable partial algebraic codebook/random codebook 1805. Based on the average power calculation result, variable partial algebraic codebook/random codebook 1805 controls the usage ratio of the algebraic codebook to the random code. The control method is the same as in the third embodiment.

In addition, noise interval average power calculator 2501 compares the calculated noise interval average power with the current power sequentially input. Then, when the average power level of the noise interval is greater than the current power level, the calculator 2401 updates the average power level of the noise interval to the current power level because the average power level is considered to be improper. It is thereby possible to control the usage ratio of the algebraic codebook to the random codebook with more accuracy.

It is herein preferable that the ratio of random code vectors output from the random codebook to those output from the partial algebraic codebook (random to algebraic) is 2:1 when a level of a noise interval is large in a voiced mode, in other words, and that about 66% are output from the random codebook and about 34% are output from the algebraic codebook. Further, it is preferable that about 98% are output from the random codebook and about 2% are output from the algebraic codebook in a non-voiced mode.

The usage ratio of the algebraic codebook to the random codebook is thus changed corresponding to the mode determination while observing noise intervals, whereby it is possible to improve coding performance with respect to unvoiced speeches and background noises while keeping robustness against a mode decision error.

In addition, while FIGS. 27 and 28 explain the case that a current power level is calculated from an excitation signal, it may be possible in the present invention to calculate the current power level using a power level of a synthesis signal subjected to LPC synthesis.

The above-mentioned speech coding apparatus and speech decoding apparatus enable themselves to be used in a communication terminal apparatus such as a mobile station in mobile station devices such as cellular phones and base station apparatus. In addition, a medium to transmit information is not limited to a radio signal as described in this embodiment, and it may be possible to use an optical signal and further to use a cable transmission path.

Further it is possible to achieve the speech coding/decoding apparatus illustrated in the above embodiment by storing corresponding software in a storage medium such as a magnetic disk, optomagnetic disk and ROM cartridge. Using such a storage medium enables the speech coding apparatus/decoding apparatus and transmission apparatus/reception apparatus to be achieved by a device using the medium, such as a personal computer.

(Fifth Embodiment)

This embodiment explains about a case of using an algebraic codebook with three excitation pulses as a random codebook. Explained herein is a case that 16 bits are assigned for each subframe. In addition, in this embodiment, the algebraic codebook is used along with a random codebook in which excitation pulses are arranged uniformly over an entire subframe.

In this case, since the random codebook is used together without changing the number of bits of an entire random codebook, it is necessary to reduce a size of the algebraic codebook. When the size of the algebraic codebook is simply reduced, the number of search position candidates for each pulse should be decreased, and thereby the search in a wide range becomes difficult. Therefore with the search range of the excitation pulse maintained, the size of the algebraic codebook is decreased.

Figure 29:
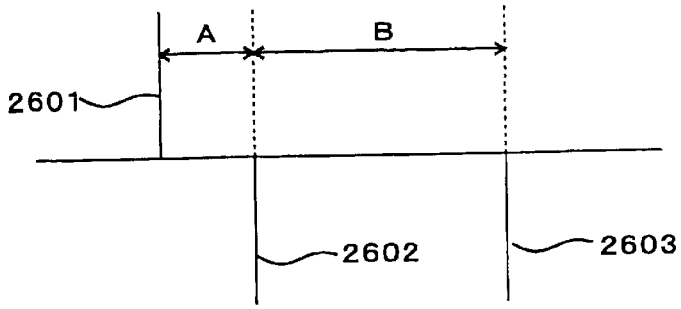
FIG. 29 is a diagram illustrating a 3-pulse excitation vector for use in a fifth embodiment of the present invention.

Specifically, with attention drawn to a form of an excitation vector generated from the algebraic codebook, a limitation is introduced such that an excitation vector having a form with a low usage frequency is not generated from the algebraic codebook, and the size of the algebraic codebook is thereby reduced. Used as a characteristic amount indicative of the form of the excitation vector is a relative position relationship between the excitation pulses. That is, as illustrated in FIG. 29, in an excitation vector comprised of three excitation pulses 2601 to 2603, there are used an interval A between a first pulse 2601 and a second pulse 2602 and an interval B between the second pulse 2602 and a third pulse 2603. Based on such a characteristic amount, the vector with the low usage frequency is determined, the size of the algebraic codebook is reduced, and then the random codebook is used together. The algebraic codebook with a thus reduced size is referred to as partial algebraic codebook because the algebraic codebook is partially used.

In order to examine a method of configuring the partial algebraic codebook, the intervals A and B are used to study the vector form with the low usage frequency. Since there exists a plurality of excitation vectors each with a combination of the intervals A and B, normalization is performed with the number of combinations capable of being generated from the partial algebraic codebook. Further, since it is considered that the tendencies are different between a voiced segment and non-voiced segment, the voiced segment and non-voiced segment are classified, for example, using first-order reflection coefficients, and usage frequency distribution is examined for each segment.

As a result of the examination, it is understood that a vector such that at least one of the intervals A and B is short has a high usage frequency in a speech segment, and that a uniform frequency distribution is obtained over the entire in the non-voiced segment as compared to the voiced segment. According to the examination result, a limitation is provided of generating only vectors such that a pulse interval between at least a pair of excitation pulses is short, and thereby the algebraic codebook is formed.

As a method of generating only vectors such that at least one pulse interval is short, there are proposed following two methods.

(Method 1)

In the partial algebraic codebook, all searches are performed, while determining whether or not an excitation pulse interval being currently searched in a loop of the search is shorter than a predetermined distance, and only shorter intervals are subject to the search.

(Method 2)

Figure 30A:
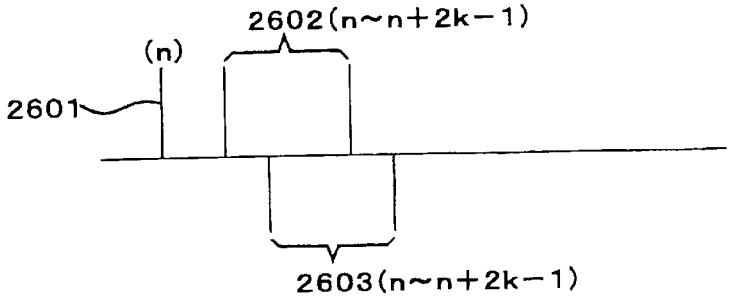
FIG. 30A is a diagram to explain an aspect of the 3-pulse excitation vector illustrated in FIG. 29.
Figure 30B:
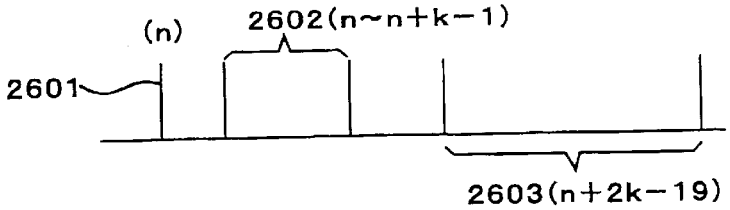
FIG. 30B is another diagram to explain the aspect of the 3-pulse excitation vector illustrated in FIG. 29.
Figure 30C:
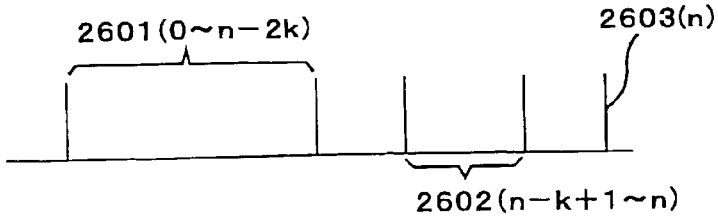
FIG. 30C is the other diagram to explain the aspect of the 3-pulse excitation vector illustrated in FIG. 29.

In the partial algebraic codebook, combinations are only searched such that a difference between indexes of the excitation pulses is in a predetermined range (K). Specifically, the partial algebraic codebook search is performed while classifying to three kinds of patterns as illustrated in FIGS. 30A to 30C (FIG. 30A: three pulses are close; FIG. 30B: former two pulses are close; and FIG. 30C: latter two pulses are close). In addition, FIGS. 30A to 30C illustrate cases that pulses are arranged in the order of 2601 to 2603, and it is necessary actually to consider all available combinations taking the order where three pulses are arrange into the account.

Using the method 1 enables a limitation due to precise pulse interval distances, however, needs a condition branch every time in the search loop. Meanwhile, in the method 2, the limitation due to precise pulse interval distances is not performed in the case of ununiform search position candidates, however, it is made possible to search only necessary portions of the algebraic codebook orderly, and the condition branch in the search loop is made no need.

Thus configuring a partial algebraic codebook with three excitation pulses set enables a partial algebraic codebook with high basic performance to be achieved.

Figure 31:
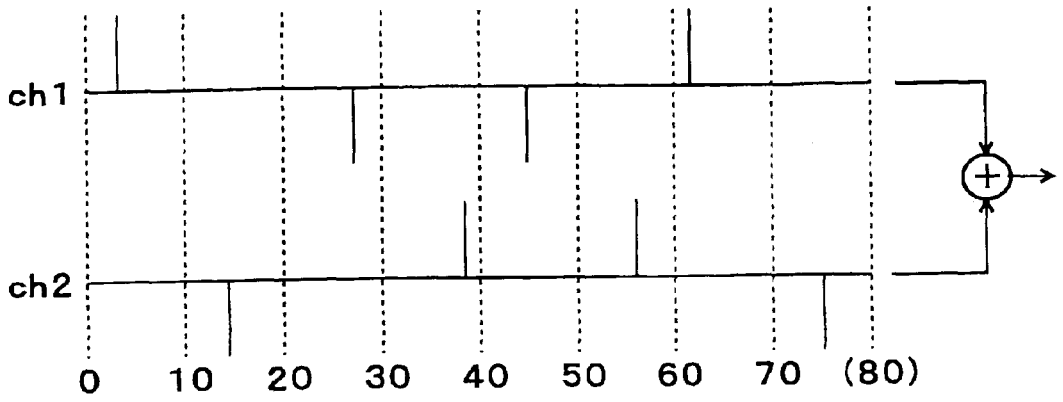
FIG. 31 is a diagram illustrating a 2 ch random code vector in the fifth embodiment.

The following explains about the random codebook used with the above-mentioned algebraic codebook. In order to improve the representative characteristic of a vector such that power is dispersed over an entire subframe, this random codebook is configured so that excitation pulses are arranged uniformly over the entire subframe as much as possible. In the random codebook, pulse amplitude is ±1, and pulse positions are limited so that pulses do not overlap between channels (ch). Further, a position and amplitude (polarity) of each excitation pulse is generated according to random numbers. FIG. 31 illustrates a random codebook with a 2-ch structure in which the total number of excitation pulses is 8.

Figure 32:
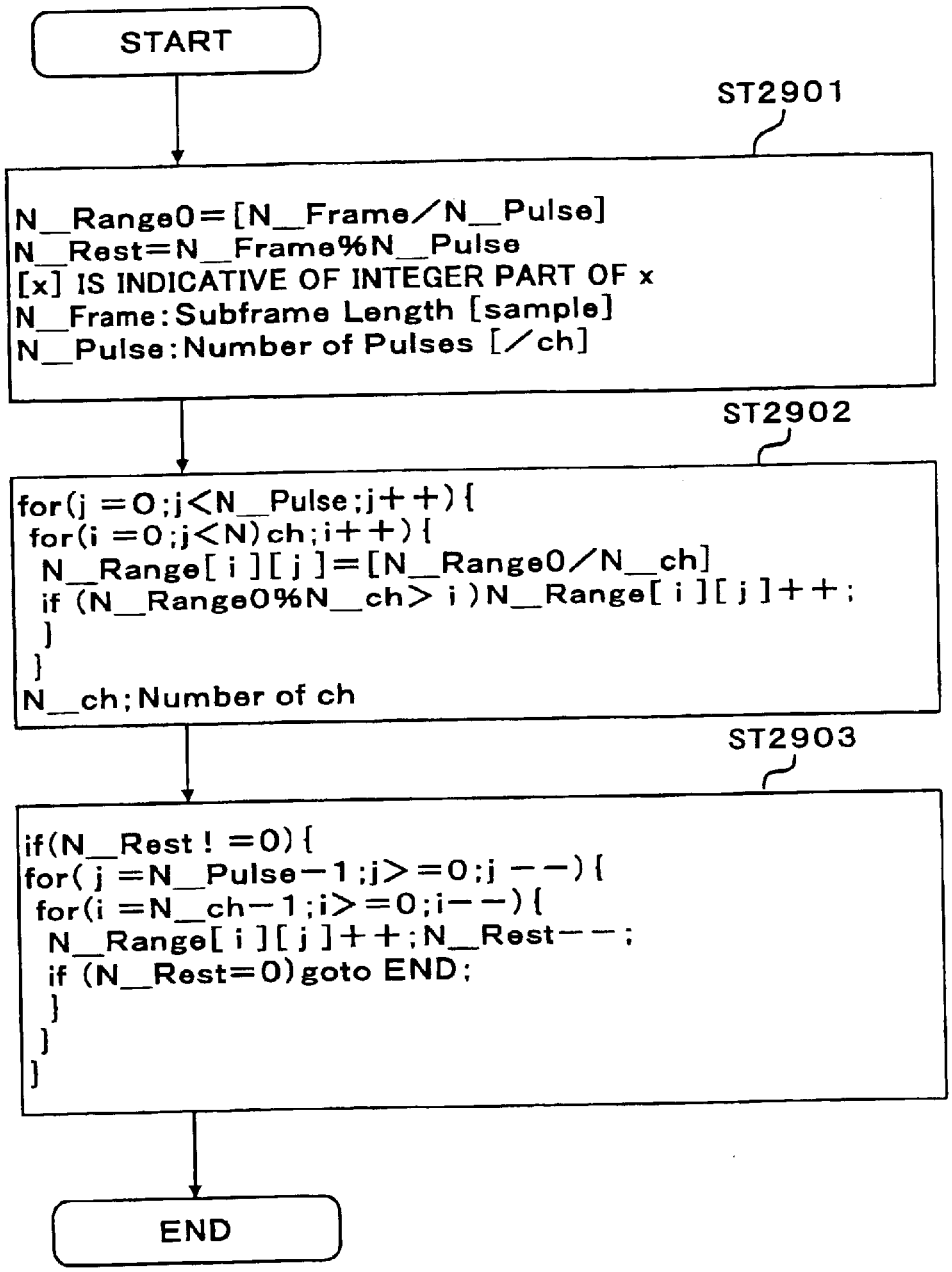
FIG. 32 is a flowchart to explain processing for setting an arrangement range of each pulse in generating a random codebook.

This random codebook is formed by setting the number of channels and the number of pulses, further setting an arrangement range for each pulse, and determining a position and polarity of each pulse. In a method of forming the random codebook, the settings of the number of channels and the number of pulses are first performed, and then the arrangement range for each pulse is set. In other words, a range length in which each pulse is arranged (N_Range[i][j]) is set. This setting is performed as illustrated in FIG. 32.

First, a subframe length is divided by the number of pulses (corresponding to one channel) to obtain N_Range0, and the remainder is stored as N_Rest (ST2901). Next, N_Range0 is divided by the number of channels to set N_Range[i] [j] (ST2902). Herein, i denotes a channel number, and j denotes a pulse number. At this point, when N_Range0 is not divisible by the number of channels (N_ch), the remainder is assigned in ascending order of the channel number (ST2902).

Next, N_Rest is assigned sequentially staring from N_Range[N_ch−1] [N_Pulse−1] of a pulse that is arranged at a final portion in the subframe (ST2903). The setting of N_Range[i] [j] is thereby completed.

Figure 33:
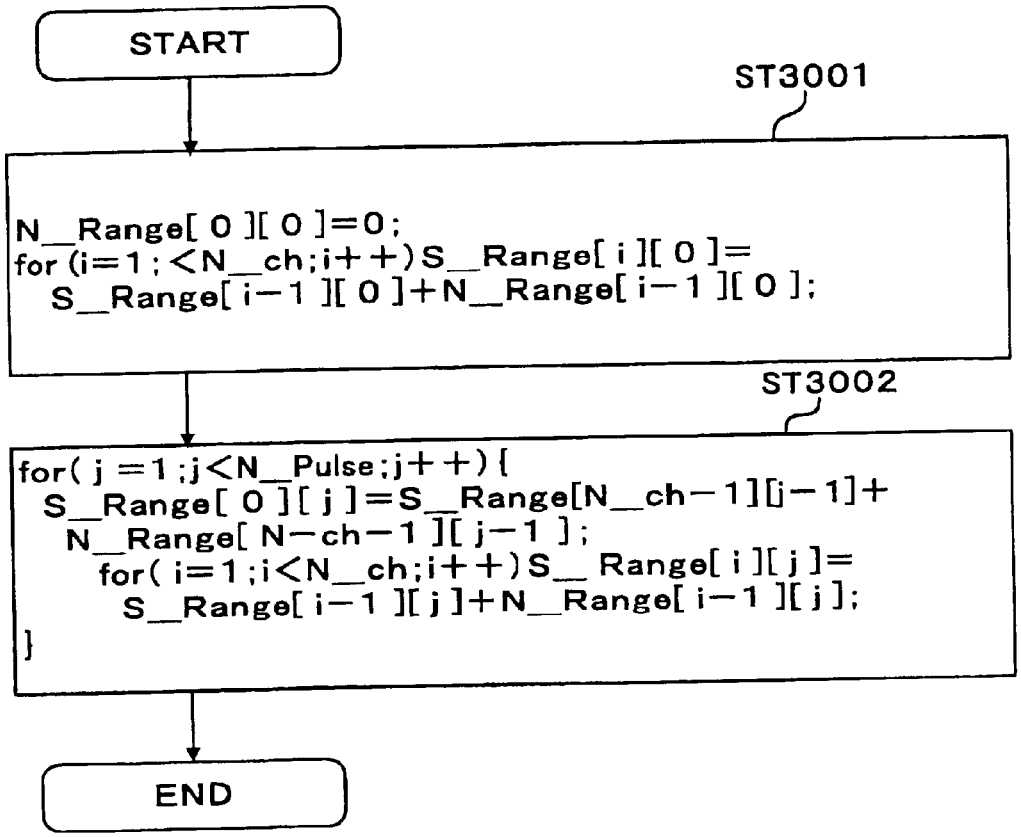
FIG. 33 is another flowchart to explain the processing for setting an arrangement range of each pulse in generating the random codebook.

In the setting of the arrangement range for each pulse, a starting position (S_Range[i][j]) of N_Range[i] [j] is set. In other words, when N_Range[i] [j] is arranged sequentially staring from a beginning of the subframe, a respective head position is obtained. The setting of the starting position is performed as illustrated in FIG. 33. S_Range[i] [0] is determined of a first pulse of each channel. In this case, the determination is performed in ascending order of the pulse number (ST3001). Next, rest of S_Range[i] [0] is determined similarly (ST3002). Thus the setting of S_Range[i] [j] is completed.

Figure 34:
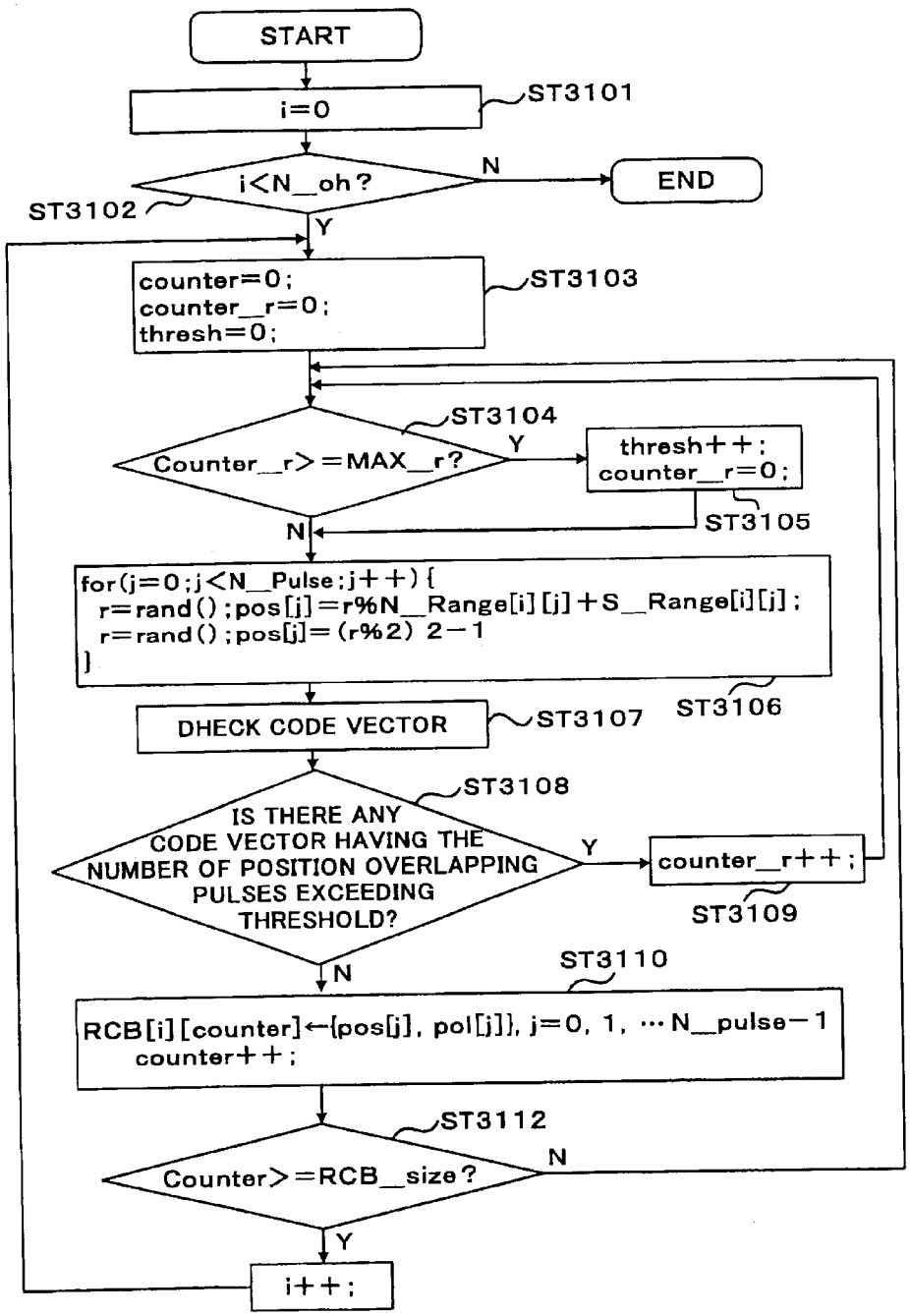
FIG. 34 is a flowchart to explain processing for determining a position and polarity of a pulse in generating the random codebook.

As described above, the setting of the arrangement range of each pulse is performed, and then a position and polarity of each pulse is determined. The determination on the position and polarity of each pulse is performed as illustrated in FIG. 34. First, a loop counter for a channel is reset (ST3101). Next, it is judged whether or not a loop counter "i" is smaller than N_ch (ST3102). When the loop counter "i" is smaller than N_ch, the counter and threshold are reset (ST3103). In other words, this step is to reset the number of determined random code vectors (counter), the number of times the random code vector is generated (counter_r), and the number of pulses allowed to have different positions (thresh). Meanwhile, when the loop counter "i" is not smaller than N_ch, the random codebook formation is finished.

Next, it is judged whether or not the number of times the random code vector is generated (counter_r) is maximum MAX_r (ST3104). When the counter_r is not MAX_r, a pulse position and polarity are generated due to code vector generation and random numbers (ST3106). When the counter_r is MAX_r, the threshold (thresh) is incremented, and the repeating counter (counter_r) is reset (ST3105). Then, a pulse position and polarity are generated due to code vector generation and random numbers (ST3106). In addition, in the generation of pulse position and polarity due to random numbers, rand( ) is indicative of integer random number generation function.

Next, after generating pulse positions and polarities, a code vector is checked (ST3107). At this point, a generated code vector is compared with all code vectors already registered with the random codebook to check whether code vectors with overlapping pulse positions exist. Then, the number of pulses with overlapping positions is counted for each code vector.

Next, it is judged whether or not a code vector such that the number of pulses with overlapping positions exceeds a threshold exists in the random codebook (ST3108). When there is the code vector such that the number of pulses with overlapping positions exceeds the threshold, the repeating counter (counter_r) is incremented (ST3109), and then the processing flow proceeds to ST3104. Meanwhile, when there is no code vector such that the number of pulses with overlapping positions exceeds the threshold, the code vector is registered with the random codebook (ST3101). In other words, the code vector generated due to the random numbers is stored in the random codebook, and the counter (counter) is incremented.

Next, it is judged whether or not the counter (counter) is greater than a size of the random codebook (ST3111). When the counter (counter) is greater than the size of the random codebook to be generated, the channel loop counter is incremented (ST3112), and the processing flow proceeds to ST3102. When the counter (counter) is not greater than the size of the random codebook to be generated, the processing flow proceeds to ST3104.

In the formation of the random codebook, pulse positions and polarities of a code vector are determined according to random numbers, while checking so that a position of a pulse does not overlap another position of an already determined pulse. Thus, pulse positions that do not overlap one another are first generated, and then the number of pulses with overlapping positions is increased sequentially.

Further in the formation of the random codebook, the entire subframe is divided uniformly, and when it is not divided uniformly, a range in ch1 is made wider than in ch2, and a range is made wider at an end of a subframe. An example is explained using FIG. 35. In FIG. 35, a number (except a pulse number) denotes an arrangement range (N_Range[i][j] or starting position (S_Range[i][j]) of each pulse (with a pulse number j), and the pulse numbers are described downwardly in the figures starting from a beginning to an end of a subframe. In FIG. 35A, the number of pulses is 4, and therefore 80 samples can be divided uniformly over the entire subframe. In FIG. 35B, the number of pulses is 6, and therefore 80 samples are not divided uniformly over the entire subframe. In this case, ch1 (7) is made wider than ch2 (6), and further, a respective range at an end of the subframe is made wider (ch1:8, ch2:7). Why the range in ch1 is made wider than in. ch2 is based on the assumption that the number of code vectors (code size) of ch1 is made larger than the number of code vectors of ch2. In addition, it may be considered to set N_Range[i] [j] of ch1 and ch2 equal and assign the residual uniformly to each channel at a latter part of the subframe.

By thus forming a random codebook, it is possible to efficiently form a random codebook such that excitation pulses are distributed over the entire subframe. Further, since the number of overlapping excitation pulses is increased at a latter part of the random codebook, it is possible to form a desirable codebook by reducing the size thereof starting from the latter part when the size of the codebook is decreased.

The following explanation is given of a case that mode switching is applied in using together the partial algebraic codebook and random codebook. In this case, the partial algebraic codebook is separated into blocks according to excitation pulse forms, and reduced stepwise corresponding to the blocks, and according to the reduction, the random codebook is increased stepwise (adaptively).

Figure 36:
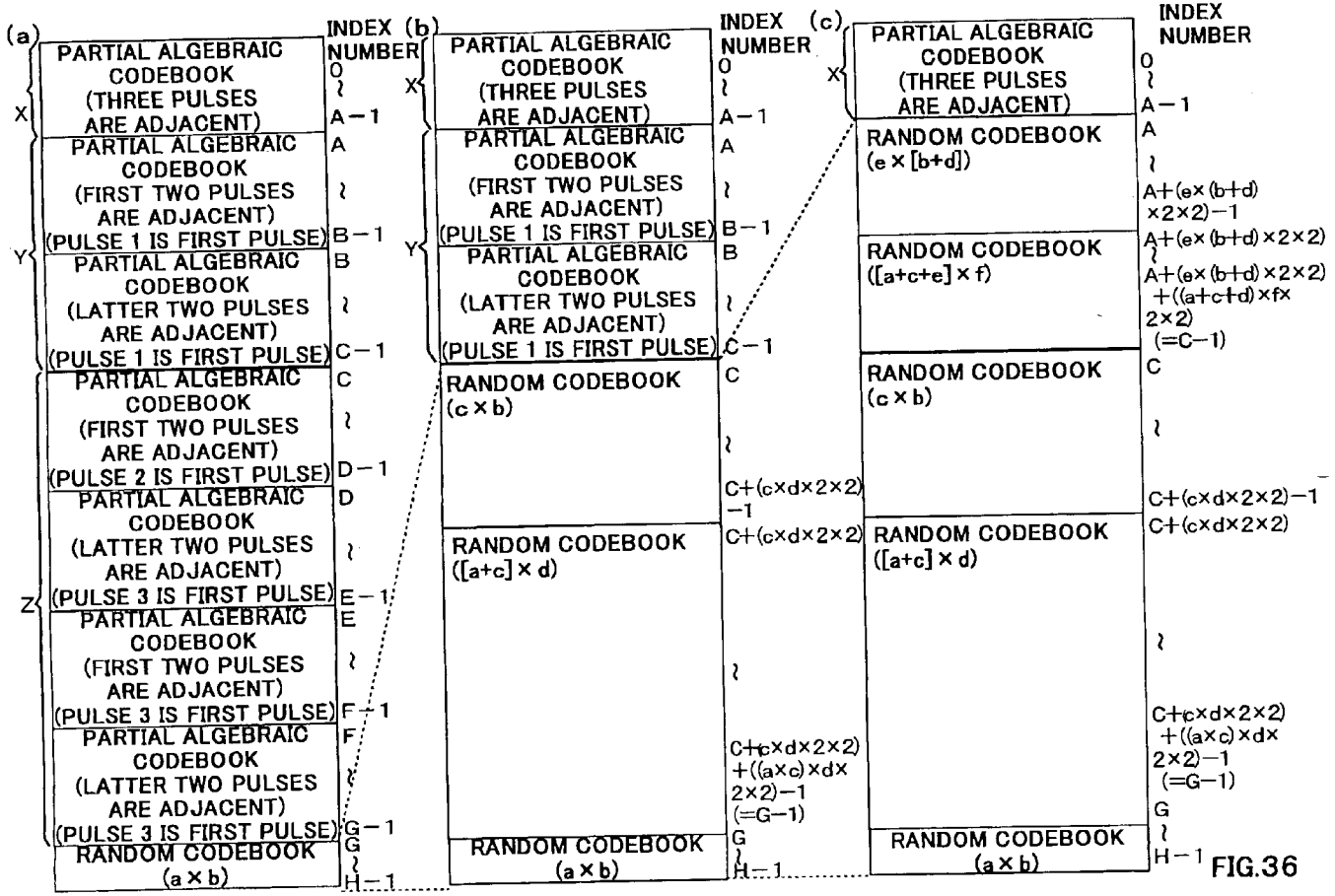
FIG. 36 is a diagram illustrating an aspect that a partial algebraic codebook and random codebook are used together.
Figure 37A:
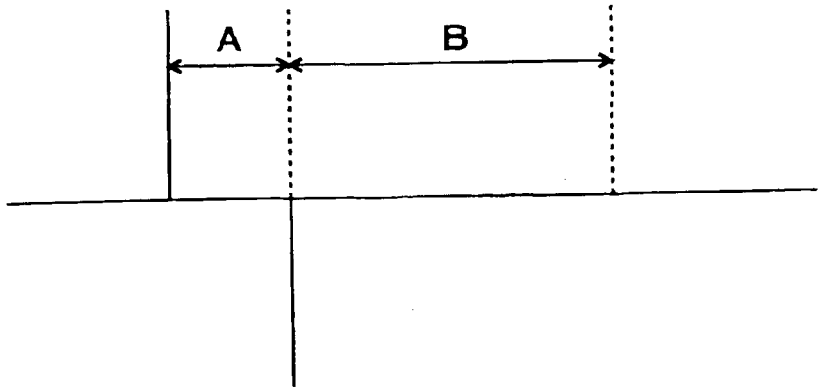
FIG. 37A is a diagram to explain a block separation of the partial algebraic codebook.
Figure 37B:
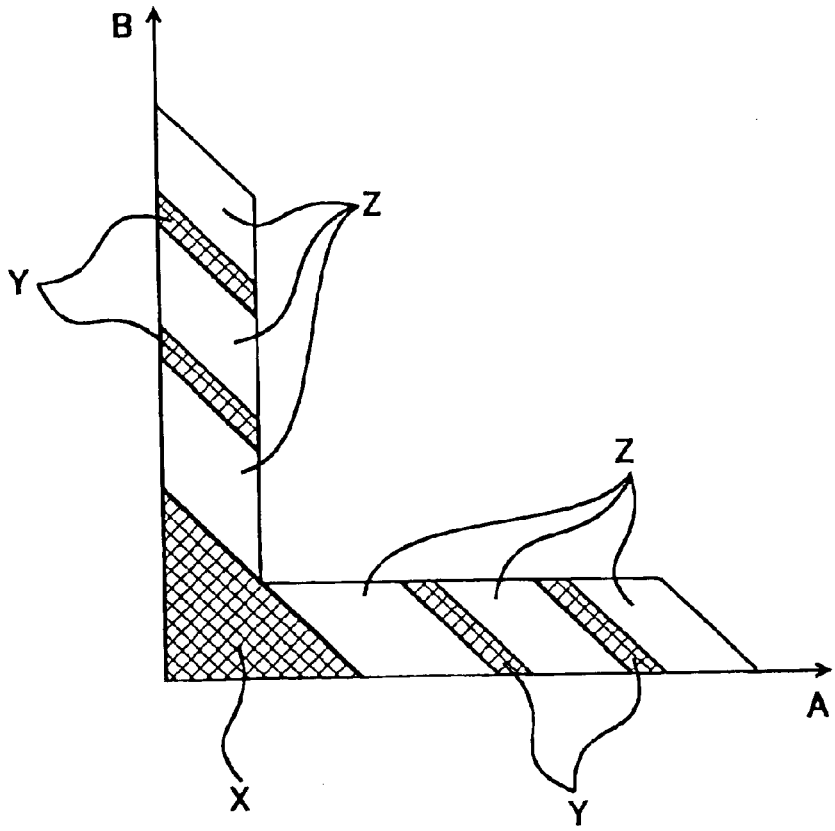
FIG. 37B is another diagram to explain the block separation of the partial algebraic codebook.

FIG. 36 is a diagram illustrating the partial algebraic codebook separated into blocks. The block separation is performed corresponding to excitation pulse forms. These blocks are determined with the pulse intervals A and B (to be more corrected, a difference between indexes) of excitation pulses illustrated in FIG. 37A. That is, blocks X to Z respectively correspond to regions illustrated in FIG. 37B.

Thus separating the partial algebraic codebook into blocks to reduce the size thereof enables the size control to be performed easily. Specifically, it is only required to set a search loop in a corresponding block to "OFF".

The random codebook is separated into stages, while thus separating the partial algebraic codebook into blocks. Herein, as illustrated in a pattern (a) in FIG. 38, the random codebook is separated into three stages for each of ch1 and ch2. Specifically, a first stage includes a and b, a second stage includes c and d, and a third stage includes e and f. Employing the above-mentioned processing, the partial algebraic codebook is reduced per block basis, and corresponding to the reduced size, the random codebook is increased stepwise to increase a rate of the random codebook. A mode is determined corresponding to the decrease of the partial algebraic codebook and increase of the random codebook. Specifically, modes respectively illustrated in (a) to (c) in FIG. 36 are determined. In addition, the number of modes is one of examples. It may be possible to use two modes when the mode setting is performed rougher than in FIG. 36, and further possible to use four modes or more when the mode setting is performed finer than in FIG. 36.

Figure 38:
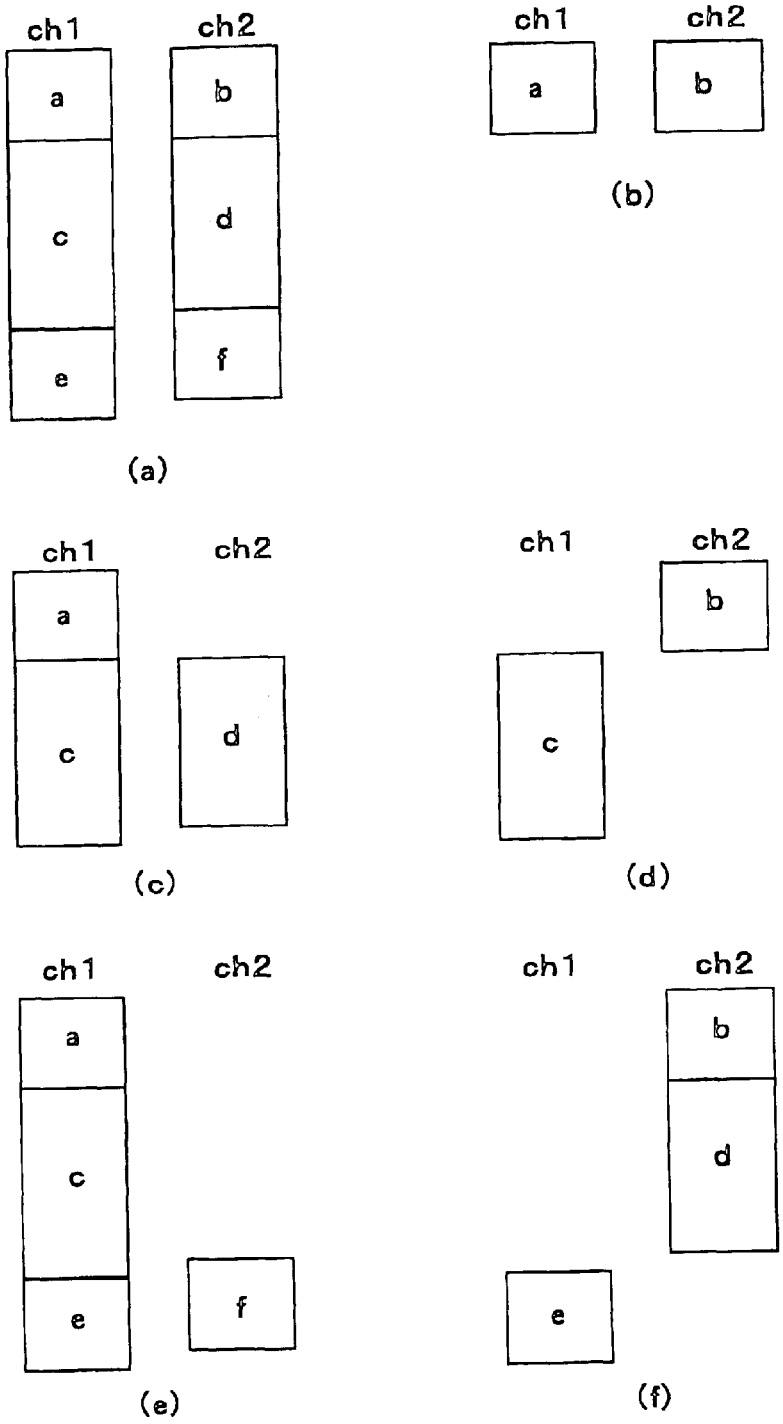
FIG. 38 is a diagram to explain a stepwise increment of the random codebook.

The random codebook used for each mode is explained using FIGS. 36 and 38. It is assumed that (a) denotes a mode with a random codebook of a smallest size, (c) denotes another mode with a random codebook with a largest size, and that (b) denotes the other mode with a random codebook of a middle size. When the mode is changed in the order of (a), (b) and (c), in FIG. 35, the size of the random codebook in ch1 is increased from a to (a+c) to (a+c+e), and the size of the random codebook in ch2 is increased from b to (b+d) to (b+d+f). At this point, in order to assign the same index to common code vectors among modes in each mode, the following index assignment method is used.

First, indexes are assigned of vectors generated by a×b. Next, indexes are assigned of vectors generated by c×b and (a+c)×d. Finally, indexes are assigned of vectors generated by (a+c+e)×f and e×(b+d). FIG. 36 illustrates an example of this assignment method.

Accordingly, the partial algebraic codebook and random codebook are formed as follows in the case of using those together: When the partial algebraic codebook is comprised of blocks X, Y and Z, as illustrated in (a) in FIG. 36, the random codebook has a portion illustrated in the pattern (b) of the random codebook in FIG. 38. When the partial algebraic codebook is comprised of blocks X and Y, as illustrated in (b) in FIG. 36, the random codebook has portions illustrated in the patterns (b) to (d) of the random codebook in FIG. 38. Further, when the partial algebraic codebook is comprised of the block X, as illustrated in (c) in FIG. 36, the random codebook has portions illustrated in the patterns (b) to (f) of the random codebook in FIG. 38.

The mode switching is performed according to a mode information transmitted with a control signal from the mode determiner. It may be possible to generate the mode information according to information obtained by decoding various information such as LPC parameter and gain parameter transmitted from a coder side, and further possible to use mode information transmitted from a coder side.

Thus, the partial algebraic codebook is reduced per block basis and the random codebook is increased stepwise, whereby it is possible to control sizes of the partial algebraic codebook and random codebook with ease. Further, since common code vector indexes can be made the same in different modes, it is possible to suppress effects caused by a mode error.

The following description is given of a specific example of a structure ratio of the partial algebraic codebook to the random codebook in each mode of a voiced mode, unvoiced mode and stationary noise mode which are assumed herein to be all the modes. While the following optimal ratios may be changed according to a bit allocation, in an example of a random codebook of 16 bits, it is preferable that the ratio of the partial algebraic codebook to the random codebook is about 50%:50% in the voiced mode, about 10%:90% in the unvoiced mode, and about 10%:90% (the rate of the random codebook may be increased to about 100%., i.e., about 0%:100% when extremely few mode errors exist) in the stationary noise mode. In addition, when a decoder side performs postprocessing to improve the subjective quality of a stationary noise signal, a case sometimes occurs that it is not necessary to particularly increase the rate of the random codebook in the stationary noise mode.

(Sixth Embodiment)

This embodiment explains a case that a noise characteristic of a dispersion pattern is switched according to a noise power level (average power level over a previous noise mode interval), or a first sample value of the dispersion pattern is operated according to the noise power level.

Figure 39:
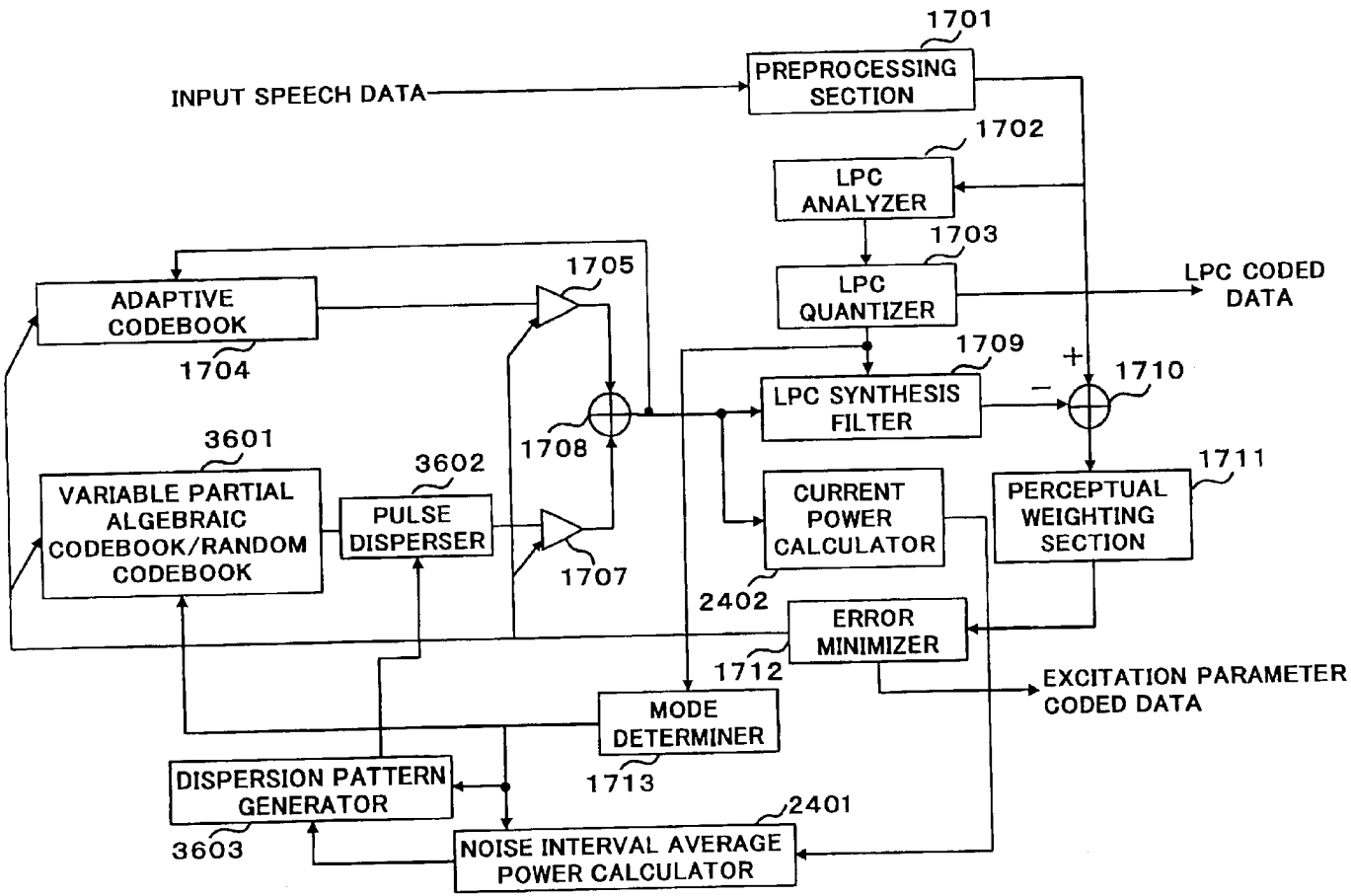
FIG. 39 is a block diagram illustrating a configuration of a speech coding apparatus according to a sixth embodiment of the present invention.
Figure 40:
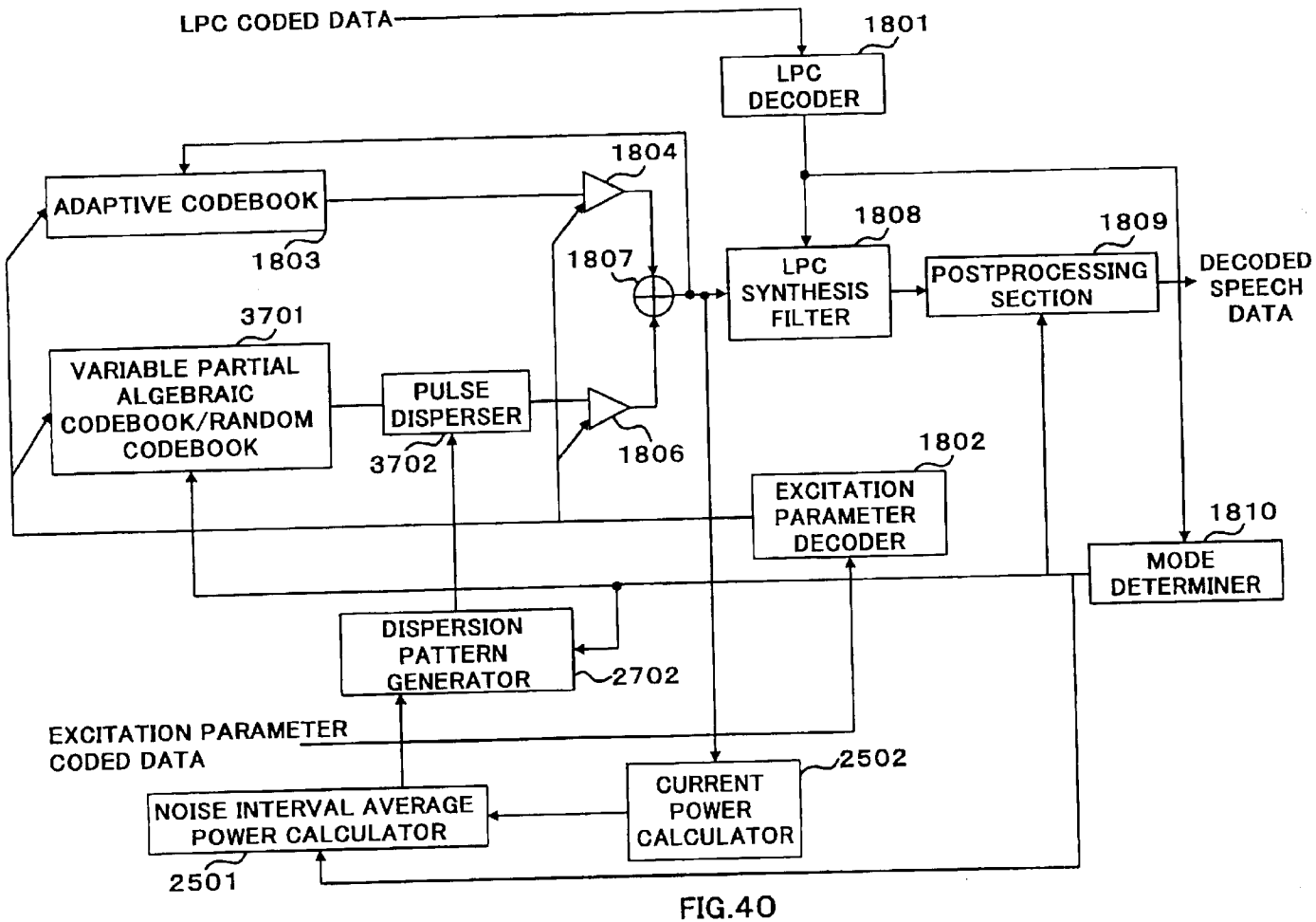
FIG. 40 is a block diagram illustrating a configuration of a speech decoding apparatus according to the sixth embodiment of the present invention.

FIG. 39 is a block diagram illustrating a configuration of a speech coding apparatus according to the sixth embodiment, and FIG. 40 is a block diagram illustrating a configuration of a speech decoding apparatus according to the sixth embodiment. In FIG. 39, the same sections as those in FIG. 27 are assigned the same reference numerals as in FIG. 27 to omit the detail explanation. Further, in FIG. 40, the same sections as those in FIG. 28 are assigned the same reference numerals as in FIG. 28 to omit the detail explanation.

The speech coding apparatus illustrated in FIG. 39 has variable partial algebraic codebook/random codebook 3601, and pulse disperser 3602 that disperses a pulse of an excitation vector output from variable partial algebraic codebook/random codebook 3601. The dispersion of the pulse of the excitation vector is performed according to a dispersion pattern generated in dispersion pattern generator 3603. The dispersion pattern is determined according to a level of average power of a noise interval obtained in noise interval average power calculator 2401, and mode information from mode determiner 1713.

The speech decoding apparatus illustrated in FIG. 40 has variable partial algebraic codebook/random codebook 3701 in response to the speech coding apparatus illustrated in FIG. 39, and pulse disperser 3702 that disperses a pulse of an excitation vector output from variable partial algebraic codebook/random codebook 3701. The dispersion of the pulse of the excitation vector is performed according to a dispersion pattern generated in dispersion pattern generator 3703. The dispersion pattern is determined according to a level of average power of a noise interval obtained in noise interval average power calculator 2501, and mode information from mode determiner 1810.

Figure 41:
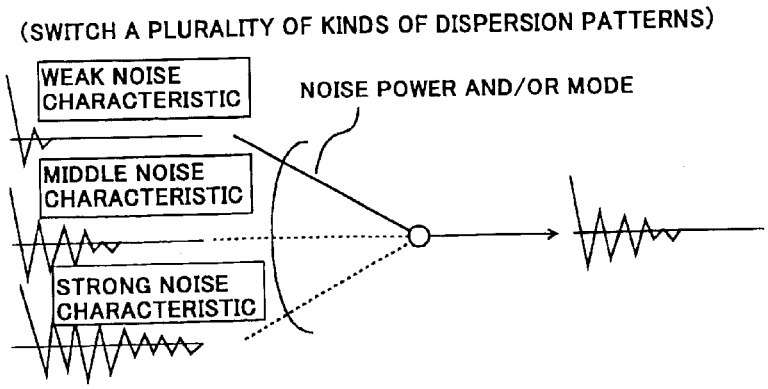
FIG. 41 is a diagram to explain a dispersed pule generator used in the speech coding apparatus and speech decoding apparatus according to the sixth embodiment.
Figure 42:
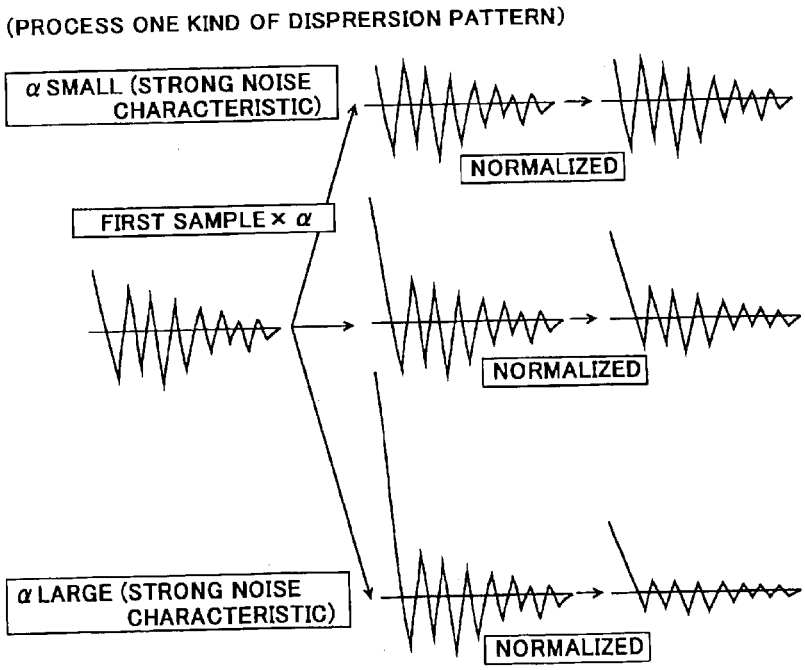
FIG. 42 is a diagram to explain another dispersed pulse generator used in the speech coding apparatus and speech decoding apparatus according to the sixth embodiment.

Dispersion pattern generators 3603 and 3703 respectively in the speech coding apparatus illustrated in FIG. 39 and the speech decoding apparatus illustrated in FIG. 40 generate dispersion patterns as illustrated in FIGS. 41 and 42.

First, in the speech coding apparatus, noise interval average power calculator 2401 calculates an average power level of a noise interval using a power level of a (sub)frame that is previously determined to be a noise interval. The previous average power level of the noise interval is updated sequentially using a power level output from current power calculator 2402. The calculated average power level of the noise interval is output to dispersion pattern generator 3603. Dispersion pattern generator 3603 switches the noise characteristic of a dispersion pattern based on the average power level of the noise interval. In other words, as illustrated in FIG. 41, dispersion pattern generator 3603 has a plurality of noise characteristics set according to levels of average power of noise intervals, and corresponding to the level of average power, selects a noise characteristic. Specifically, when the average power level of a noise interval is high, the generator 3603 selects a dispersion pattern with high (strong) noise characteristic, while when the average power level of a noise interval is low, the generator 3603 selects a dispersion pattern with low (weak) noise characteristic.

Further, it may be possible to switch the noise characteristic of a dispersion pattern between a noise interval and speech interval, In addition, the speech interval may be classified into a voiced interval and unvoiced interval. In this case, this switching is performed so that the noise characteristic of the dispersion pattern is high in the noise interval, and the noise characteristic of the dispersion pattern is low in the speech interval. Moreover, when the speech interval. is classified into the voiced interval and unvoiced interval, the switching is performed so that the noise characteristic of the dispersion pattern is low in the voiced interval, and the noise characteristic of the dispersion pattern is high in the unvoiced interval. The classification into the noise interval and speech interval (voiced interval and unvoiced interval) is separately performed, for example, in mode determiner 1713. The selection of dispersion pattern is performed in dispersion pattern generator 3603 according to the mode information output from mode determiner 1713.

That is, a mode determined in mode determiner 1713 is output to dispersion pattern generator 3603 as the mode information, and based on the mode information, dispersion pattern generator 3603 switches the noise characteristic of a dispersion pattern. In this case, as illustrated in FIG. 41, dispersion pattern generator 3603 has a plurality of noise characteristics set according to modes, and corresponding to the level of average power, selects a level of the noise characteristic corresponding to the mode. Specifically, the generator 3603 selects a dispersion pattern with strong noise characteristic at the time of a noise mode, while selecting a dispersion pattern with weak noise characteristic at the time of a speech (voiced) mode.

Further, dispersion pattern generator 3603 with another configuration changes an amplitude value of a first sample of a dispersion pattern corresponding to a level of average power of a noise interval, and thereby performs the operation equal to the above-mentioned switching successively. Specifically, as illustrated in FIG. 42, the generator 3603 multiplies the amplitude value of the first sample by a factor that increases such amplitude when the average power level of a noise interval is high, while multiplying the amplitude value of the first sample by another factor that decreases such amplitude when the average power level of a noise interval is low. In order to determine these factors using the average power level of a noise interval, a conversion function and conversion role need to be predetermined. In addition, a sample of which the amplitude value is changed is not limited to the first sample. Further, a dispersion pattern multiplied by the factor is normalized so as to have the same vector power as the pattern before being multiplied.

Next, in the speech decoding apparatus, noise interval average power calculator 2501 calculates an average power level of a noise interval using a power level of a (sub)frame that is previously determined to be a noise interval. The previous average power level of a noise interval is updated sequentially using a power level output from current power calculator 2502. The calculated average power level of the noise interval is output to dispersion pattern generator 3703. Dispersion pattern generator 3703 switches the noise characteristic of a dispersion pattern based on the average power level of the noise interval. In other words, as illustrated in FIG. 41, dispersion pattern generator 3703 has a plurality of noise characteristics set according to levels of average power of noise intervals, and corresponding to the level of average power, selects a noise characteristic. Specifically, when the average power level of a noise interval is high, the generator 3703 selects a dispersion pattern with high (strong) noise characteristic, while when the average power level of a noise interval is low, the generator 3703 selects a dispersion pattern with low (weak) noise characteristic.

Further, also in this case, it may be possible to switch the noise characteristic of a dispersion pattern between a noise interval and speech interval, In addition, the speech interval may be classified into a voiced interval and unvoiced interval. In this case, this switching is performed so that the noise characteristic. of the dispersion pattern is high in the noise interval, and the noise characteristic of the dispersion pattern is low in the speech interval. Moreover, when the speech interval is classified into the voiced interval and unvoiced interval, the switching is performed so that the noise characteristic of the dispersion pattern is low in the voiced interval, and the noise characteristic of the dispersion pattern is high in the unvoiced interval. The classification into the noise interval and speech interval (voiced interval and unvoiced interval) is separately performed, for example, in mode determiner 1810. The selection of dispersion pattern is performed in dispersion pattern generator 3703 according to the mode information output from mode determiner 1810.

That is, a mode determined in mode determiner 1810 is output to dispersion pattern generator 3703 as the mode information, and based on the mode information, dispersion pattern generator 3703 switches the noise characteristic of a dispersion pattern. In this case, as illustrated in FIG. 41, dispersion pattern generator 3703 has a plurality of noise characteristics set according to modes, and corresponding to the level of average power, selects a level of the noise characteristic corresponding to the mode. Specifically, the generator 3703 selects a dispersion pattern with strong noise characteristic at the time of a noise mode, while selecting a dispersion pattern with low weak noise characteristic at the time of a speech (voiced) mode.

Further, dispersion pattern generator 3703 with another configuration changes an amplitude value of a first sample of a dispersion pattern corresponding to a level of average power of a noise interval, and thereby changes the noise characteristic of the dispersion pattern successively. Specifically, as illustrated in FIG. 42, the generator 3603 multiplies the amplitude value of the first sample by a factor that increases such amplitude when the average power level of a noise interval is high, while multiplying the amplitude value of the first sample by another factor that decreases such amplitude when the average power level of a noise interval is low. A predetermined conversion function and conversion role lie between the factor and average power level, and thereby it is possible to determine the amplitude conversion factor using average power information. In addition, a sample of which the amplitude value is changed is not limited to the first sample. Further, a dispersion pattern with changed amplitude is normalized so as to have the same vector power as the pattern with the amplitude not changed yet.

With respect to the switching between dispersion pattern noise characteristics according to the average power level of a noise interval, it may be possible to prepare a plurality of kinds with mode information, and switch between dispersion patterns in a combination of mode information and average background noise power information, whereby even at the time of high noise power, it is possible to decrease the noise characteristic of the dispersion pattern to a middle level or less in a speech interval (voiced interval), and thereby possible to improve the speech quality of a noise.

In this embodiment, it may be possible to switch a noise characteristic of a dispersion pattern between a noise interval and speech interval not depending on the power level of a noise interval. In this case, the switching is performed in the same way as the above-mentioned case so that the noise characteristic of the dispersion pattern is high in the noise interval, and the noise characteristic of the dispersion pattern is low in the speech interval. Moreover, when the speech interval is classified into the voiced interval and unvoiced interval, the switching is performed so that the noise characteristic of the dispersion pattern is low in the voiced interval, and the noise characteristic of the dispersion pattern is high in the unvoiced interval.

While the above-mentioned sixth embodiment explains the case of using a variable partial algebraic codebook/random codebook, the present invention is applicable to a case of using a general algebraic codebook.

The present invention is not limited to the above embodiments, and is capable of being carried into practice with various modifications thereof. Further, it may be possible to configure an apparatus according to anyone of the above-mentioned embodiments as software. For example, a corresponding excitation vector generating program may be stored in a ROM to operate according instructions from a CPU. Further, the excitation vector generating program may be stored in a computer readable storage medium, the excitation vector generating program stored in the storage medium may be stored in a RAM of a computer, and thereby the operation is performed according to the program. In such cases, the same functions and effects as in the above-mentioned embodiments are obtained.

As described above, according to the present invention, it is possible to reduce a size of a random codebook by generating only combinations such that at least two pulses are adjacent among a plurality of excitation pulses generated from an algebraic codebook. In particular, by storing excitation vectors effective on an unvoiced segment and stationary noise segment in a portion of a size corresponding to a reduced size, it is possible to provide a speech coding apparatus and speech decoding apparatus enabling improved qualities with respect to the unvoiced segment and stationary noise segment.

Further in a system such that modes are classified into a mode corresponding to an unvoiced segment and stationary noise segment and another mode corresponding to portions (for example, speech segment) other than the above portion, adaptively switching the size to be reduced is capable of provide a speech coding apparatus and speech decoding apparatus enabling further improved qualities with respect to the unvoiced segment and stationary noise segment.

This application is based on the Japanese Patent Applications No.HEI11-059520 filed on Mar. 5, 1999, and No.HEI11-314271 filed on Nov. 5, 1999, entire contents of which are expressly incorporated by reference herein.

INDUSTRIAL APPLICABILITY

The present invention is applicable to a base station apparatus and communication terminal apparatus in a digital radio communication system.

What is claimed is:

1. A speech coding/decoding apparatus comprising:

a partial algebraic codebook for generating excitation vectors, each comprised of two or more excitation pulses;

limiting means for limiting an interval between at least a pair of the excitation pulses to be relatively short, in an excitation vector among the excitation vectors; and a random codebook used adaptively, corresponding to a size, with respect to the number of candidate vectors that may be generated, of the partial algebraic codebook.

2. The speech coding/decoding apparatus according to claim 1, wherein the limiting means controls the length of the interval using a relative relationship between a candidate position number (index) of each excitation pulse and changes the number of candidate relative-relationships for each pair of excitation pulses in accordance with whether the excitation vector corresponds to voiced speech or non-voiced speech.

3. The speech coding/decoding apparatus according to claim 1, wherein the size of the random codebook, with regard to the number of entries therein, is adaptively increased within a range of a decreased size of the partial algebraic codebook.

4. The speech coding/decoding apparatus according to claim 1, wherein the random codebook comprises a plurality of channels for generating excitation vectors comprised of excitation pulses and positions of the excitation pulses generated by the plurality of channels are limited so as not to overlap between the channels.

5. A base station apparatus comprising the speech coding/decoding apparatus according to claim 1.

6. A communication terminal apparatus comprising the speech coding/decoding apparatus according to claim 1.

* * * * *